US005995631A

United States Patent [19]

Kamada et al.

[11] Patent Number: 5,995,631

[45] Date of Patent: Nov. 30, 1999

[54] SOUND IMAGE LOCALIZATION APPARATUS, STEREOPHONIC SOUND IMAGE ENHANCEMENT APPARATUS, AND SOUND IMAGE CONTROL SYSTEM

[75] Inventors: Kenji Kamada; Akihiro Fujita; Koji Kuwano, all of Hamamatsu, Japan

[73] Assignee: Kabushiki Kaisha Kawai Gakki Seisakusho, Japan

[21] Appl. No.: 08/898,029

[22] Filed: Jul. 22, 1997

[30] Foreign Application Priority Data

Jul. 23, 1996 [JP] Japan ..... 8-212021
Aug. 20, 1996 [JP] Japan ..... 8-238591

[51] Int. Cl.[6] ..... H04R 5/00

[52] U.S. Cl. ..... 381/1; 381/17

[58] Field of Search ..... 381/1, 17, 61, 381/63, 307, 309, 310

[56] References Cited

U.S. PATENT DOCUMENTS 4,980,914 12/1990 Kunugi et al. ..... 381/1
5,684,881 11/1997 Serikawa et al. ..... 381/1

FOREIGN PATENT DOCUMENTS

WO9416538 7/1994 WIPO .

OTHER PUBLICATIONS

"As to RSS" by Roland K.K. Japan, pp. 676–677, Japanese Acoustic Society vol. 48, No. 9, Jan. 1992. (This reference is discussed in the application).

*Primary Examiner*—Vivian Chang
*Attorney, Agent, or Firm*—Christie, Parker & Hale, LLP

[57] ABSTRACT

A stereophonic sound image enhancement apparatus subtracts a right input signal from a left input signal and amplifies the subtracted signal to produce a difference signal, and also subtracts a right crosstalk signal from a left low-frequency-range enhanced signal obtained by filtering the left input signal. Then, the difference signal is added to this subtracted signal, and the added signal is outputted as a left output signal. Also, the left crosstalk signal is subtracted from a right low-frequency-range enhanced signal obtained by filtering the right input signal, and the difference signal is subtracted from the subtracted signal to output the subtraction result as a right output signal. Furthermore, a sound image control apparatus applies a left-channel head related transfer function to a monophonic input signal to output the resultant signal as a left input signal "Lin", and also applies a right-channel head related transfer function to this monophonic input signal "Min" to output the resultant signal as a right input signal "Rin". The sound image control apparatus performs a crosstalk canceling process operation with respect to these left input signal "Lin" and right input signal "Rin", and further mixes the left input signal "Lin" and the right input signal "Rin" with signals having phases reverse to those of the left/right input signals. Finally, the signals processed by the crosstalk canceling process and the mixing process are mixed with each other.

11 Claims, 41 Drawing Sheets

Lout
R8
C4
R7
FIRST ADDER
13a
RIGHT CROSSTALK SIGNAL
LEFT CROSSTALK SIGNAL
Rout
R10
C5
R9
SECOND ADDER
13b
12a
FIRST LOW-PASS FILTER
12b
SECOND LOW-PASS FILTER
11a
FIRST GROUP DELAY EQUALIZER
11b
SECOND GROUP DELAY EQUALIZER
BIAS
C1
VCC
R1
R2
R4
OP1
BIAS
R3
C2
Lin
10
Min
R6
OP2
BIAS
R5
C3
Rin WHERE, $C = -\frac{A}{S}$

SOUND IMAGE LOCALIZATION APPARATUS, STEREOPHONIC SOUND IMAGE ENHANCEMENT APPARATUS, AND SOUND IMAGE CONTROL SYSTEM

BACKGROUND OF THE INVENTION

1. Field of the Invention

The present invention generally relates to a sound image localization apparatus, a stereophonic sound image enhancement apparatus, and a sound image control system suitably used in various acoustic devices, for instance, electronic musical instruments, game machines, and sound mixers. More specifically, the present invention is directed to a sound image localization apparatus capable of realizing sound image localization by a loudspeaker by employing a simple analog circuit, to a stereophonic sound image enhancement apparatus capable of enhancing a sound image in response to a stereophonic sound signal in a two-channel loudspeaker reproduction, and to a sound image control apparatus for localizing a sound image to an arbitrary position in a three-dimensional space in response to a monophonic sound signal.

2. Description of the Related Art

Conventionally, such a technical idea is known in the field that 2-channel stereophonic signals are produced, and these stereophonic signals are supplied to right/left loudspeakers so as to simultaneously produce stereophonic sounds, so that sound images may be localized. In accordance with this sound image localization technique, the sound images are localized by changing the balance in the right/left sound volume, so that the sound images could be localized only between the right/left loudspeakers.

To the contrary, very recently, several techniques have been developed by which sound images can be localized outside the right/left loudspeakers. That is, in the first prior art to reproduce the sounds by way of the two right/left loudspeakers, the sound having the reverse phase with respect to the phase of the right-channel sound is mixed with the left-channel sound, and also the sound having the reverse phase with respect to the phase of the left-channel sound is mixed with the right-channel sound. As a result, the sound image may be localized outside the left/right loudspeakers. This sort of conventional technique is disclosed in, for instance, WO94/16538 (PCT/US93/12688) entitled "SOUND IMAGE MANIPULATION APPARATUS AND METHOD FOR SOUND IMAGE ENHANCEMENT."

Concretely speaking, in this first conventional technique, the difference signal between the left-channel left input signal and the right-channel right input signal is produced. This difference signal is supplied to the band-pass filter while the amplitude of this difference signal is properly controlled. Then, the difference signal derived from the band-pass filter is added to a one-channel input signal, so that the output signal for this channel is produced. Similarly, the difference signal derived from the band-pass filter is subtracted from the other-channel input signal, so that the output signal for this channel is produced. The respect output signals are supplied to the right/left loudspeakers. In accordance with this first conventional technique, since the sound image can be localized outside the right/left loudspeakers, the sound stage can be greatly enhanced.

Also, as the second conventional technique, the sound image localization technique called as "Schroeder" system is widely known in the field. In this Schroeder system, the sounds which are produced from the left loudspeaker and then reach the right ear of the audience, and also the sounds which are produced from the right loudspeaker and then reach the left ear (will be referred to as "crosstalk sounds" hereinafter) are canceled, so that the sound listening conditions through the headphone are established. As a consequence, the sound images can be localized not only between the right/left loudspeakers, but also arbitrary positions, for example, a position on one side of the audience.

Furthermore, as the third conventional technique, such a technique is known that since the head related transfer function (head related acoustic transfer function) is added and the crosstalk canceling process is performed by way of the convolution calculation, the sound image can be localized at an arbitrary position (for instance, see "As to RSS" by Roland K. K. JAPAN, Japanese Acoustic Society volume 48, No. 9).

However, the above-described first conventional technique has the following problem. That is, when the sounds are heard at a position apart from the loudspeakers, the audience hears the sound images which are localized outside the right/left loudspeakers. To the contrary, when the sounds are heard at a position close to the loudspeakers, the audience cannot cleary discern where the sound images are localized.

Also, the first conventional technique has another problem. That is, when the mixing ratio of the other-channel sound having the reverse phase to one-channel sound is increased by controlling the magnitude of the difference signal in order to increase the sound stage enhancement effect, the sound quality deteriorates. This quality deterioration is caused because the comb filter characteristic is formed by the monophonic components of the input signal. This sound quality deterioration will appear as such a phenomenon that the audience hears the sounds from which the low frequency components are mainly cut off. When the sound quality deterioration becomes extreme, it becomes difficult to reproduce an input source.

Also, the second conventional technique has a problem that the audience hear the sound image which is close by, resulting in unnatural sounds. In addition, if the above-described crosstalk canceling theory by the Schroeder system is strictly applied to constitute the sound image localization apparatus by employing the analog circuit, then a very large amount of hardware is necessarily required. On the other hand, if the sound image localization apparatus is constituted by employing the software of the digital processor (DSP) or the CPU, execution is very different. As a consequence, conventionally, the sound image localization apparatus with employment of the Schroeder system could be limitedly applied only to the high-grade electronic musical instruments and the high-grade acoustic appliances.

Also, the above-explained third conventional technique owns another problem. That is, when the head related transfer function is added and the crosstalk canceling process operation is carried out by way of the convolution calculation, a large number of convolution stages is required, so that the hardware scale is increased. Conversely, if a total number of the convolution stages is decreased, then a different problem occurs. That is, the low frequency components of the signals which are processed by the head related transfer function are reduced, and also the crosstalk sounds canceled by the crosstalk canceling process are reduced.

SUMMARY OF THE INVENTION

The present invention has been made to solve the above-explained problems, and therefore, an object is to provide a sound image localization apparatus capable of localizing a sound image at an arbitrary position by employing a simple and low-cost analog circuit in a two-channel loudspeaker reproducing mode.

Another object of the present invention is to provide a stereophonic sound image enhancement apparatus capable of enhancing a stereophonic sound image with a simple and low-cost arrangement, and further having less deterioration of sound qualities in a two-channel loudspeaker reproducing mode even when a stereophonic sound image enhancement effect is emphasized.

A further object of the present invention is to provide a stereophonic sound image enhancement apparatus such that even when an audience hears sounds at a position near loudspeakers in a two-channel loudspeaker reproducing mode, the audience can have such a clear feeling of a position where a sound image is localized, and unnatural feelings can be removed by localizing sound images at a position apart from the audience, and furthermore the audience can discern the sound fields.

A still further object of the present invention is to provide a sound image control apparatus capable of increasing precision in a process operation of a head related transfer function and also a crosstalk canceling operation by employing a small scale of hardware without executing a convolution operation.

As shown in FIG. 1, a sound image localization apparatus, according to a first aspect of the present invention, is featured by comprising:

- a first group delay equalizer for delaying a left input signal entered from a left input terminal;
- a first low-pass filter for filtering an output signal derived from the first delay equalizer to output a filtered signal as a left crosstalk signal;
- a second group delay equalizer for delaying a right input signal entered from a right input terminal;
- a second low-pass filter for filtering an output signal derived from the second delay equalizer to output a filtered signal as a right crosstalk signal;
- first calculating means for subtracting the right crosstalk signal from the left input signal to output a subtracted signal as a left output signal; and
- second calculating means for subtracting the left crosstalk signal from the right input signal to output a subtracted signal as a right output signal.

Now, a basic operation idea of this sound image localization apparatus will be simply summarized. When sounds are heard by an audience by using a headphone, sounds to be produced from a left loudspeaker SPL reaches only a left ear of this audience, and sounds to be produced from a right loudspeaker SPR reaches only a right ear of this audience. However, when sounds are heard by an audience by using loudspeakers, as indicated in FIG. 2, sounds produced from a left loudspeaker SPL and sounds produced from a right loudspeaker SPR reach a left ear and a right ear of the audience, respectively. It should be understood that, as illustrated in FIG. 2, a sound which is produced from the left loudspeaker SPL and then directly reaches the left ear of the audience will be referred to as a "left direct sound AL"; a sound produced from the left loudspeaker SPL, which cross-reaches the right ear, will be referred to as a "left crosstalk sound BL"; a sound which is produced from the right loudspeaker SPR and then directly reaches the right ear of the audience will be referred to as a "right direct sound AR," and a sound produced from the right loudspeaker SPR, which cross-reaches the left ear, will be referred to as a "right crosstalk sound BR."

This sound image localization apparatus according to the basic idea of the present invention is controlled in such a manner that only the left direct sound AL can reach the left ear of the audience and only the right direct sound AR can reach the right ear by canceling the above-described left crosstalk sound BL and right crosstalk sound BR. As a result, it is possible to establish similar listening conditions to that by using the headphone, so that the sound images can be localized outside the right/left loudspeakers SPR/SPL.

To establish the above-described listening conditions, the sound having the reverse phase to that of the right crosstalk sound BR is mixed with the sound produced from the left loudspeaker SPL in this sound image localization apparatus. As a result, the right crosstalk sound BR is canceled. Similarly, the sound having the reverse phase to that of the left crosstalk sound BL is mixed with the sound produced from the right loudspeaker SPR in this sound image localization apparatus. As a result, the left crosstalk sound BL is canceled.

Assuming now that a left input signal inputted to the sound image localization apparatus is expressed by "Lin," a right input signal inputted thereto is expressed by "Rin"; a left output signal outputted from the sound localization apparatus is expressed by "Lout," a right output signal outputted therefrom is expressed by "Rout"; first and second group delay equalizers are expressed by a function "G1(s)"; and also first and second low-pass filters are expressed by a product "aG2(s)" made by a coefficient "a" and another function "G2(s)," both the left output signal "Lout" and the right output signal "Rout" may be expressed by the below-mentioned formula (1) and formula (2):

$$\text{Lout}=\text{Lin}-a\text{G1}(s)\text{G2}(s)\text{Rin} \qquad \text{formula (1)}$$

$$\text{Rout}=\text{Rin}-a\text{G1}(s)\text{G2}(s)\text{Lin} \qquad \text{formula (2)}$$

A symbol "aG1(s)G2(s)Rin" contained in the above-described formula (1) indicates a right crosstalk signal corresponding to the right crosstalk sound BR, whereas a symbol "aG1(s)G2(s)Lin" contained in the above-described formula (2) indicates a left crosstalk signal corresponds to the left crosstalk sound BL. As a result, the formula (1) represents that the left output signal "Lout" can be obtained by subtracting the right crosstalk signal from the left input signal "Lin," and the formula (2) represents that the right output signal "Rout" can be obtained by subtracting the left crosstalk signal from the right input signal "Rin."

The above-described first and second group delay equalizers G1(s) may be constructed by an all-pass filter. This all-pass filter owns such a characteristic that although the phase of the output signal varies in response to a change in a frequency, the amplitude of this output signal is not varied. The first group delay equalizer G1(s) simulates left difference time indicative of a difference between the time during which the left direct sound AL reaches the left ear, and the time during which the right crosstalk sound BR reaches the left ear. Similarly, the second group delay equalizer G1(s) simulates right difference time indicative of a difference between the time during which the right direct sound AR reaches the right ear, and the time during which the left crosstalk sound BL reaches the right ear.

As the function G1(s), as indicated by a broken line of FIG. 3, such a function having a group delay which does not depend upon the frequency is ideal. However in a group delay equalizer constructed by an analog circuit, the higher the frequency becomes, the more difficult the large group delay is obtained. On the other hand, in this sound image localization apparatus, the Inventors could confirm by their experiments that when the group delay was equalized up to, for example, on the order of 2 kHz, the sufficient effect could be achieved. As a consequence, the first and second group delay equalizers G1(s) may be realized by, for example, a group delay equalizer having group delay time of 180$\mu$ expressed by the below-mentioned formula (3):

$$G1(s) = \frac{s^2 - 2\zeta\omega_0 s + \omega_0^2}{s^{2+} 2\zeta\omega_0 s + \omega_0^2}, \qquad \text{formula (3)}$$

where symbol "$\omega_0$" indicates an angular frequency at which the phase becomes 180°, symbol "$\zeta$" shows an attenuation rate ($\zeta$=½Q), and symbol "s" denotes a Laplace operator (j$\omega$).

In FIG. 3, there is shown by a solid line, a group delay time characteristic of the first and second group delay equalizers when $\omega_0$=3386 Hz and $\zeta$=1 are set in the above-described formula (3). As apparent from FIG. 3, this group delay time characteristic represents a quasi-idea group delay time characteristic near 2 kHz.

The output signal from the first group delay equalizer is supplied to the first low-pass filter, and the output signal from the second group delay equalizer is supplied to the second low-pass filter. As to the function aG2(s) indicative of the first and second low-pass filters, the coefficient "a" denotes lowering of sound volumes based on the above-described left difference time and right difference time. This coefficient "a" may be selected to be on the order of 0.5 to 1.0.

The crosstalk sound becomes indistinct sounds effected by the head related transfer function, namely softer sounds than direct sounds. The first and second low-pass filters own a function capable of obtaining such a sound similar to this crosstalk sound by equalizing the characteristic of such a crosstalk sound. In other words, these first and second low-pass filters may approximate the head related transfer function.

The function G2(s) represents, for instance, a first-order low-pass filter having a cut-off frequency of 1 to 2 kHz. This function G2(s) may be expressed by, for example, the following formula (4):

$$G2(s) = \frac{Rs + \varpi_0}{s + \omega_0}, \qquad \text{formula (4)}$$

where symbol "$\omega_0$" indicates a cut-off angular frequency, symbol "R" denotes an attenuation suppressing value, and symbol "s" represents a Laplace operator.

FIG. 4 represents a frequency characteristic of the function G2(s) when the cut-off angular frequency=1,700 Hz and the attenuation suppressing value=0.5. As apparent from FIG. 4, the characteristic of the first and second low-pass filters are different from the characteristic of the general-purpose low-pass filter. That is, the attenuation of the amplitude of the signal in the high frequency range is suppressed to gently descend, and then is saturated near −6 dB. The left crosstalk signal derived from the first low-pass filter is supplied to the second calculating means, and the right crosstalk signal derived from the second low-pass filter is supplied to the first calculating means.

The first and second calculating means may be arranged by adders, respectively. The first calculating means produces the left output signal "Lout" by subtracting the right crosstalk signal from the left input signal "Lin". Similarly, the second calculating means produces the right output signal "Rout" by subtracting the left crosstalk signal from the right input signal "Rin".

If the left output signal Lout and the right output signal Rout are supplied to the left loudspeaker and the right loudspeaker, respectively, then the right crosstalk sound BR derived from the right loudspeaker and the left crosstalk sound BL derived from the left loudspeaker can be canceled. Accordingly, since only the direct sounds from the right loudspeaker reach the right ear of the audience and the only the direct sounds from the left loudspeaker reach the left ear of the audience, it is possible to establish such a listening condition similar to that by the headphone. As a consequence, the sound images can be localized not only between the right/left loudspeakers, but also in the broad range around the audience.

The sound image localization apparatus, according to the fist aspect of the present invention, may be arranged by further comprising: distributing means for distributing a monophonic input signal to the left input signal and the right input signal, and wherein the left input signal derived from the distributing means is supplied to the left input terminal, and the right input signal derived from the distributing means is supplied to the right input terminal.

This distributing means may be arranged by, for example, a balancer constructed of a variable resistor. Since the distribution ratio of the right input signal to the left input signal is changed by this distributing means, the localization position of the sound image can be varied. In accordance with this sound image localization apparatus, the stereophonic sound image can be enhanced. It should be noted that if this sound image localization apparatus is provided in each of plural parts and the left output signals and the right output signals derived from the respective sound image localization apparatuses are mixed with each other to output the mixed output signals, then it is possible to realize such a sound image localization apparatus capable of controlling a plurality of sound images.

In this sound image localization apparatus, the first group delay equalizer, the second group delay equalizer, the first low-pass filter, the second low-pass filter, the first calculating means, the second calculating means, and the distributing means are constituted by an analog circuit element. As the analog circuit element, for example, an operational amplifier, a resistor, a variable register and a capacitor may be utilized. As a result, the sound image localization apparatus can be made simple and in low cost.

As previously described, in accordance with the sound image localization apparatus according to the first aspect of the present invention, the sound images can be localized at an arbitrary position by employing the simple and low-cost analog circuit in the two-channel loudspeaker reproducing mode.

As represented in FIG. 5A, a stereophonic sound image enhancement apparatus, according to a second aspect of the present invention, is featured by comprising:

a first group delay equalizer for delaying a left input signal entered from a left input terminal;

a first high-pass filter for filtering an output signal derived from the first group delay equalizer to output a filtered signal as a left crosstalk signal;

a first low-pass filter for filtering the left input signal to output a filtered signal as a left low-frequency-range enhanced signal;

a second group delay equalizer for delaying a right input signal entered from a right input terminal;

a second high-pass filter for filtering an output signal derived from the second group delay equalizer to output a filtered signal as a right crosstalk signal;

a second low-pass filter for filtering the right input signal to output a filtered signal as a right low-frequency-range enhanced signal;

subtracting means for subtracting the right input signal from the left input signal;

amplifying means for amplifying an output signal derived from the subtracting means to output an amplified signal as a difference signal;

first calculating means for subtracting the right crosstalk signal from the left low-frequency-range enhanced signal, and also for adding a subtraction result to the difference signal to thereby output an addition result as a left output signal; and second calculating means for subtracting the left crosstalk signal from the right low-frequency-range enhanced signal, and also for subtracting the difference signal from a subtracted signal to thereby output a subtraction result as a right output signal.

In this stereophonic sound image enhancement apparatus, a difference signal is firstly produced by subtracting the right input signal from the left input signal. Next, this difference signal is added to the left input signal to thereby produce the left output signal. Similarly, this difference signal is subtracted from the right input signal to thereby produce the right output signal. When this left output signal is supplied to the left loudspeaker and this right output signal is supplied to the right loudspeaker, the sound image can be localized outside the right/left loudspeakers.

The subtracting means subtracts the right input signal Rin from the left input signal Lin. As a result, the difference signal (Lin−Rin) is produced. This difference signal is multiplied by the coefficient "b" by the amplifying means, and the amplified signal is supplied to the first calculating means and the second calculating means. The coefficient "b" defines a degree of broad feelings, and may be selected to be 0.0 to 1.0.

Assuming now that the first and second group delay equalizers are expressed by a product "cG3(s)" between a coefficient "c" and a function G3(s); the first and second low-pass filters are expressed by a function "G4'(s)"; and the first and second high-pass filters are expressed by another function "G4(s)", the left output signal "Lout" may be expressed by the following formula (5) and the right output signal "Rout" may be expressed by the following formula (6):

$$\mathrm{Lout}(s)=\mathrm{Lin}\,G4'(s)+b(\mathrm{Lin}-\mathrm{Rin})-aG3(s)G4(s)\mathrm{Rin} \qquad \text{formula (5)}$$

$$\mathrm{Rout}(s)=\mathrm{Rin}\,G4'(s)+b(\mathrm{Rin}-\mathrm{Lin})-aG3(s)G4(s)\mathrm{Lin} \qquad \text{formula (6)}$$

In this case, the reason why the first and second high-pass filters G4(s) are employed is given as follows. That is, an audience does not have the capability of recognizing a localization direction with respect to such a sound image which is formed by low frequencies such as a bass guitar, and a bass drum. Generally speaking, accordingly, a stereophonic signal is produced in such a manner that sounds of low frequencies may be heard from a center position between right/left loudspeakers. In other words, the signals corresponding to the low frequency components are contained in the left-channel signal and the right-channel signal in the ratio of 50% to 50%, and the same phase are produced by the left-channel signal and the right-channel signal. Therefore, there are few phase differences between the signal corresponding to the low frequency component contained in the left-channel signal and the signal corresponding to the low frequency component contained in the right-channel signal. As a consequence, when such a signal produced by executing a predetermined process operation to the right input signal Rin (namely, signal delayed by second group delay equalizer) is subtracted from the left input signal Lin, since the sounds with the low frequencies are canceled by each other, the bass sounds are decreased. This phenomenon is similarly applied to such a case that a signal produced by executing a predetermined process operation to the left input signal Lin (namely, signal delayed by first group delay equalizer) is subtracted from the right input signal Rin.

As a consequence, in order to remove the low frequency components from the respective output signals derived from the first and second group delay equalizers, the first and second high-pass filters are employed. The cut-off frequency "f1" of the function G4(s) employed in these first and second high-pass filters may be selected to be on the order of 100 Hz. Under this condition, such a frequency characteristic of G4(s) indicated by a solid line is represented in FIG. 6.

However, even when the first and second high-pass filters are provided, there is no clear recognition that lowering of the bass sounds can be sufficiently suppressed. Accordingly, first and second low-pass filters having such a frequency characteristic as shown by a broken line of FIG. 6 are employed. The first and second low-pass filters produce a left low-frequency-image emphasized signal and a right low-frequency-range emphasized signal. In the left low-frequency-range emphasized signal, the bass sound range of the left input signal Lin is emphasized. In the right low-frequency-range emphasized signal, the bass sound range of the right input signal Rin is emphasized. Then, both the left low-frequency-range emphasized signal and the right crosstalk signal derived from the second high-pass filter are calculated to thereby produce the left output signal Lout. Similarly, both the right low-frequency-range emphasized signal and the left crosstalk signal derived from the first high-pass filter are calculated to thereby produce the right output signal Rout. As a result, it is possible to obtain the sounds with better qualities from the bass sound range to the treble sound range.

In the above-described formula (5), symbol "cG3(s)G4(s)Rin" indicates the right crosstalk signal, whereas in the formula (6), symbol "cG3(s)G4(s)Lin" indicates the left crosstalk signal. Also, symbol "b(Rin−Lin)" indicates such a signal obtained by multiplying the following difference signal by the coefficient "b". This difference signal is obtained by subtracting the right input signal Rin from the left input signal Lin. This signal "b(Rin−Lin)" may apply the broad feelings.

The function G4'(s) indicative of the first and second low-pass filters owns a characteristic approximated to the reverse characteristic of the function G4(s). As a consequence, the formula (5) indicates that the left output signal Lout is produced by adding "b(Rin−Lin)" to such a signal obtained by subtracting the right crosstalk signal from the signal produced by filtering the left input signal Lin by the first low-pass filter. Similarly, the formula (6) indicates that the right output signal Rout is produced by subtracting "b(Rin−Lin)" from such a signal obtained by further subtracting the left crosstalk signal from the signal produced by filtering the right input signal Rin by the second low-pass filter.

As apparent from FIG. 6, it should be understood that when the cut-off frequency of the function G4'(s) is lower than the cut-off frequency of the function G4(s), the frequency range in which no broadening control is carried out will be produced. However, this frequency range is the bass sound range, and since the audiences cannot sense the direction of the sound image with respect to the low frequencies, there is no practical problem.

The first and second group delay equalizers may be realized by employing those in the above-described sound image localization apparatus. The output signals derived from these first and second group delay equalizers are supplied to the first and second high-pass filters. The coefficient "c" of the first and second group delay equalizers may be selected to be on the order of 0.5 to 1.0.

As indicated by a broken line of FIG. 6, the first and second low-pass filters G4'(s) may be constructed by having a characteristic approximated to the reverse characteristic of G4(s). The left low-frequency-range emphasized signal derived from the first low-pass filter is supplied to the first calculating means, and the right low-frequency-range emphasized signal derived from the second low-pass filter is supplied to the second calculating means.

The first and second calculating means may be arranged by a calculating circuit having, for example, an operational amplifier. The first calculating means subtracts the right crosstalk signal from the left low-frequency-range emphasized signal, and then adds the difference signal to this subtraction result so as to output the addition result as the left output signal Lout. Similarly, the second calculating means subtracts the left crosstalk signal from the right low-frequency-range emphasized signal, and then subtracts the difference signal from this subtraction result so as to output the subtraction result as the right output signal Rout.

As a consequence, if the left output signal Lout and the right output signal Rout are supplied to the left loudspeaker and the right loudspeaker, such sounds from which both the right crosstalk sound and the left crosstalk sound have been canceled may be produced. In addition, the difference signal is added to the left input signal Lin, and then the addition result is subtracted from the right input signal Rin, so that the sound images can be localized not only between the right and left loudspeakers, but also in the broad range around the audience. Furthermore, the stereophonic sound image can be greatly enhanced, as compared with the above-explained sound image localization apparatus.

Similar to the case of the above-described sound image localization apparatus, this sound image localization apparatus may be arranged, as shown in FIG. 5B, in such a way that the respective output signals derived from the first and second group delay equalizers are filtered by the third and fourth low-pass filters $G_{LPF}(S)$ indicated by the below-mentioned formula (7), and the filtered output signals are supplied to the first and second high-pass filters:

$$G_{LPF}(s) = \frac{Rs + \varpi_0}{s + \omega_0}, \qquad \text{formula (7)}$$

where symbol "$\omega_0$" indicates a cut-off angular frequency, symbol "R" denotes an attenuation suppressing value, and symbol "s" shows a Laplace operator. These third and fourth low-pass filters are arranged by the same structures of the first and second low-pass filters employed in the above-described sound image localization apparatus, and own the same functions and effects as those of these first and second low-pass filters.

In this stereophonic sound image enhancement apparatus, the first group delay equalizer, the first high-pass filter, the first low-pass filter, the second group delay equalizer, the second high-pass filter, the second low-pass filter, the subtracting means, the amplifying means, the first calculating means, the second calculating means, the third low-pass filter, and the fourth low-pass filter are constituted by an analog circuit element. As the analog circuit element, for instance, an operational amplifier, a resistor, a capacitor, and the like may be employed. As a consequence, the stereophonic sound image enhancement apparatus may be made simple and in low cost.

It should be noted that although the above-described subtracting means is so arranged as to produce the difference signal by subtracting the right input signal Rin from the left input signal Lin, this difference signal may be produced by subtracting the left input signal Lin from the right input signal Rin. In this case, the first calculating means may be arranged in such a manner that the difference signal derived from the amplifying means is subtracted from the subtraction result obtained by subtracting the output signal derived from the second high-pass filter from the output signal derived from the first low-pass filter, and this subtraction result is outputted as the left output signal Lout to the left output terminal. Similarly, the second calculating means may be arranged in such a manner that the difference signal derived from the amplifying means is added to the subtraction result obtained by subtracting the output signal derived from the first high-pass filter from the output signal derived from the second low-pass filter, and this addition result is outputted as the right output signal Rout to the right output terminal.

As previously explained, in accordance with the stereophonic sound image enhancement apparatus according to the second aspect of the present invention, the stereophonic image can be enhanced without any deterioration in the sound quality in the two-channel loudspeaker reproducing mode, and further with the simple and low-cost arrangement.

Also, as indicated in FIG. 7, a stereophonic sound image enhancement apparatus, according to a third aspect of the present invention, is featured by comprising:

crosstalk canceling means for producing a first left signal Lm1 formed by subtracting a right crosstalk signal from a left input signal Lin, and a first right signal Rm1 formed by subtracting a left crosstalk signal from a right input signal Rin;

reverse-phase signal producing means for producing a second left signal Lm2 formed by mixing a reverse-phase signal of the right input signal Rin with the left input signal Lin, and a second right signal Rm2 formed by mixing a reverse-phase signal of the left input signal Lin with the right input signal Rin; and mixing means for mixing the first left signal Lm1 derived from the crosstalk canceling means with the second left signal Lm2 derived from the reverse-phase signal producing means to thereby produce a left output signal Lout, and also for mixing the first right signal Rm1 derived from the crosstalk canceling means with the second right signal Rm2 derived from the reverse-phase signal producing means to thereby produce a right output signal Rout.

The above-described crosstalk canceling means is effected to localize the sound image formed by the left input signal Lin and the right input signal Rin near the ears of the audience. Also, the reverse-phase signal producing means is effected to broaden the sound image formed by these left input signal Lin and right input signal Rin outside the right/left loudspeakers. Accordingly, the first left signal Lm1 and the second left signal Lm2 are mixed with each other at the proper mixing rate to form the left output signal Lout in the mixing means. Also, the first right signal Rm1 and the second right signal Rm2 are mixed with each other at the proper mixing rate to form the right output signal Rout. Then, when the sounds are produced based on these left output signal Lout and right output signal Rout, the sound images can be localized at the positions apart from the audience and along such a wide direction from the just-transverse direction of the audience to the front face direction thereof.

As represented in FIG. 8, the above-described crosstalk canceling means may be constituted by:

left crosstalk signal producing means for producing the left crosstalk signal based on the left input signal Lin;

right crosstalk signal producing means for producing the right crosstalk signal based on the right input signal Rin;

a left-channel crosstalk calculator for subtracting the right crosstalk signal from the left input signal Lin;

a first left-channel crosstalk filter for filtering a signal derived from the left-channel crosstalk calculator to produce the first left signal Lm1;

a right-channel crosstalk calculator for subtracting the left crosstalk signal from the right input signal Rin; and a first right-channel crosstalk filter for filtering a signal derived from the right-channel crosstalk calculator to produce the first right signal Rm1.

The above-explained left crosstalk signal producing means may be arranged by a left-channel crosstalk attenuator, a left-channel crosstalk delay device, and a second left-channel crosstalk filter. This left crosstalk signal producing means produces the left crosstalk signal in such a way that the left input signal Lin is attenuated by the left-channel crosstalk attenuator, this attenuated signal is delayed by the left-channel crosstalk delay device, and then this delayed signal is filtered by the second left-channel crosstalk filter.

Similarly, the above-explained right crosstalk signal producing means may be arranged by a right-channel crosstalk attenuator, a right-channel crosstalk delay device, and a second right-channel crosstalk filter. This right crosstalk signal producing means produces the right crosstalk signal in such a way that the right input signal Rin is attenuated by the right-channel crosstalk attenuator, this attenuated signal is delayed by the right-channel crosstalk delay device, and then this delayed signal is filtered by the second right-channel crosstalk filter.

The respective gains of the above-described left-channel crosstalk attenuator and right-channel crosstalk attenuator are variable within a range between 0 and 1. Also, the above-explained second left-channel crosstalk filter and second right-channel crosstalk filter may be arranged by a primary IIR type filter, respectively. Furthermore, the respective delay amounts of the left-channel crosstalk delay device and the right-channel crosstalk delay device may be set to approximately 8 sampling points in such a case that the analog signal is sampled at the frequency of 48 kHz to thereby produce the digital signal.

Also, the filter coefficients of the first left-channel crosstalk filter and the first right-channel crosstalk filter may be formed based on the gain of either the left-channel crosstalk attenuator, or the right-channel crosstalk attenuator, and also the filter coefficient of either the second left-channel crosstalk filter or the second right-channel crosstalk filter.

As shown in FIG. 9, the above-described reverse-phase signal producing means is constituted by:

a left-channel reverse-phase attenuator for attenuating the left input signal Lin;

a left-channel reverse-phase delay device for delaying an output signal derived from the left-channel reverse-phase attenuator;

a right-channel reverse-phase attenuator for attenuating the right input signal Rin;

a right-channel reverse-phase delay device for delaying an output signal derived from the right-channel reverse-phase attenuator;

a left-channel reverse-phase calculator for subtracting the output signal derived from the right-channel reverse-phase delay device from the output signal derived from the left-channel reverse-phase attenuator to thereby produce the second left signal Lm2; and a right-channel reverse-phase calculator for subtracting the output signal derived from the left-channel reverse-phase delay device from the output signal derived from the right-channel reverse-phase attenuator to thereby produce the second right signal Rm2.

The left-channel reverse-phase attenuator attenuates the left input signal Lin and then supplies the attenuated left input signal to the left-channel reverse-phase calculator and the left-channel reverse-phase delay device. The left-channel reverse-phase delay device delays the output signal derived from the left-channel reverse-phase attenuator by predetermined delay time and then supplies the delayed signal to the right-channel reverse-phase calculator. Similarly, the right-channel reverse-phase attenuator attenuates the right input signal Rin and then supplies the attenuated right input signal to the right-channel reverse-phase calculator and the right-channel reverse-phase delay device. The right-channel reverse-phase delay device delays the output signal derived from the right-channel reverse-phase attenuator by predetermined delay time and then supplies the delayed signal to the left-channel reverse-phase calculator.

The left-channel reverse-phase calculator subtracts the output signal derived from the right-channel reverse-phase delay device from the output signal derived from the left-channel reverse-phase attenuator. This subtracted signal is equal to such a signal produced by mixing the signal having the reverse phase to that of the right input signal Rin with the left input signal Lin. The output signal derived from this left-channel reverse-phase calculator is supplied as the second left signal Lm2 to the above-explained mixing means. Similarly, the right-channel reverse-phase calculator subtracts the output signal derived from the left-channel reverse-phase delay device from the output signal derived from the right-channel reverse-phase attenuator. This subtracted signal is equal to such a signal produced by mixing the signal having the reverse phase to that of the left input signal Lin with the right input signal Rin. The output signal derived from this right-channel reverse-phase calculator is supplied as the second right signal Rm2 to the above-explained mixing means.

The respective gains of the above-described left-channel reverse-phase attenuator and right-channel reverse-phase attenuator are variable within a range between 0 and 1. Furthermore, the respective delay amounts of the left-channel reverse-phase delay device and the right-channel reverse-phase delay device may be set to approximately 8 sampling points in such a case that the analog signal is sampled at the frequency of 48 kHz to thereby produce the digital signal.

As indicated in FIG. 10, the mixing means may be arranged by the left-channel mixer and the right-channel mixer. The left-channel mixer mixes the first left signal Lm1 derived from the crosstalk canceling means with the second left signal Lm2 derived from the reverse-phase signal producing means. As this left-channel mixer, an adder may be employed. The output signal derived from this left-channel mixer is externally outputted as the left output signal Lout. Similarly, the right-channel mixer mixes the first right signal Rm1 derived from the crosstalk canceling means with the second right-signal Rm2 derived from the reverse-phase signal producing means. As this right-channel mixer, an adder may be employed. The output signal derived from this right-channel mixer is externally outputted as the right output signal Rout.

The above-explained crosstalk canceling means, reverse-phase signal producing means, and mixing means may be constituted by executing, for instance, the process operation by the digital signal processor (DSP). At this time, in order to secure the real-time characteristic of the signal processing operation, it is preferable to perform the time-divisional multiplexing process operation.

In accordance with the stereophonic sound image enhancement apparatus with employment of the above-described arrangement, the sounds produced based on the left output signal Lout can be entered only to the left ear, and the sounds produced based on the right output signal Rout can be entered only to the right ear by way of the crosstalk canceling means. As a result, the audience can hears the panned sound images that are near the right/left ears.

Also, the left-channel input sounds can be localized at the left-sided position apart from the left-sided loudspeaker, and the right-channel input sounds can be localized at the right-sided position apart from the right-sided loudspeaker by the reverse-phase signal producing means. As a consequence, the audience hears the panned sound images outside of the right/left loudspeakers.

Also, the sound image localized near the right/left ears by the crosstalk canceling means is mixed with the sound image localized outside the right/left loudspeakers by the reverse-phase signal producing means by using the mixing means, so that it is possible to form the sound stage having the very broad feelings which could not be realized in the prior art system.

Furthermore, while the mixing ratio is varied, the input signal is directly outputted, the input signal is processed only by the crosstalk canceling process to output the crosstalk-canceled input signal, the input signal is processed only by the reverse-phase signal mixing process to output the mixed input signal, or the input signal is processed by executing both the crosstalk canceling process and the reverse-phase signal mixing process to output the resultant signal. As a result, the magnitude of broadening feelings can be changed. Moreover, the listening point may be set to any points within the wide range by varying the delay amount of the crosstalk canceling means and the delay amount of the reverse-phase signal producing means.

A stereophonic sound image enhancement apparatus, according to a fourth aspect of the present invention, is featured by such a stereophonic sound image enhancement apparatus for executing a predetermined process to a left input signal Lin and a right input signal Rin so as to output processed signals as a left output signal Lout and a right output signal Rout, comprising:

left-channel mixing means for mixing the left input signal Lin, a signal obtained by multiplying the left input signal Lin by a gain "e", and a signal obtained by multiplying the right input signal Rin by the gain "e", by delaying the multiplied right input signal, and further by reversing a phase of the delayed signal with each other;

right-channel mixing means for mixing the right input signal Rin, a signal obtained by multiplying the right input signal Rin by a gain "e", and a signal obtained by multiplying the left input signal Lin by the gain "e", by delaying the multiplied left input signal, and further by reversing a phase of the delayed signal with each other;

left-channel sound quality correcting means for adding a signal obtained by multiplying an output signal derived from the left-channel mixing means by a gain (1−e) to another signal obtained by filtering the output signal derived from the left-channel mixing means by way of a low-pass filter and by multiplying the filtered signal by the gain "e" to thereby output this adding result as the left output signal Lout; and right-channel sound quality correcting means for adding a signal obtained by multiplying an output signal derived from the right-channel mixing means by a gain (1−e) to another signal obtained by filtering the output signal derived from the right-channel mixing means by way of a low-pass filter and by multiplying the filtered signal by the gain "e" to thereby output this adding result as the right output signal Rout.

Also, this stereophonic sound image enhancement apparatus further comprises:

crosstalk canceling means for outputting a left signal and a right signal, corresponding to sounds from which crosstalk sounds have been removed based on the left input signal Lin and the right input signal Rin, and wherein the left-channel mixing means mixes the left signal derived from the crosstalk canceling means, a signal formed by multiplying the left input signal Lin by a gain "e", and a signal formed by multiplying the right input signal Rin by the gain "e", by delaying the multiplied right signal, and by reversing the phase of the delayed/multiplied right signal with each other, and the right-channel mixing means mixes the right signal derived from the crosstalk canceling means, a signal formed by multiplying the right input signal Rin by a gain "e", and a signal formed by multiplying the left input signal Lin by the gain "e", by delaying the multiplied left signal, and by reversing the phase of the delayed/multiplied left signal with each other.

In accordance with this stereophonic sound image enhancement apparatus, since this enhancement apparatus is arranged in such a manner that the filtering effects by the low-pass filters are emphasized in accordance with increasing of the mixing ratio of the reverse-phase signal, the stereophonic sound image enhancement effect can be emphasized without deteriorating the sound qualities.

As illustrated in FIG. 11, a sound image control apparatus, according to a fifth aspect of the present invention, is featured by comprising:

head related transfer function applying means including left-channel head related transfer function applying means for applying a left-channel head related transfer function to a monophonic input signal Min to thereby output the resultant signal as a left input signal Lin, and right-channel head related transfer function applying means for applying a right-channel head related transfer function to the monophonic input signal Min to thereby output the resultant signal as a right input signal Rin;

crosstalk canceling means for producing a first left signal Lm1 formed by subtracting a right crosstalk signal from the left input signal Lin derived from the left-channel head related transfer function applying means, and also a first right signal Rm1 formed by subtracting a left crosstalk signal from the right input signal Rin derived from the right-channel head related transfer function applying means;

reverse-phase signal producing means for producing a second left signal Lm2 formed by mixing the left input signal Lin with a signal having a phase reverse to the phase of the right input signal Rin, and a second right signal Rm2 formed by mixing the right input signal Rin with a signal having a phase reverse to the phase of the left input signal Lin; and mixing means for producing a left output signal Lout by mixing the first left signal Lm1 derived from the crosstalk canceling means with the second left signal Lm2 derived from the reverse-phase signal producing means, and also a right output signal Lout by mixing the first right signal Rm1 derived from the crosstalk canceling means with the second right signal Rm2 derived from the reverse-phase signal producing means.

This sound image control apparatus is realized by employing the left-channel head related transfer function applying means for applying the left-channel head related transfer function to the monophonic input signal "Min", and also the right-channel head related transfer function applying means for applying the right-channel head related transfer function to this monophonic input signal "Min" on the input side of the above-described stereophonic sound image enhancement apparatus according to the fourth aspect. As a consequence, the crosstalk canceling means, the reverse-phase signal producing means, and the mixing means are similar to those of the stereophonic sound image enhancement apparatus according to the fourth aspect.

As indicated in FIG. 12, each of the above-described left-channel head related transfer function applying means and right-channel external ear transfer function applying means may be arranged by:

a direct sound filter for filtering the monophonic input signal "Min";

a delay device for inter aural time difference, capable of delaying an output signal from this direct sound filter;

a reflection sound filter for filtering this monophonic input signal "Min";

a plurality of delay devices $D_1$ to $D_n$ for delaying an output signal derived from this reflection sound filter;

a plurality of amplifiers $G_1$ to $G_n$ for amplifying an output signal derived from each of these delay devices $D_1$ to $D_n$;

a reflection sound adder for adding output signals derived from the plural amplifiers $G_1$ to $G_n$ together; and an adder for adding an output signal derived from this delay device for inter aural time difference to the output signal derived from the reflection sound adder.

The direct sound filter simulates the frequency characteristics of the head related transfer functions of the sounds which directly reach from the sound source (e.g., loudspeaker) to the ears of the audience. The delay device for inter aural time difference simulates the time differences of the sounds at the right/left ears, which directly reach from the sound source to the ears of the audience. The reflection sound filter simulates the changes in the frequencies caused by the reflections occurred in the room. The delay devices $D_1$ to $D_n$, the amplifier units $G_1$ to $G_n$, and the reflection sound adder may simulate the reach times of the reflection sounds to the right/left ears in the room, and the levels of the reflection sounds when reached the right/left ears. Then, the adder adds the signals corresponding to the direct sounds derived from the delay device for inter aural time difference to the signals corresponding to the reflection sounds derived from the reflection sound adder. The adder outputs the summation result as either the left input signal Lin or the right input signal Rin.

The above-described left-channel head related transfer function applying means and right-channel head related transfer function applying means may be arranged by, for instance, the DSP processing operation. In this case, in order to secure the real-time characteristic of the signal processing operation, it is preferable to execute the time-divisional multiplexing process operations.

As described above, since the head related transfer function is applied to the monophonic input signal "Min" by way of the left-channel external transfer function applying means and the right-channel external transfer function applying means, the sound images can be localized at any arbitrary positions while the sounds are heard by using the headphone.

Also, the sounds produced based on the left-channel signal can be entered only to the left ear, and also the sounds produced based on the right-channel signal can be entered only to the right ear by employing the crosstalk canceling means. As a consequence, since the audience may be positioned under similar listening conditions to the headphone listening conditions, the sound images can be localized at any arbitrary positions in the loudspeaker reproducing mode.

Since the reverse-phase signal producing means is employed in this sound image control apparatus, the sound images can be localized at the positions apart from the audience, as compared with the sound image localization by the sound image control apparatus arranged by the crosstalk canceling means and the head related transfer function applying means.

Also, the respective signals produced from the crosstalk canceling means and the reverse-phase signal producing means can be weighted by using the mixing means. In the case that the signal derived from the crosstalk canceling means is mixed with the signal derived from the reverse-phase signal producing means in a preselected mixing ratio, the sound image can be localized at the farmost position from the audience in the two-channel loudspeaker reproducing mode. In such a case that the weight given to the signal derived from the reverse-phase signal producing means is set to zero, it is possible to execute the logically correct sound image control process. Furthermore, in such a case that the weights given to the respective signals derived from the crosstalk canceling means and the reverse-phase signal producing means are set to zero, it is possible to perform the sound image control in the headphone reproducing mode.

Also, the sound image control apparatus, according to the fifth aspect of the present invention, is featured by further comprising:

direction instructing means for instructing a direction along which a sound image is moved, wherein the head related transfer function applying means comprises:

first left-channel head related transfer function applying means for applying a left-channel head related transfer function corresponding to a first direction;

first right-channel head related transfer function applying means for applying a right-channel head related transfer function corresponding to the first direction;

second left-channel head related transfer function applying means for applying a left-channel head related transfer function corresponding to a second direction;

second right-channel head related transfer function applying means for applying a right-channel head related transfer function corresponding to the second direction;

first weighting means for applying a weighting factor "$\alpha$" to the respective signals derived from the first left-channel head related transfer function applying means and from the first right-channel head related transfer function applying means in response to the instruction issued from the direction instructing means;

second weighting means for applying a weighting factor "$1-\alpha$" to the respective signals derived from the second left-channel head related transfer function applying means and from the second right-channel head related transfer function applying means in response to the instruction issued from the direction instructing means;

left mixing means for mixing a signal derived from the first left-channel head related transfer function applying means to which the weighting factor "$\alpha$" has been applied by the first weighting means with another signal derived from the second left-channel head related transfer function applying means to which the weighting factor "$1-\alpha$" has been applied by the second weighting means to thereby produce the left input signal; and right mixing means for mixing a signal derived from the first right-channel head related transfer function applying means to which the weighting factor "$\alpha$" has been applied by the first weighting means with another signal derived from the second right-channel head related transfer function applying means to which the weighting factor "$1-\alpha$"has been applied by the second weighting means to thereby produce the right input signal; under which $0 \leqq \alpha \leqq 1$.

As the above-explained direction instructing means, an apparatus capable of entering continuous values may be employed, e.g., a joy stick, a slide-type variable resistor, and a rotary variable resistor. The instruction issued by this direction instructing means may be reflected on the weighting factor "$\alpha$".

It is now assumed that a sound image is localized along a predetermined direction, to which the head related transfer functions have been applied by the first left-channel head related transfer function applying means and the first right-channel head related transfer function applying means. In this case, the weighting factor "$\alpha$" of the first weighting means is equal to "1", whereas the weighting factor "$\alpha$" of the second weighting means is equal to "0". When a new direction is instructed by the direction instructing means in this condition, the second left-channel head related transfer function applying means and the second right-channel head related transfer function applying means are set to apply the head related transfer functions corresponding to this newly instructed direction. Then, the weighting factor "$\alpha$" is sequentially changed from "0" to "1". As a result, the respective signals derived from the first left-channel head related transfer function applying means and from the first right-channel head related transfer function applying means are mixed in a cross-fade mode with the respective signals derived from the second left-channel head related transfer function applying means and from the second right-channel head related transfer function applying means, and then, the cross-fade-mixed signal is outputted. At the time when the weighting factor "α" becomes "1", only the respective signals are outputted from the second left-channel head related transfer function applying means and from the second right-channel head related transfer function applying means, so that the sound image can be localized in the new direction. As explained above, according to this sound image control apparatus, since the sound image is moved by way of the cross-fade mixing operation, the sound image smoothing movement can be achieved, and further occurrences of noise can be suppressed.

BRIEF DESCRIPTION OF THE DRAWINGS

For a better understanding of the present invention, reference may be made to the accompanying drawings, in which.

DESCRIPTION OF THE PREFERRED EMBODIMENTS

Referring now to drawings, various embodiments of a sound image localization apparatus, a stereophonic sound image enhancement apparatus, and a sound image control apparatus, according to the present invention, will be described in detail.

Embodiment 1

Figure 13:
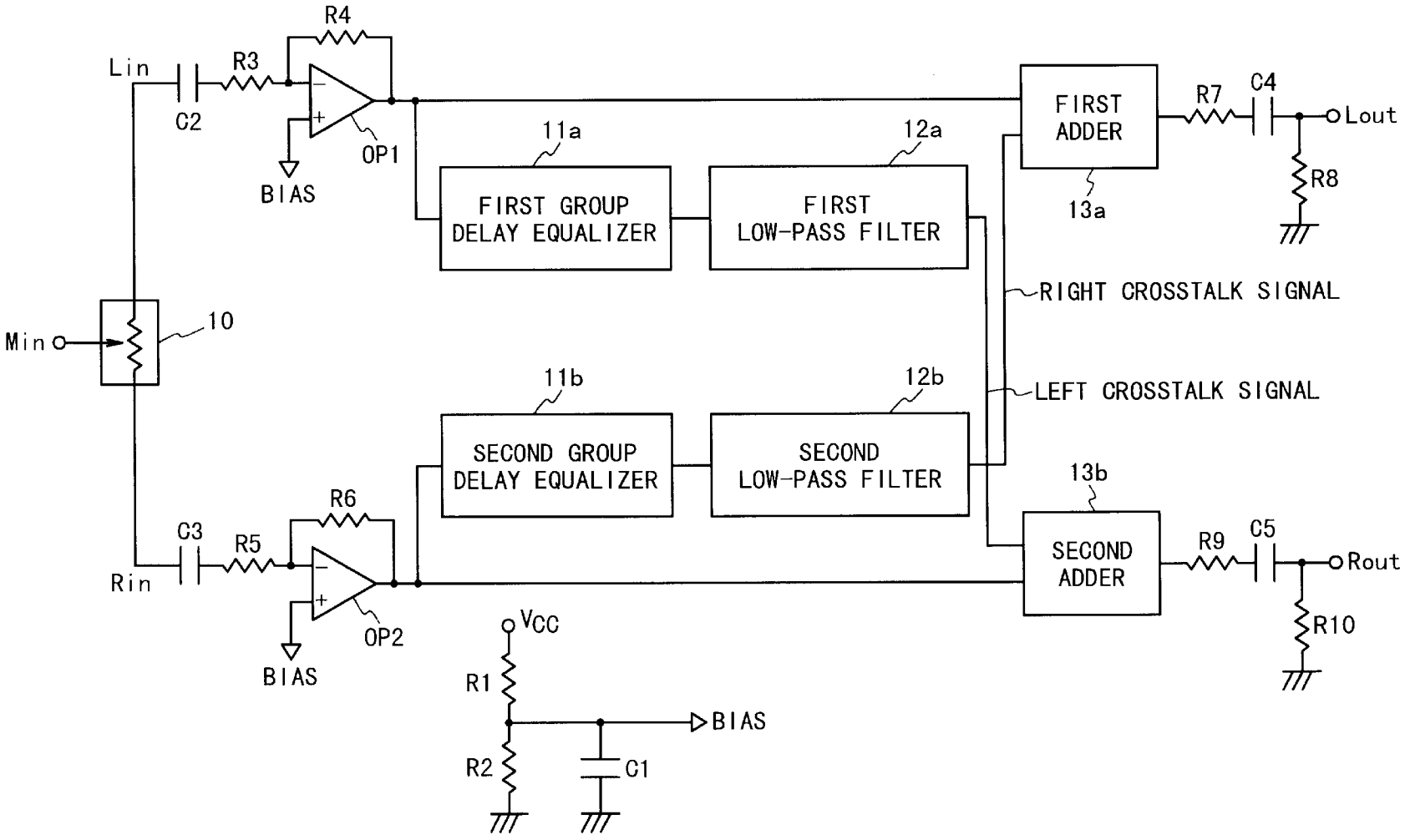
FIG. 13 is a circuit diagram of an embodiment of the sound image localization apparatus according to the first aspect of the present invention.

FIG. 13 schematically shows an electronic circuit arrangement of an embodiment of a sound image localization apparatus according to a first aspect of the present invention. A DC power supply voltage Vcc is applied to this circuit from, for example, a cell (not shown) and the like. This power supply voltage Vcc is subdivided by resistors R1 and R2, and the subdivided power supply voltages are applied to various circuit portions as bias voltages "BIAS."

As a balancer 10, for instance, a variable resistor constructed of a resistance element and a slider may be employed. A monophonic input signal "Min" is supplied to the slider of this balancer 10. This monophonic input signal "Min" is distributed as two sets of signals having amplitudes defined in accordance with a position of this slider. Then, one signal is outputted as a left input signal "Lin" from one output terminal (upper terminal shown in FIG. 13), and the other signal is outputted as a right input signal "Rin" from the other output terminal (lower terminal shown in FIG. 13). The respective amplitudes of the left input signal Lin and the right input signal Rin are varied by this balancer 10, so that a position used to localize a sound image can be adjusted.

A circuit constructed of a capacitor C2, resistors R3, R4 and an operational amplifier OP1 may eliminate noise contained in the left input signal Lin, and also may reverse a phase of this left input signal Lin. The reason why the phase is reversed is to obtain an output signal having a normal phase from a first adder 13*a* (will be described later).

A circuit constructed of a capacitor C3, resistors R5, R6 and an operational amplifier OP2 may eliminate noise contained in the right input signal Rin, and also may reverse a phase of this right input signal Rin. The reason why the phase is reversed is to obtain an output signal having a normal phase from a second adder 13*b* (which will be described later). An output signal derived from the operational amplifier OP1 is supplied to a first group delay equalizer 11*a* and the first adder 13*a*. Similarly, an output signal derived from the operational amplifier OP2 is supplied to a second group delay equalizer 11*b* and the second adder 13*b*.

Figure 14:
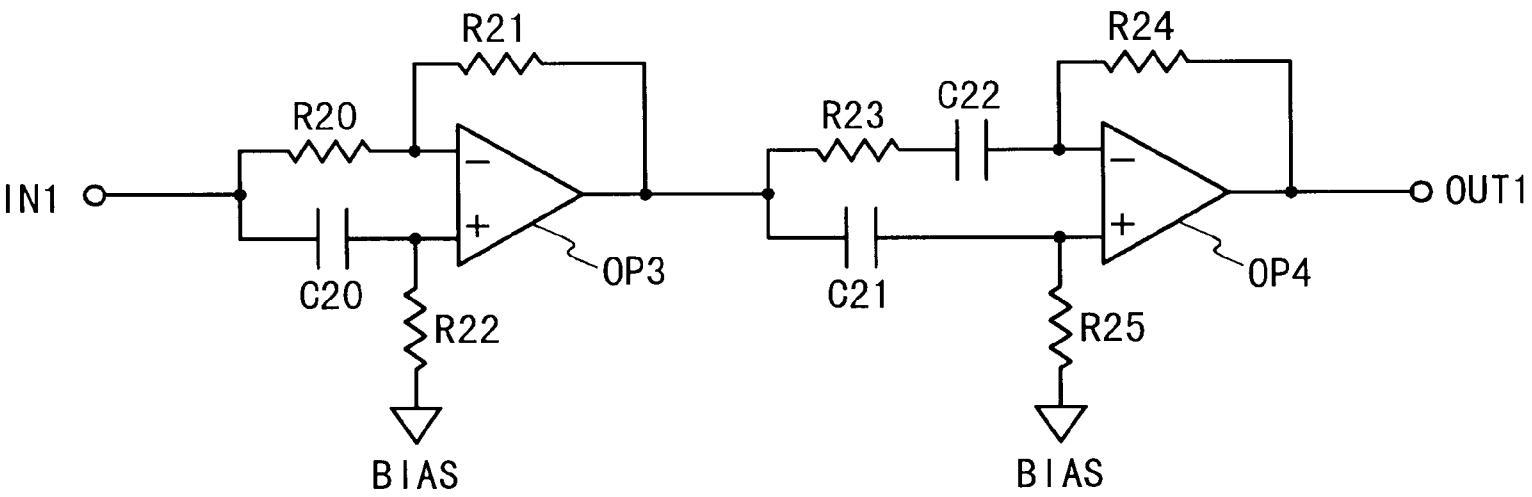
FIG. 14 is a circuit diagram of an embodiment of first and second group delay equalizers shown in FIG. 13.

The first group delay equalizer 11*a* and the second group delay equalizer 11*b* own the same circuit arrangement which is indicated in detail in FIG. 14. The first and second group delay equalizers 11*a* and 11*b* are arranged by such that two stages of the substantially same circuits are combined with each other in a serial manner in order to achieve a sufficiently large delay amount. An output signal derived from the first group delay equalizer 11*a* is supplied to a first low-pass filter 12*a*, and an output signal derived from the second group delay equalizer 12*b* is supplied to a second low-pass filter 12*b*.

Figure 1:
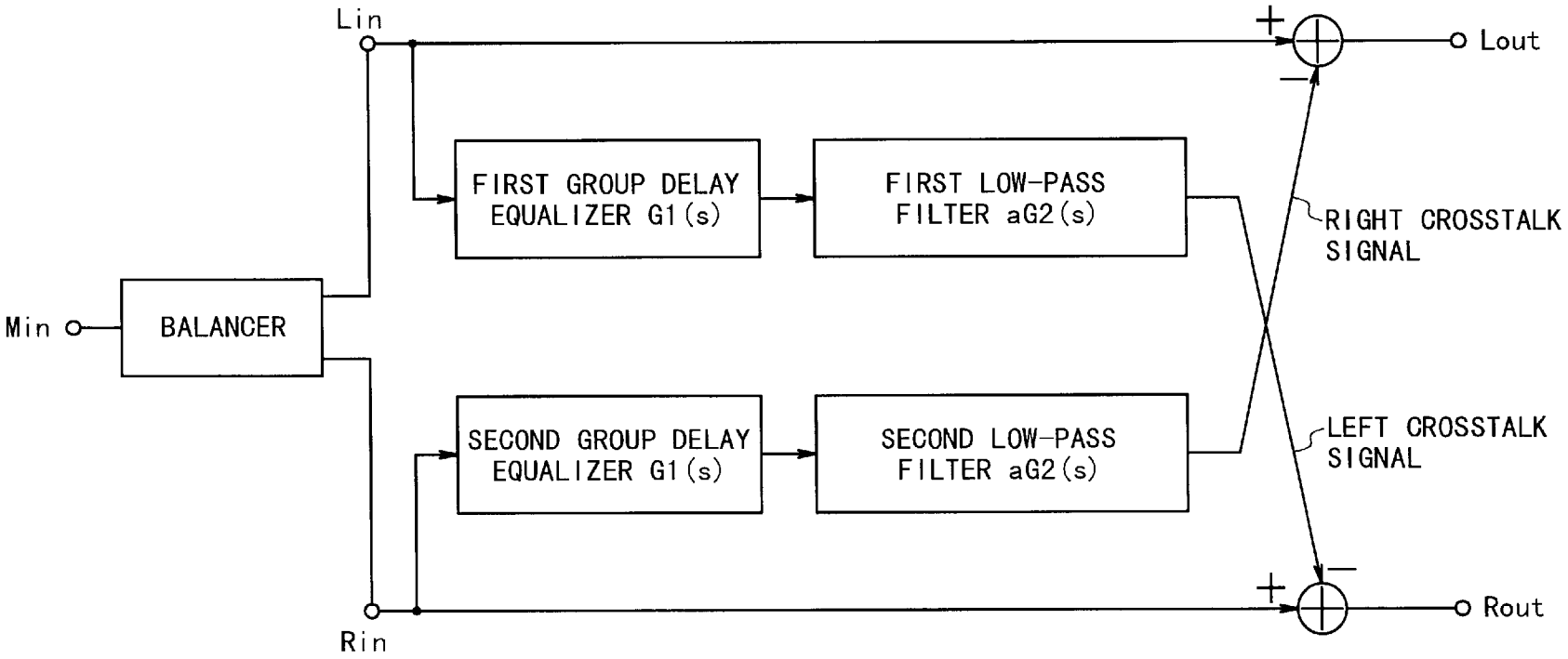
FIG. 1 schematically illustrates an arrangement of a sound image localization apparatus according to a first aspect of the present invention.
Figure 2:
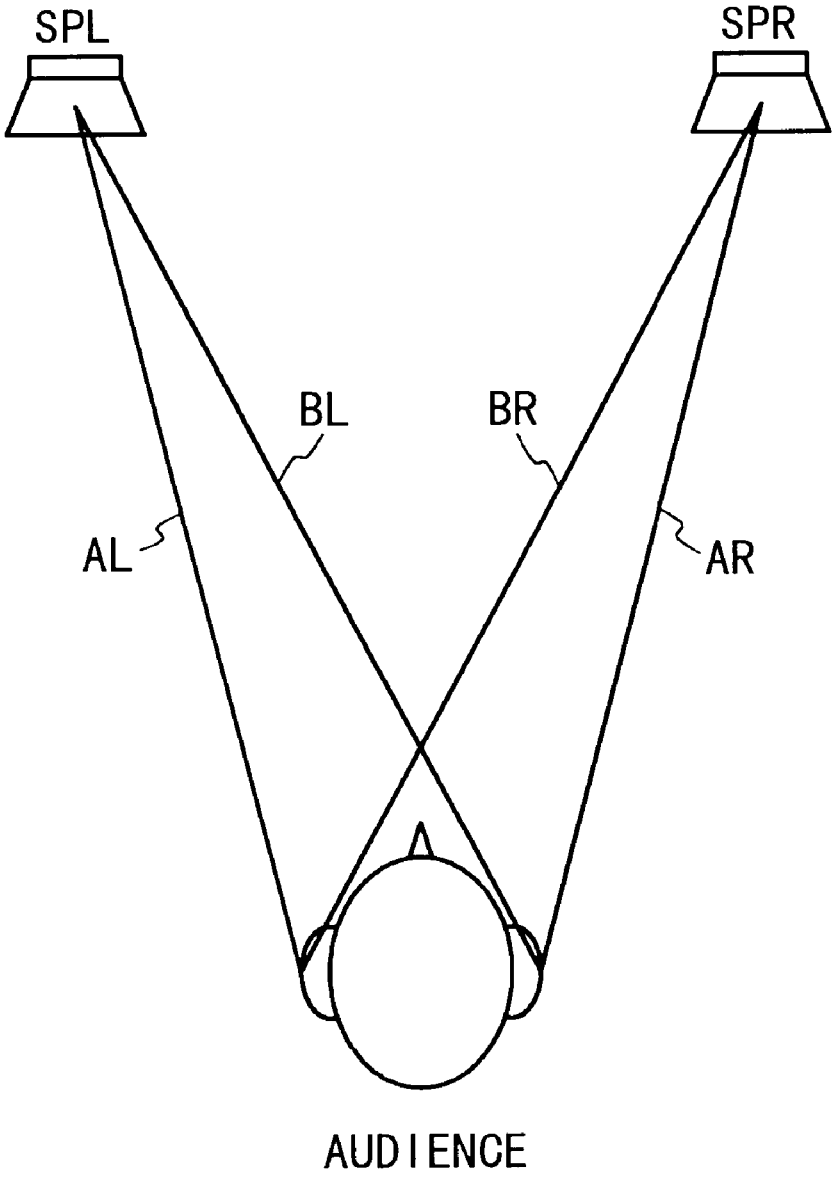
FIG. 2 is an illustration for schematically explaining a basic idea of operations of the sound image localization apparatus according to the first aspect of the present invention.
Figure 3:
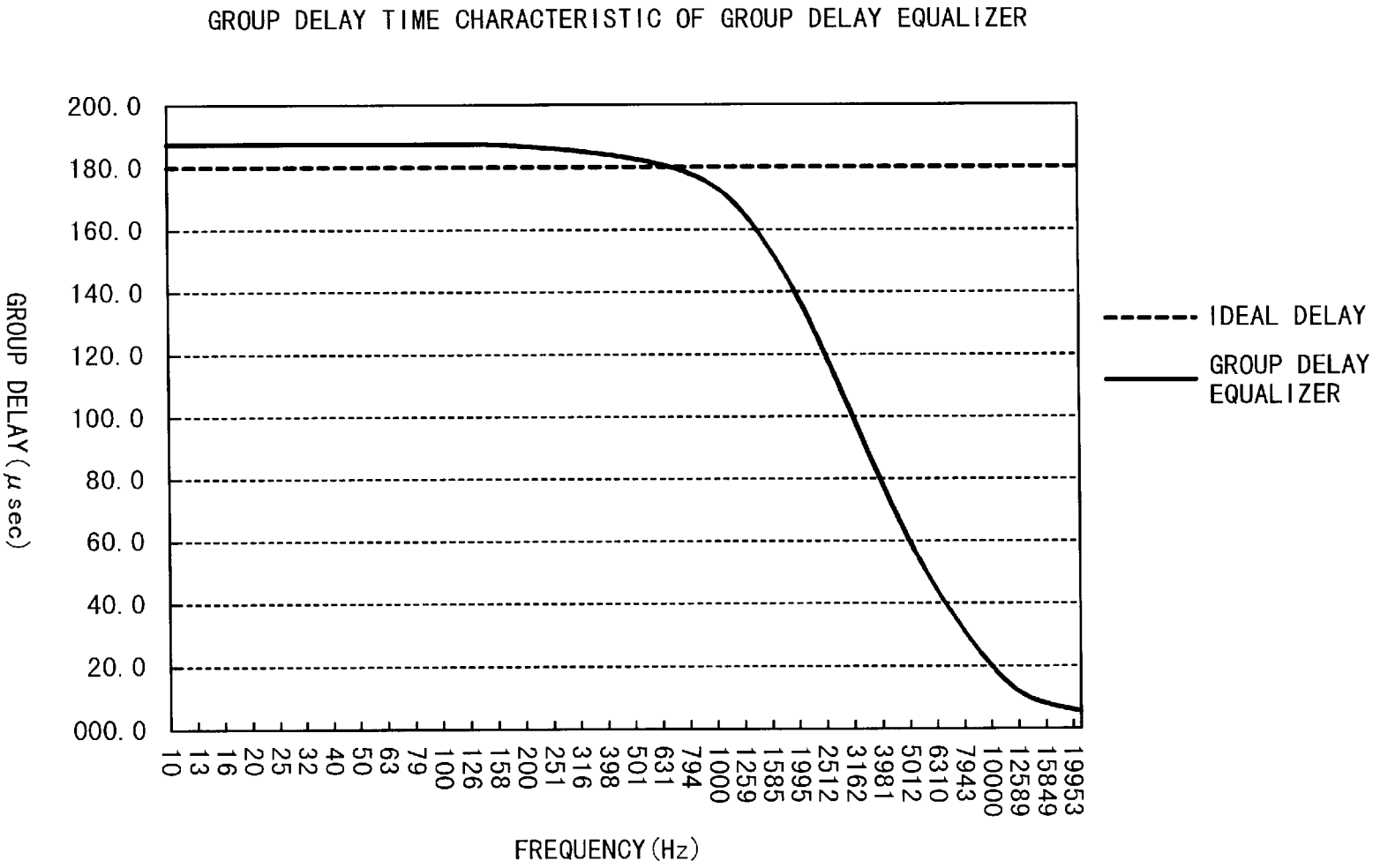
FIG. 3 graphically shows one example of a group delay time characteristic of first and second group delay equalizers employed in the sound image localization apparatus according to the first aspect of the present invention.
Figure 4:
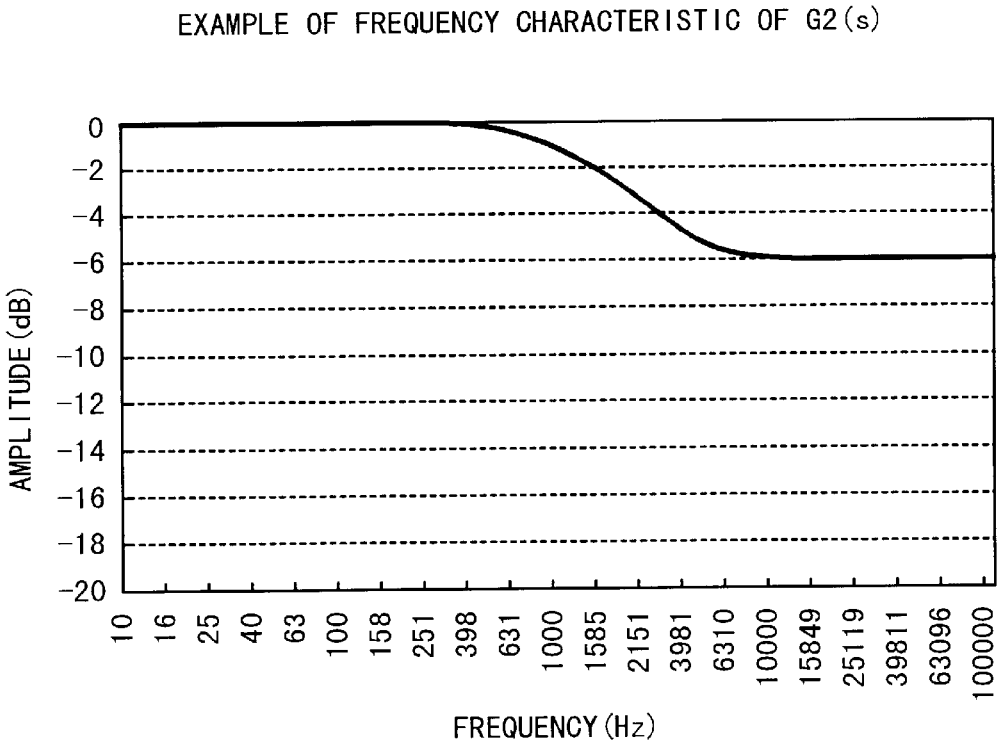
FIG. 4 graphically represents one example of a frequency characteristic of first and second low-pass filters employed in the sound image localization apparatus according to the first aspect of the present invention.
Figure 5A:
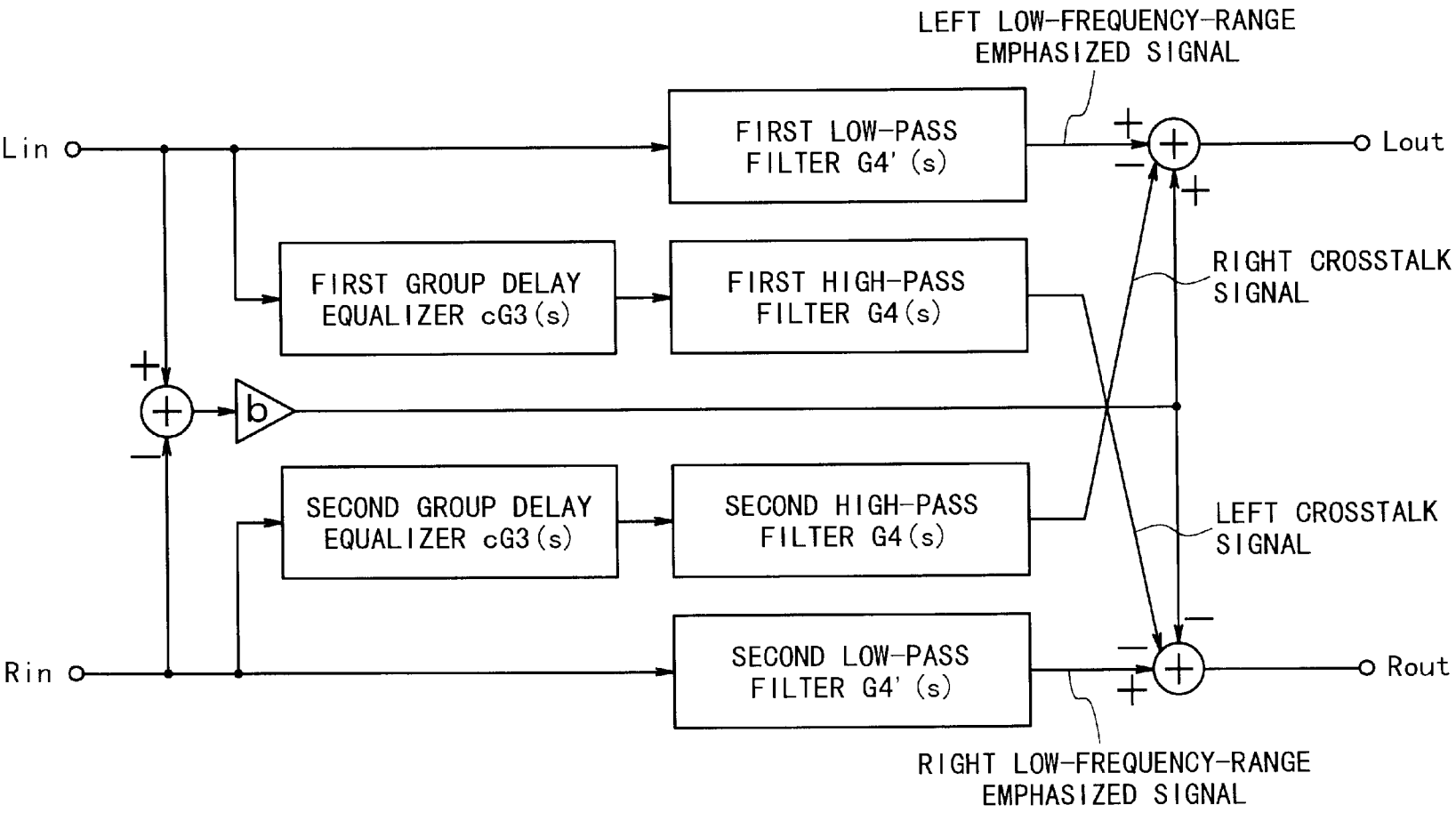
FIG. 5A is a schematic block diagram for indicating an arrangement of a modification example of a stereophonic sound image enhancement apparatus according to a second aspect of the present invention.
Figure 5B:
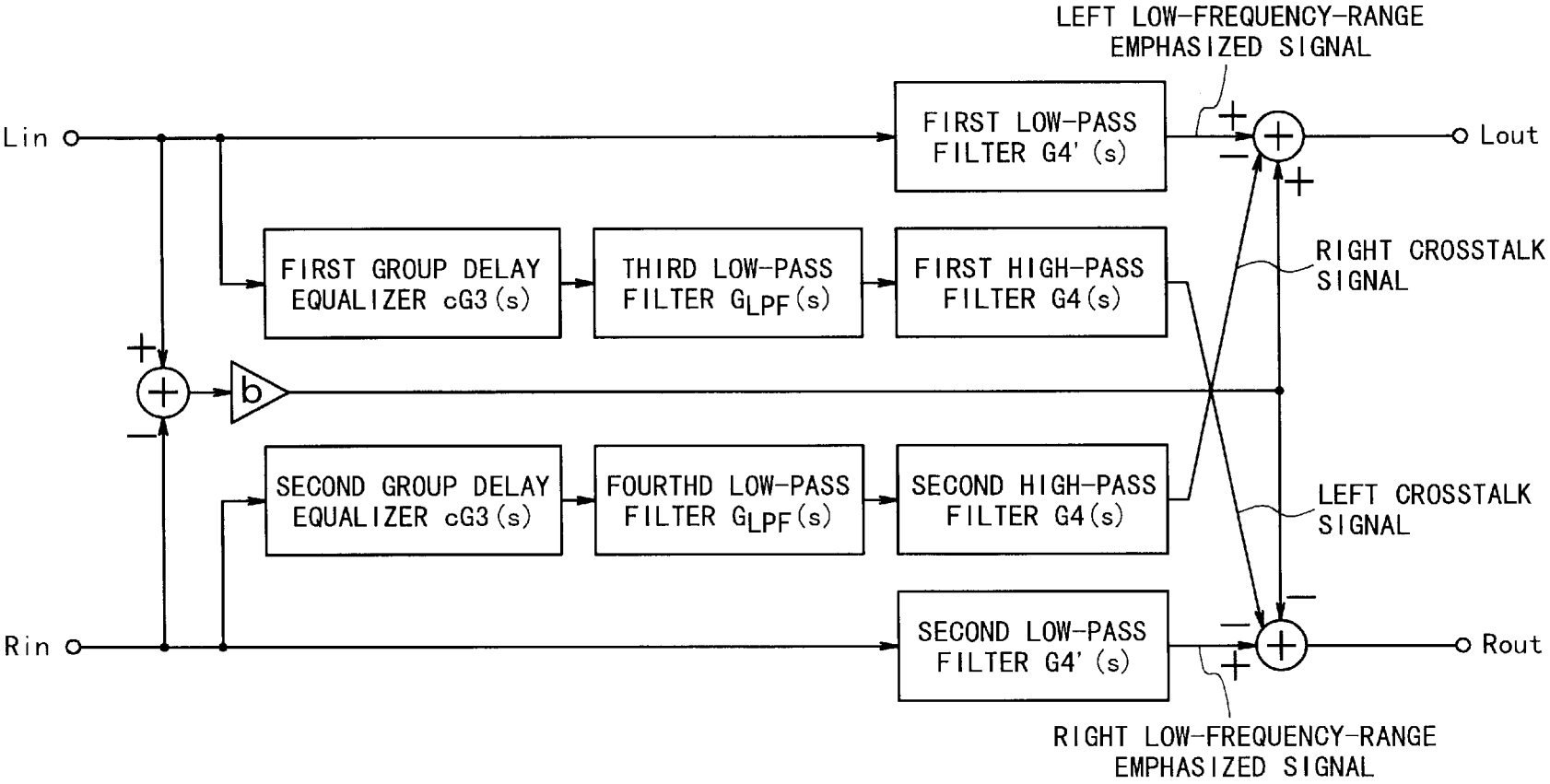
FIG. 5B is a schematic block diagram for indicating an arrangement of a stereophonic sound image enhancement apparatus according to a second aspect of the present invention.
Figure 6:
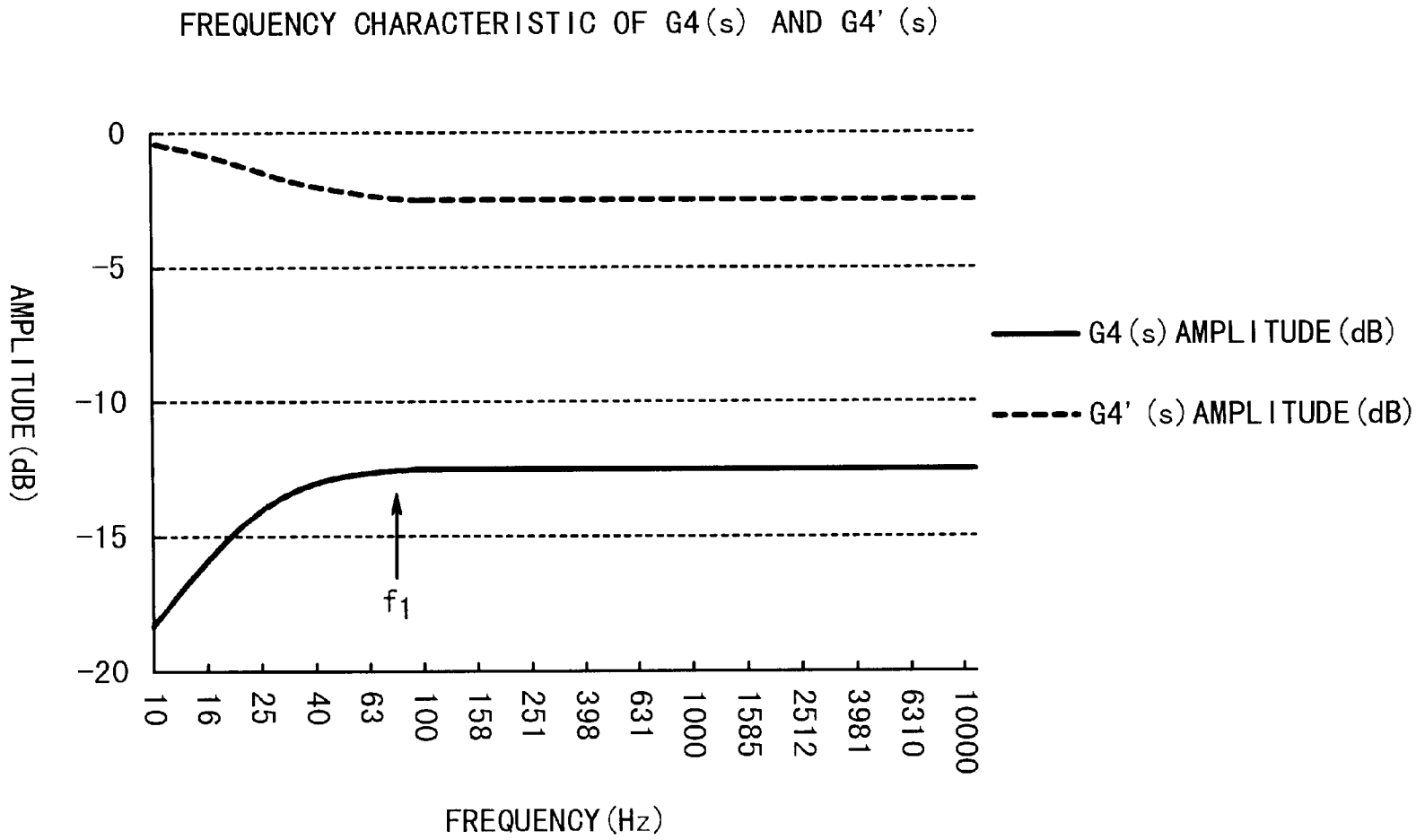
FIG. 6 graphically shows one example of frequency characteristics of first and second high-pass filters, and first and second low-pass filters employed in the stereophonic sound image enhancement apparatus according to the second aspect of the present invention.
Figure 15:
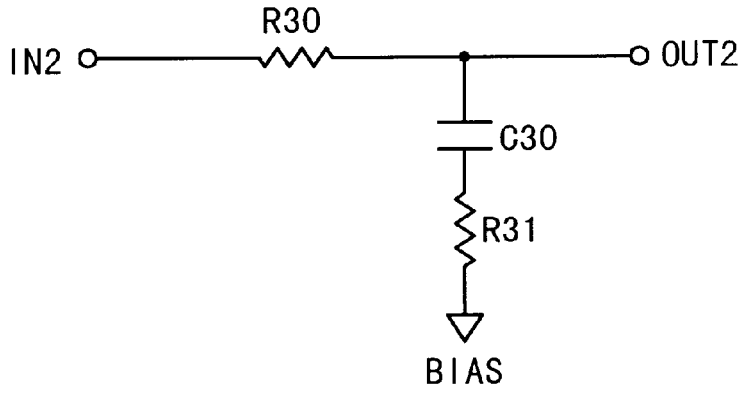
FIG. 15 is a circuit diagram of an embodiment of the first and second low-pass filters shown in FIG. 13.

The first low-pass filter 12*a* and the second low-pass filter 12*b* own the same structure, and are constituted by a primary low-pass filter, respectively. FIG. 15 represents a detailed circuit arrangement for the first and second low-pass filters 12*a* and 12*b*. In FIG. 15, a resistor R31 is used to determine an attenuation suppressing value R. Since this resistor R31 is added, such a frequency characteristic that is saturated near −6 dB, as shown in FIG. 4, can be obtained. An output signal derived from the first low-pass filter 12*a* is supplied to the second adder 13*b*, and an output signal derived from the second low-pass filter 12*b* is supplied to the first adder 13*a*.

Figure 16:
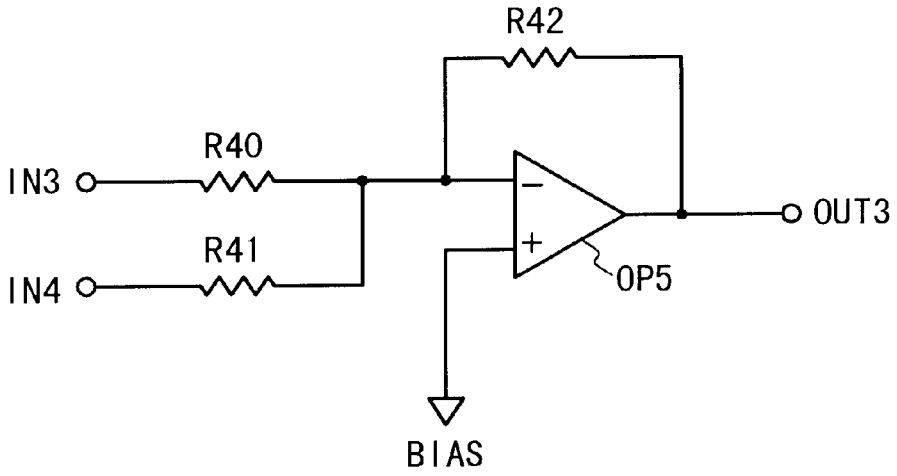
FIG. 16 is a circuit diagram of an embodiment of first and second adders shown in FIG. 13.

The first adder 13*a* and the second adder 13*b* are arranged by the same circuit which is indicated more in detail in FIG. 16.

Considering now the first adder 13*a* for is producing a left output signal Lout, a signal having a phase reversed from the phase of the left input signal Lin is supplied from the operational amplifier OP1 to an input terminal IN3, and a right crosstalk signal having the normal phase is supplied from the second low-pass filter 12*b* to an input terminal IN4. These signals are mixed with each other through resistors R40 and R41. As a result, this mixed signal is equal to such a signal obtained by subtracting the left input signal Lin from the output signal derived from the second low-pass filter 12*b*. This mixed signal is supplied to an inverting input terminal (−) of the operational amplifier OP5. Then, the phase of this mixed signal is inverted by this operational amplifier OP5. As a result, a signal is outputted from the first adder 13*a* (operational amplifier OP5), which is produced by subtracting the right crosstalk signal from the left input signal Lin. Similarly, a signal is outputted from the second adder 13*b*, which is produced by subtracting the left crosstalk signal from the right input signal Rin.

As indicated in FIG. 13, an output signal derived from the first adder 13*a* is externally outputted as a left output signal "Lout." An output signal derived from the second adder 13*b* is externally outputted as a right output signal "Rout."

Figure 17:
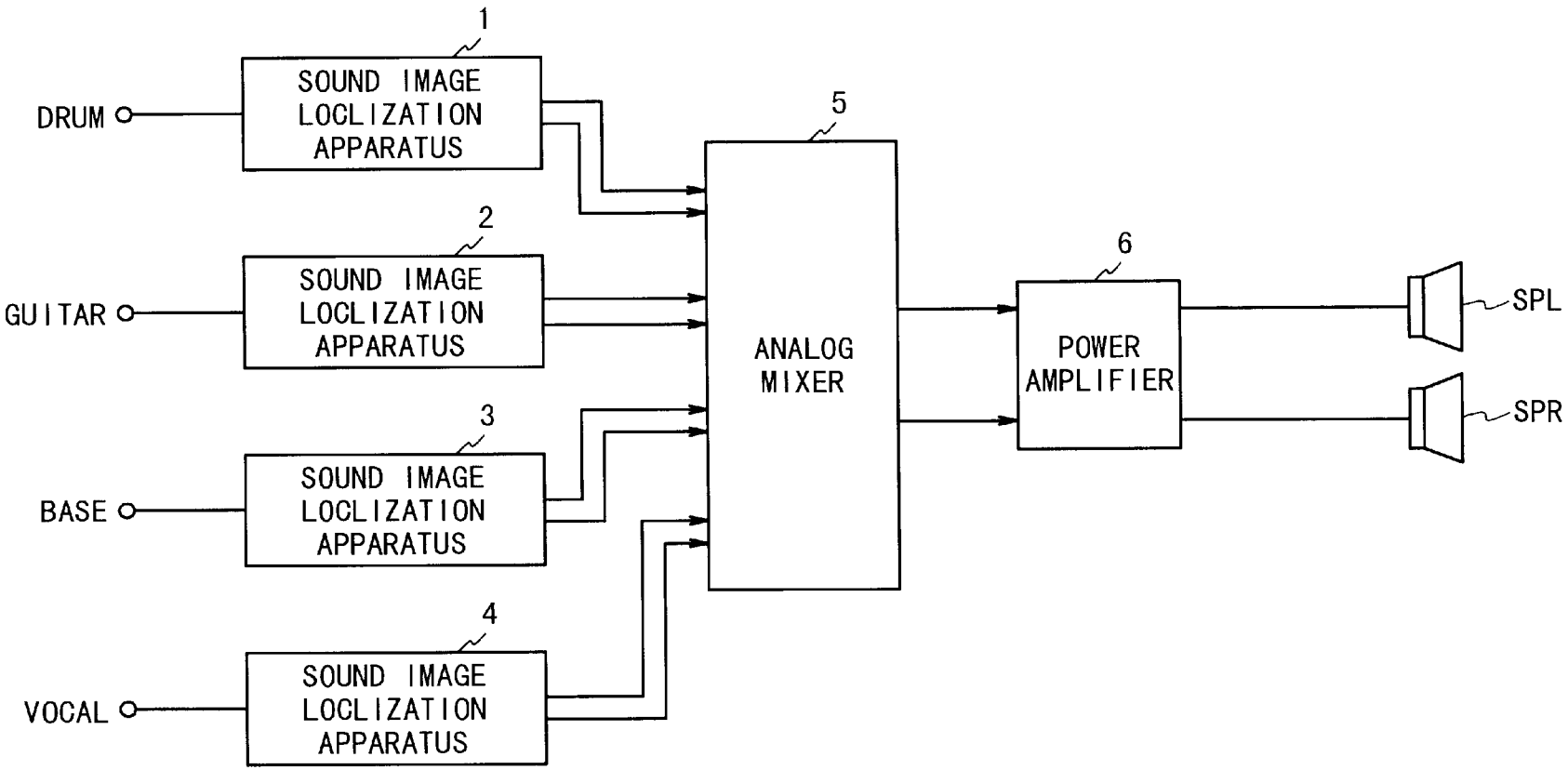
FIG. 17 is a schematic block diagram for representing an application example of the sound image localization apparatus according to the first aspect of the present invention.

In response to one monophonic input signal Min, the above-described sound image localization apparatus may localize one sound image. When a plurality of such sound image localization apparatuses is employed, a plurality of sound images may be localized in response to a plurality of monophonic input signals. FIG. 17 schematically represents a block diagram of the above-explained plural sound image localization apparatuses.

In FIG. 17, each of the sound image localization apparatuses 1 to 4 owns the same arrangement of the above-described sound image localization apparatus. A monophonic signal of a drum part is supplied to the sound image localization apparatus 1, a monophonic signal of a guitar part is supplied to the sound image localization apparatus 2, a monophonic signal of a base part is supplied to the sound image localization apparatus 3, and a monophonic signal of a vocal part is supplied to the sound image localization apparatus 4. The respective sound image localization apparatuses 1 to 4 process the inputted monophonic signals in such a manner that the sound images can be localized, and output the processed monophonic signals as stereophonic signals. These stereophonic signals of the respective parts are supplied to an analog mixer 5. Thus, these stereophonic signals are mixed in the analog mixer 5 as to the left channel and the right channel, and then the mixed stereophonic signals are supplied to a power amplifier 6. Then, both the right-channel and left-channel signals amplified by the power amplifier 6 are supplied to a left loudspeaker SPL and a right loudspeaker SPR.

Figure 18:
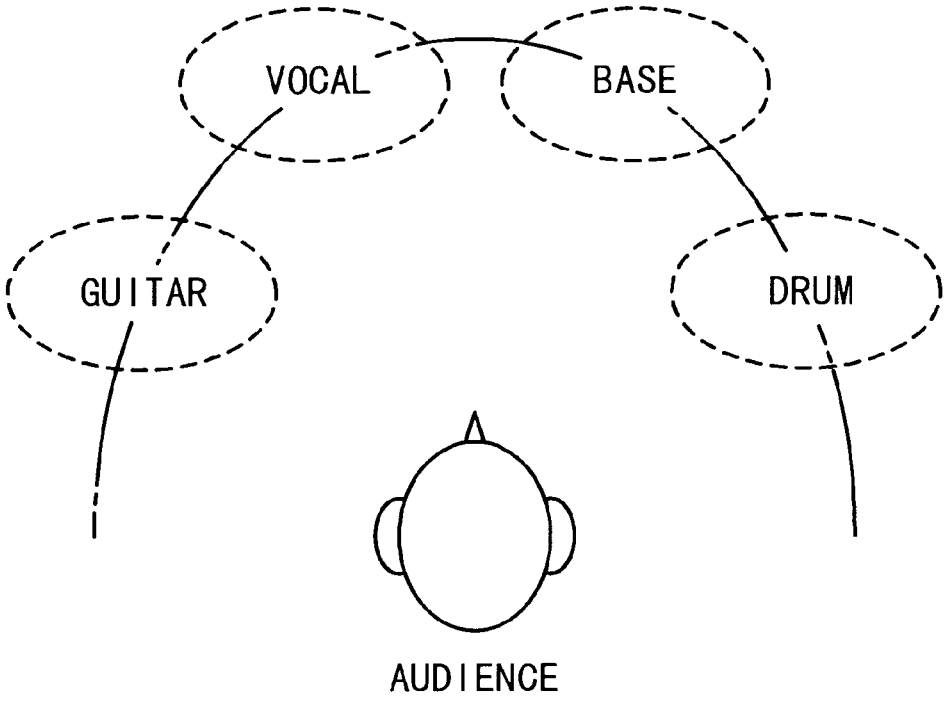
FIG. 18 is an explanatory diagram for explaining operations of the application example of the sound image localization apparatus according to the first aspect of the present invention.

With employment of the above-described arrangements, as represented in, e.g., FIG. 18, since the sound images of the respective parts can be arranged to desirable positions around an audience by adjusting the balancers of the respective sound image localization apparatuses 1 to 4, it is possible to realize realistic musical play approximated to the actual musical play modes.

Embodiment 2

Figure 19:
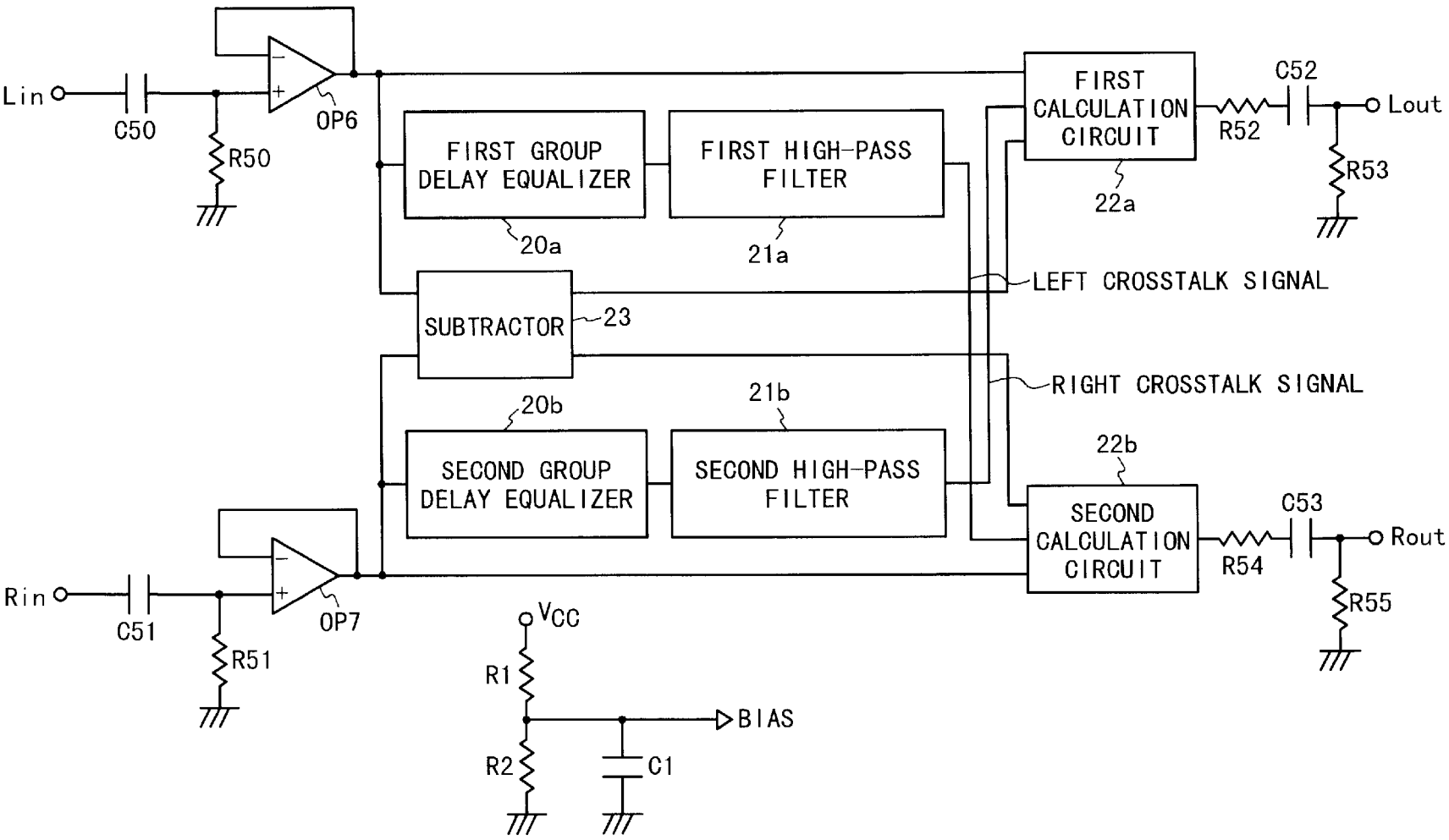
FIG. 19 is a circuit diagram for showing an embodiment of the stereophonic sound image enhancement apparatus according to the second aspect of the present invention.

FIG. 19 schematically shows a circuit arrangement of an example of a stereophonic sound image enhancement apparatus according to a second aspect of the present invention. To this stereophonic sound image enhancement apparatus, a stereophonic signal (namely, left input signal Lin and right input signal Rin) is inputted.

A circuit arranged by a capacitor C50, a resistor R50, and an operational amplifier OP6 is a buffer circuit for receiving the left input signal Lin. An output signal derived from the operational amplifier OP6 is supplied to a first group delay equalizer 20*a*, a first calculation circuit 22*a*, and a subtractor 23.

A circuit arranged by a capacitor C51, a resistor R51, and an operational amplifier OP7 is a buffer circuit for receiving the right input signal Rin. An output signal derived from the operational amplifier OP7 is supplied to a second group delay equalizer 20*b*, a second calculation circuit 22*b*, and the subtractor 23.

Figure 20:
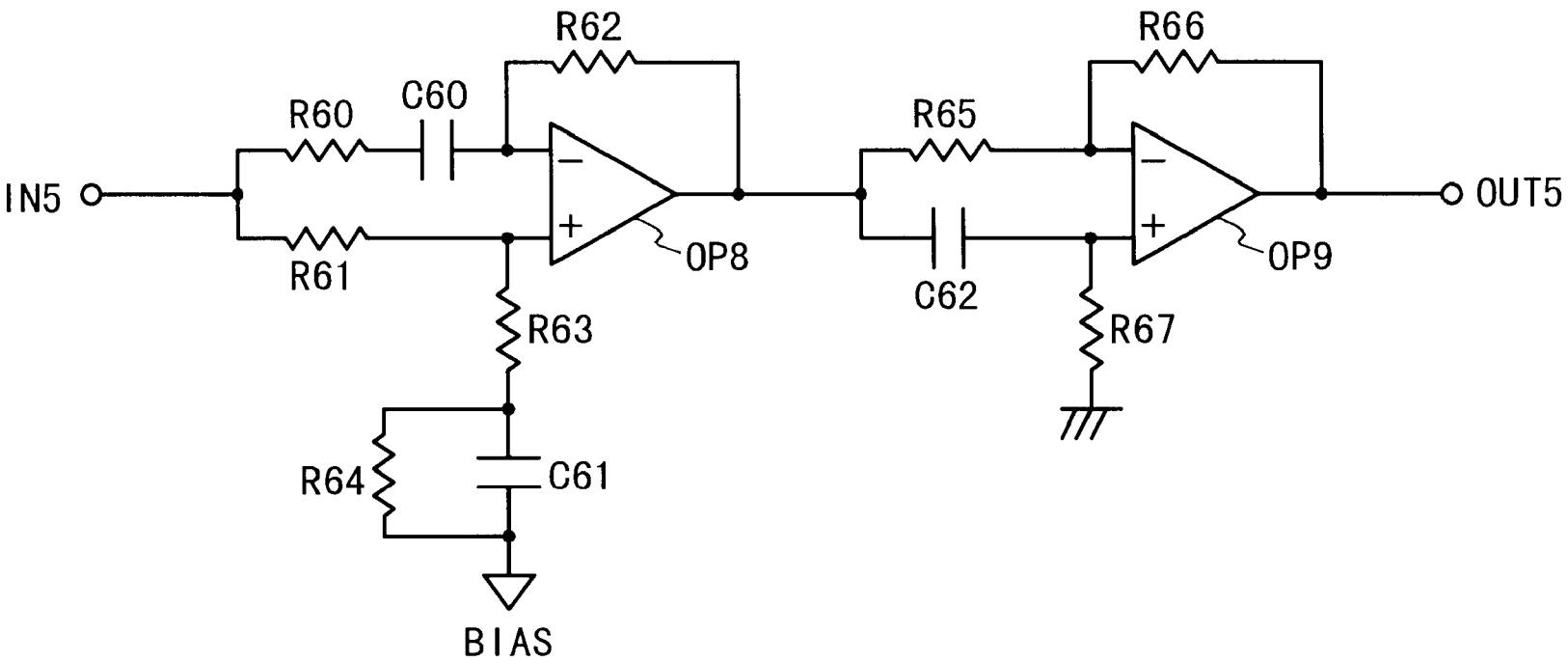
FIG. 20 is a circuit diagram for showing an embodiment of the first and second group delay equalizers shown in FIG. 19.

The first group delay equalizer 20*a* and the second group delay equalizer 22*b* own the same circuit arrangement which is indicated in detail in FIG. 20. The first and second group delay equalizers 20*a* and 20*b* are arranged by such that two stages of the substantially same circuits are combined with each other in a serial manner in order to achieve a sufficiently large delay amount. An output signal derived from the first group delay equalizer 20*a* is supplied to a first high-pass filter 21*a*, and an output signal derived from the second group delay equalizer 20*b* is supplied to a second high-pass filter 21*b*.

Figure 21:
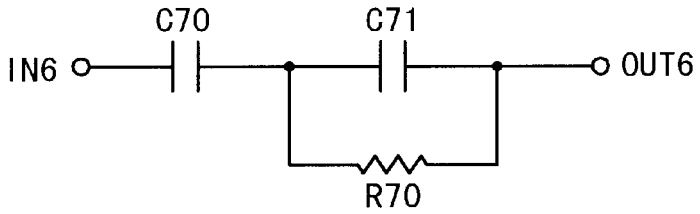
FIG. 21 is a circuit diagram for representing an embodiment of the first and second high-pass filters shown in FIG. 19.

The first high-pass filter 21*a* and the second high-pass filter 21*b* own the same circuit arrangement, which is indicated more in detail in FIG. 21. A left crosstalk signal derived from the first high-pass filter 21*a* is supplied to the second calculation circuit 22*b*, whereas a right crosstalk signal derived from the second high-pass filter 21*b* is supplied to the first calculation circuit 22*a*.

It should be noted that first and second low-pass filters G4'(s) of this stereophonic sound image enhancement apparatus do not appear on the circuit of FIG. 19. The first and second low-pass filters G4'(s) may be formed by a portion of the elements for constituting the first and second high-pass filters, and a portion of the elements for constituting the first and second calculation circuits.

That is, the output signal derived from the operational amplifier OP1 (see FIG. 19) is supplied via a resistor R90 of the first calculation circuit 22*a* (see FIG. 23) to a non-inverting input terminal (+) of an operational amplifier OP12. Also, a terminal of the resistor R90 on the side of the operational amplifier OP12 is connected via a resistor R91 to the first and second high-pass filters (see FIG. 21). In the first and second high-pass filters (see FIG. 21), an output terminal OUT9 is connected via a parallel circuit of a capacitor C71 and the resistor R70 to one end of the capacitor C70. Then, the other end of this capacitor C70 is connected to the output terminal of the operational amplifier OP9.

In this case, since an output impedance of the operational amplifier OP9 is low, it is conceivable that the other end of the capacitor C70 is grounded. As a result, it is conceivable that the low-pass filters are constituted by the resistors R90, R91, R70 and also the capacitors C70, C71. Accordingly, the signal entered to the non-inverting terminal of the operational amplifier OP12 is conceivable as either a left low-range emphasized signal or a right low-range emphasized signal, which are produced by such a manner that either the left input signal Lin or the right input signal Rin is filtered by the low-pass filter G4'(s) to emphasize a low range thereof. As previously described, in accordance with the above-explained arrangement, since the first and second low-pass filters G4'(s) may be formed by commonly employing a portion of the first and second high-pass filters, and a portion of the circuit elements of the first and second calculation circuits, a total amount of the hardware can be reduced.

Figure 22:
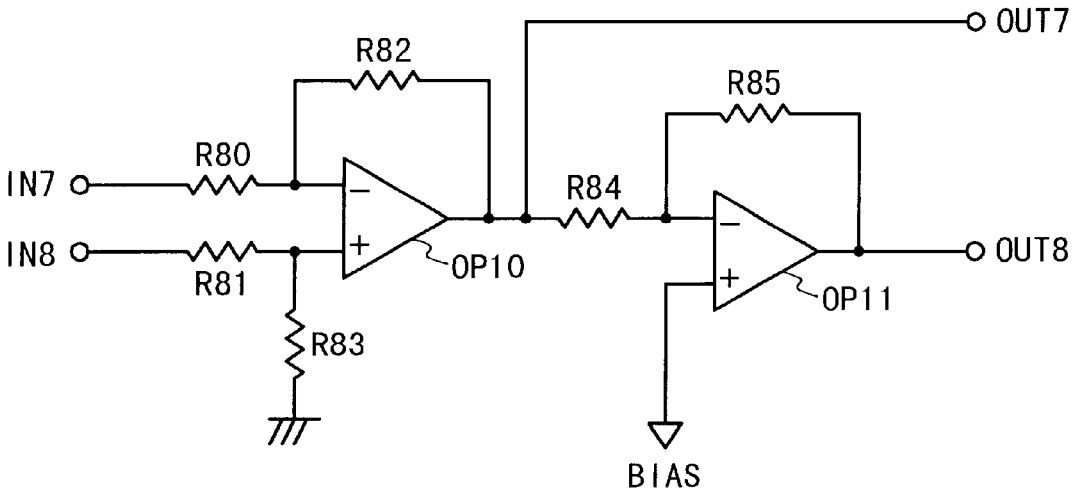
FIG. 22 is a circuit diagram for indicating an embodiment of the subtractor shown in FIG. 19.

The subtractor 23 corresponds to the subtracting means and the amplifying means employed in the stereophonic sound image enhancement apparatus according to the second aspect of the present invention. A detailed circuit arrangement of this subtractor 23 is shown in FIG. 22. The subtractor 23 subtracts the right input signal Rin from the left input signal Lin (actually, signal passed through a buffer circuit is subtracted), and amplifies the subtraction result to produce a difference signal. This difference signal is supplied to the first and second calculation circuits 22*a* and 22*b*. More specifically, an output signal derived from an operational amplifier OP10 for constructing the subtractor 23 is supplied to the second calculation circuit 22*b*, and also is supplied to an inverting circuit arranged by resistors R84, R85, and an operational amplifier OP11. Another difference signal having a reverse phase, which is outputted from this inverting circuit, is supplied to the first calculation circuit 22*a*. It should be noted that a coefficient "b" used in the amplifying means is determined by a resistance value of a feedback resistor R82 of the operational amplifier OP10. This coefficient "b" is used to increase and decrease a ratio of mixing the difference signal having the normal phase with the right input signal Rin, and is used to increase and decrease a ratio of mixing the difference signal having the reverse phase with the left input signal Lin.

Figure 23:
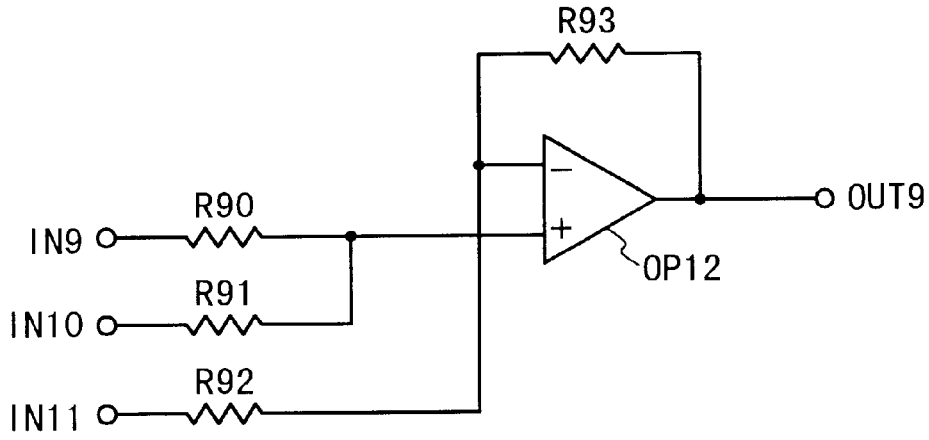
FIG. 23 is a circuit diagram for indicating an mbodiment of the first and second calculating circuits shown in FIG. 19.

The first calculation circuit 22*a* and the second calculation circuit 22*b* own the same circuit arrangement which is indicated in FIG. 23. Considering now the first calculation circuit 22*a* for producing the left output signal, the left input signal derived from the operational amplifier OP6 is supplied to an input terminal IN9, and the right crosstalk signal having the reverse phase is supplied from the second high-pass filter 21*b* to an input terminal IN10. The left input signal and the right crosstalk signal are combined with each other via the resistors R90 and R91 so as to be mixed with each other. As a consequence, this mixed signal corresponds to a signal produced by subtracting the right crosstalk signal from the left low-range emphasized signal. This mixed signal is supplied to a non-inverting input terminal (+) of the operational amplifier OP12. On the other hand, the difference signal having the normal phase is supplied from the subtractor 23 (operational amplifier OP10) to the non-inverting input terminal (−) of the operational amplifier OP12. Accordingly, such a signal is outputted from the first calculation circuit 22*a*, which is obtained by subtracting the right crosstalk signal from the left low-range emphasized signal to further add the difference signal to the subtraction result.

Considering similarly the second calculation circuit 22*b* for producing the right output signal, the right input signal derived from the operational amplifier OP7 is supplied to the input terminal IN9, and the left crosstalk a signal having the reverse phase is supplied from the first high-pass filter 21*a* to the input terminal IN10. The right input signal and the left crosstalk signal are combined with each other via the resistors R90 and R91 so as to be mixed with each other. As a consequence, this mixed signal corresponds to a signal produced by subtracting the left crosstalk signal from the right low-range emphasized signal. This mixed signal is supplied to a non-inverting input terminal (+) of the operational amplifier OP12. On the other hand, the difference signal having the reverse phase is supplied from the subtractor 23 (operational amplifier OP11) to the non-inverting input terminal (−) of the operational amplifier OP12. Accordingly, such a signal is outputted from the second calculation circuit 22*b*, which is obtained by subtracting the left crosstalk signal from the right low-range emphasized signal to further add the difference signal to the subtraction result.

As indicated in FIG. 19, the output signal derived from the first calculation circuit 22*a* is externally outputted as the left output signal "Lout." The output signal derived from the second calculation circuit 22*b* is externally outputted as the right output signal "Rout." When the left output signal Lout and the right output signal Rout are supplied to two sets of right/left loudspeakers, the sound image can be localized not only between the right and left loudspeakers, but also over the broad range around the audience, and furthermore, the stereophonic sound image can be greatly enhanced, as compared with that of the sound image localization apparatus according to the first aspect of the present invention.

Figure 24:
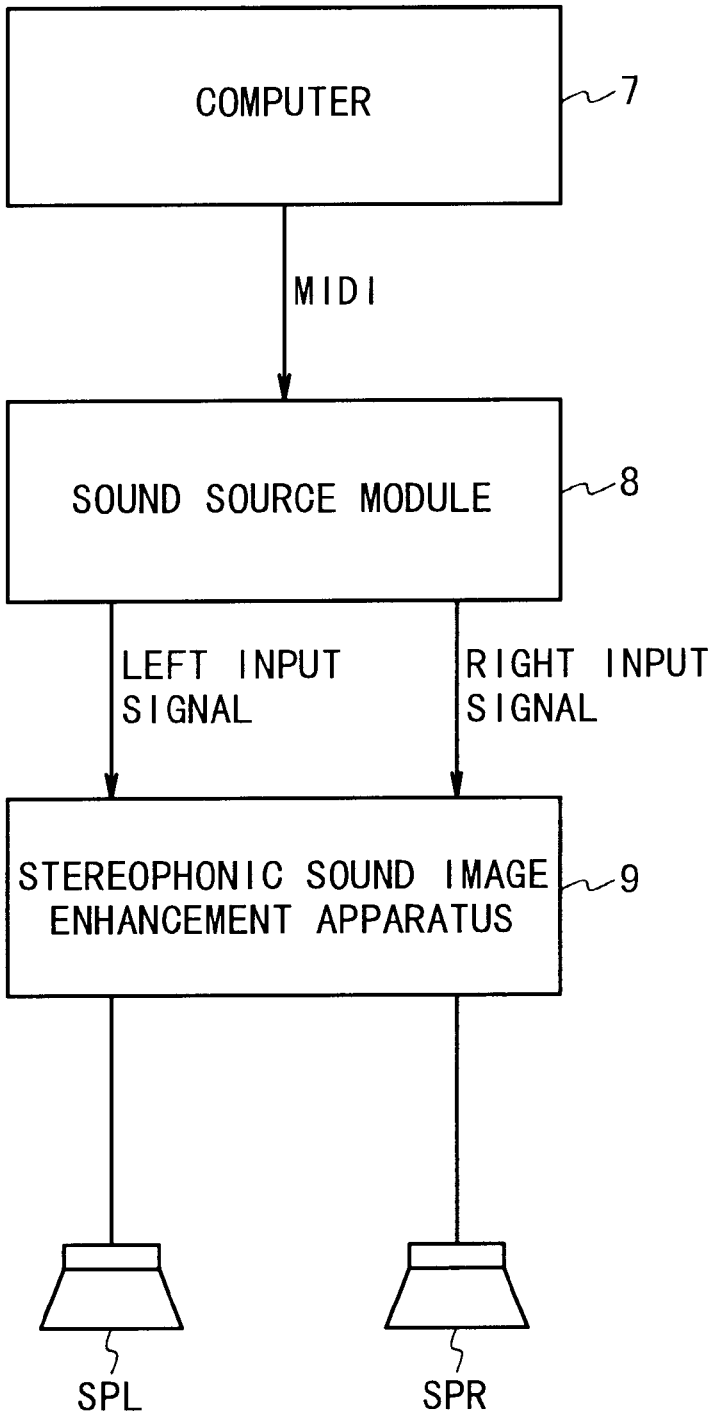
FIG. 24 is a schematic block diagram for representing an application example of the stereophonic sound image enhancement apparatus according to the second aspect of the present invention.

Next, an example of a sound image enhancement system for utilizing the above-described stereophonic sound image enhancement apparatus will be explained with reference to FIG. 24. In FIG. 24, a computer 7 sends music data in the MIDI format to a sound source module 8. The sound source module 8 produces a left input signal Lin and a right input signal Rin in response to the music data in the MIDI format. These left input signal Lin and right input signal Rin are supplied to a stereophonic sound image enhancement apparatus 9. Then, since the above-described operation is carried out in this stereophonic sound image enhancement apparatus 9, a left output signal Lout and a right output signal Rout are produced. These left and right output signals Lout and Rout are supplied to a left loudspeaker SPL and a right loudspeaker SPR. The sound image formed by the sounds produced from these left and right loudspeakers SPL and SPR may be localized at outer sides of the left loudspeaker SPL and the right loudspeaker SPR, and the stereophonic sound image may be enhanced.

It should be understood that although this sound image enhancement system is so arranged as to transmit the music data of the MIDI format to the sound source module 8, the present invention is not limited to the MIDI format, but various music data of the various formats may be employed. Alternatively, various apparatuses capable of recording the music data, for example, electronic musical instruments, and sequencers may be employed, instead of the computer. Also, there is no limitation in selection of the sound source module as the apparatus for producing the left input signal Lin and the right input signal Rin. For instance, an electronic musical instrument, a game machine, and an acoustic appliance may be employed as the sound source module.

Embodiment 3

Next, a description will now be made of an embodiment of a stereophonic sound image enhancement apparatus according to the third aspect of the present invention. To easily understand this invention, first, the known crosstalk canceling method of the Schroeder system will be explained.

Figure 25A:
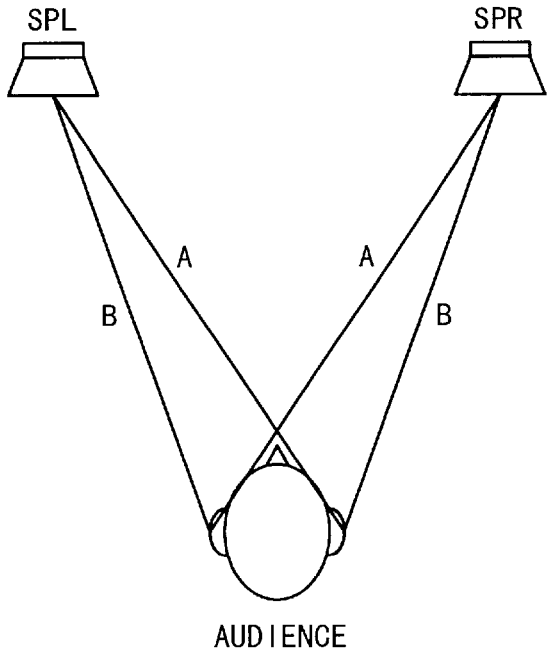
FIG. 25A and FIG. 25B are explanatory diagrams for explaining transfers of sound by the Schroeder method.

FIG. 25A represents a path along which a sound produced from a left loudspeaker SPL and a sound produced from a right loudspeaker SPR reach right/left ears of an audience. In FIG. 25A, symbol "S" indicates a transfer function of a direct sound, and symbol "A" shows a transfer function of a crosstalk sound. In a two-channel loudspeaker reproduction, the transfer characteristics such as "S" and "A" are added until the sounds produced from the loudspeaker reach the right/left ears of the audience. For example, when the sound is produced only from the left loudspeaker SPL based upon the left input signal Lin, "SLin" is entered into the left ear and also "ALin" is entered into the right ear.

Figure 25B:
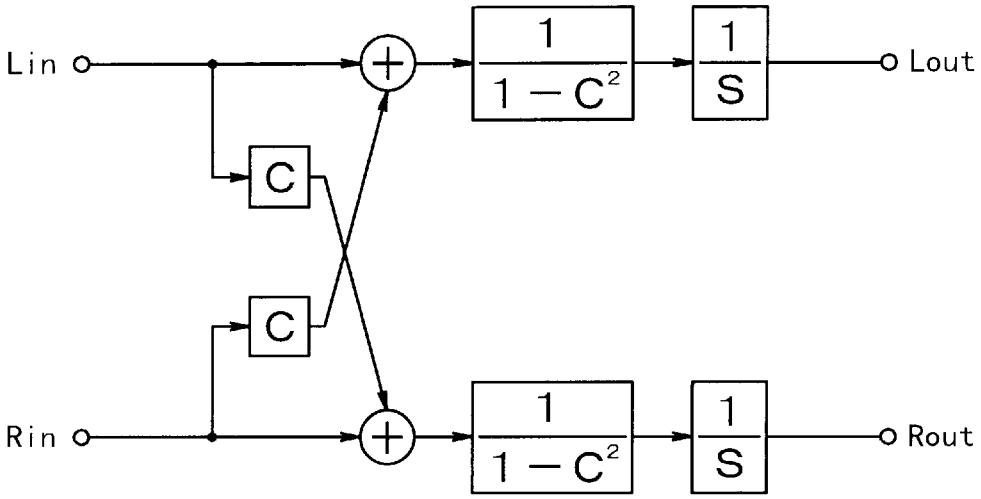

FIG. 25B conceptually represents an arrangement of a Schroeder type crosstalk canceling apparatus. When the sound signal reaching the left ear (a left-ear signal: LS) and the sound signal reaching the right ear (a right-ear signal: Rs) are calculated in accordance with this arrangement, the below-mentioned formula (8) and formula (9) results are obtained:

$$
\begin{aligned}
LS &= S \times Lout + A \times Rout \qquad \text{formula (8)}\\
&= S \times \left(\frac{1}{1-C^2}\frac{1}{S}\right)(Lin + C \times Rin) + \\
&\quad A \times \left(\frac{1}{1-C^2}\frac{1}{S}\right)(Rin + C \times Lin) \\
&= S\left(\frac{1}{1-\left(-\frac{A}{S}\right)^2}\frac{1}{S}\right)\left(Lin + \frac{-A}{S} \times Rin\right) + \\
&\quad A \times \left(\frac{1}{1-\left(-\frac{A}{S}\right)^2}\frac{1}{S}\right)\left(Rin + \frac{-A}{S} \times Lin\right) \\
&= \left(\frac{1}{1-\frac{A^2}{S^2}}\right)\left(Lin - \frac{A}{S} \times Rin\right) + \\
&\quad \left(\frac{1}{1-\frac{A^2}{S^2}}\frac{A}{S}\right)\left(Rin - \frac{A}{S} \times Lin\right) \\
&= \left(\frac{S^2}{S^2-A^2}\right)\left(Lin - \frac{A}{S} \times Rin + \frac{A}{S}Rin - \frac{A^2}{S^2} \times Lin\right) \\
&= \frac{S^2}{S^2-A^2}\left(Lin - \frac{A^2}{S^2} \times Lin\right) \\
&= \frac{S^2}{S^2-A^2}Lin\left(1 - \frac{A^2}{S^2}\right) \\
&= \frac{S^2}{S^2-A^2}\left(\frac{S^2-A^2}{S^2}\right)Lin \\
&= Lin
\end{aligned}
$$

-continued $$
\begin{aligned}
RS &= S \times Rout + A \times Lout \qquad \text{formula (9)} \\
&= S \times \left(\frac{1}{1-C^2}\frac{1}{S}\right)(Rin + C \times Lin) + \\
&\quad A \times \left(\frac{1}{1-C^2}\frac{1}{S}\right)(Lin + C \times Rin) \\
&= S \times \left(\frac{1}{1-\left(-\frac{A}{S}\right)^2}\frac{1}{S}\right)\left(Rin + \frac{-A}{S} \times Lin\right) + \\
&\quad A \times \left(\frac{1}{1-\left(-\frac{A}{S}\right)^2}\frac{1}{S}\right)\left(Lin + \frac{-A}{S} \times Rin\right) \\
&= \left(\frac{1}{1-\frac{A^2}{S^2}}\right)\left(Rin - \frac{A}{S} \times Lin\right) + \\
&\quad \left(\frac{1}{1-\frac{A^2}{S^2}}\frac{A}{S}\right)\left(Lin - \frac{A}{S} \times Rin\right) \\
&= \left(\frac{S^2}{S^2-A^2}\right)\left(Rin - \frac{A}{S} \times Lin + \frac{A}{S}Lin - \frac{A^2}{S^2} \times Rin\right) \\
&= \frac{S^2}{S^2-A^2}\left(Rin - \frac{A^2}{S^2} \times Rin\right) \\
&= \frac{S^2}{S^2-A^2}Rin\left(1 - \frac{A^2}{S^2}\right) \\
&= \frac{S^2}{S^2-A^2}RinS^2 - \frac{A^2}{S^2} \\
&= Rin
\end{aligned}
$$

Based upon the above-described formula (8) and formula (9), it is understandable that in accordance with this Schroeder method, the sounds corresponding to the left input signal Lin and the right input signal Rin are directly entered to the left ear and the right ear, respectively, irrelevant to the transfer functions S and A, and then the crosstalk sounds are canceled.

Figure 7:
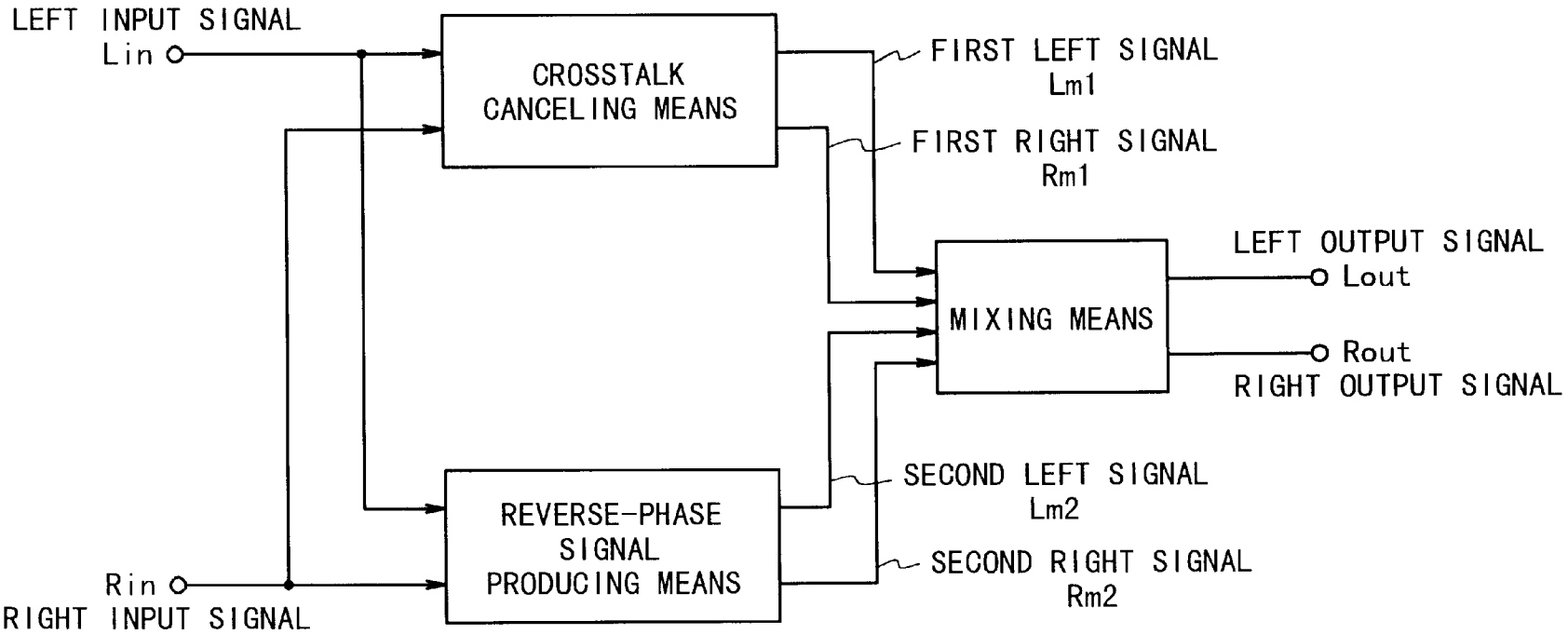
FIG. 7 is a block diagram for schematically indicating an arrangement of a stereophonic sound image enhancement apparatus according to a third aspect of the present invention.
Figure 8:
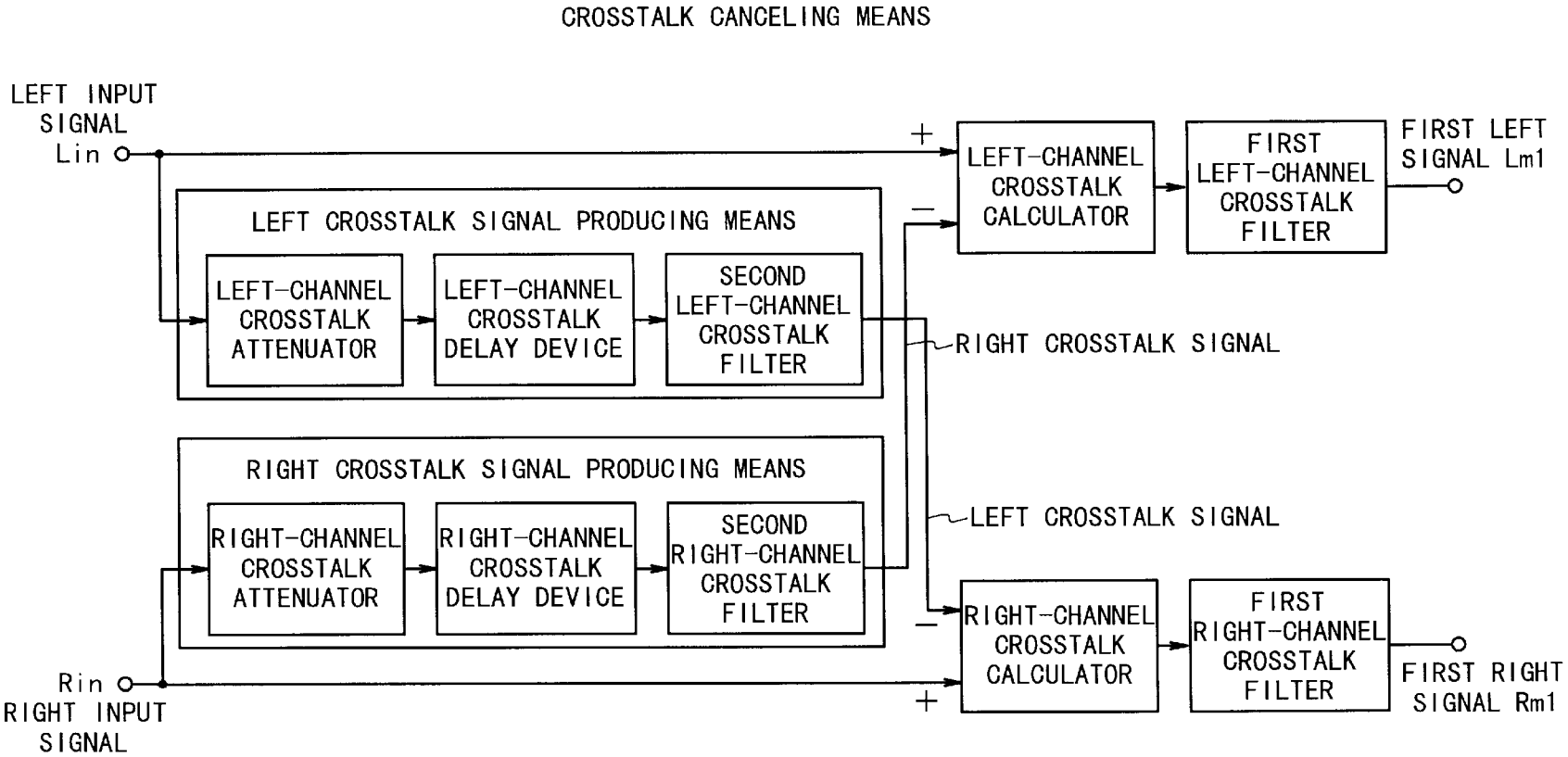
FIG. 8 is a block diagram for schematically representing an arrangement of crosstalk canceling means employed in the stereophonic sound image enhancement apparatus according to the third aspect of the present invention.
Figure 26A:
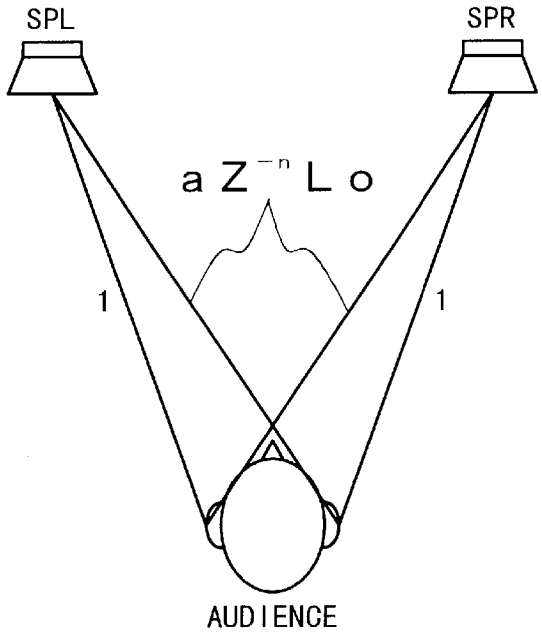
FIG. 26A and FIG. 26B are schematic block diagrams for indicating a stereophonic sound image enhancement apparatus by the Schroeder method.

Concretely speaking, crosstalk canceling means indicated in FIG. 7 may be arranged as shown in FIG. 8. Referring now to FIG. 26A to FIG. 28, a first example of this crosstalk canceling means will be explained. FIG. 26A schematically represents a path along which the sounds produced from the left loudspeaker SPL and the right loudspeaker SPR reach the right/left ears of the audience. In this embodiment 3, it is assumed that the transfer function S is equal to "1", and the transfer function A is equal to "$aZ^{-n}L_o$." In this case, symbol "a" denotes a gain, symbol "n" represents delay time of a crosstalk sound with respect to the direct sound, and symbol "$L_o$" shows a low-pass filter for simulating diffraction of a crosstalk sound caused by the head of the audience. Based on this assumption, since S=1 and $A=aZ^{-n}L_o$, symbol "C" may be expressed by the following formula (10):

$$C = -\frac{A}{S} = -aZ^{-n}L_0 \qquad \text{formula (10)}$$

Figure 26B:
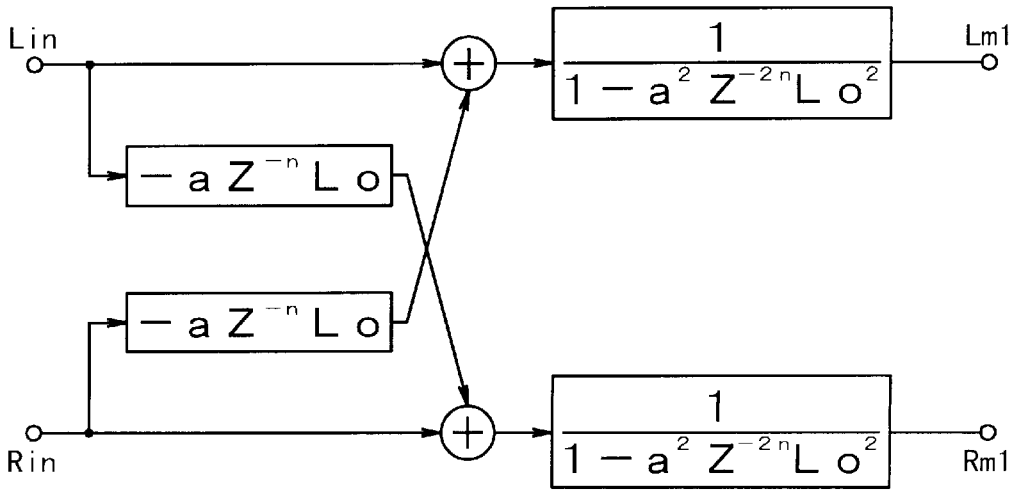

When this is applied to the Schroeder type crosstalk canceling apparatus shown in FIG. 25B, the arrangement of the crosstalk canceling means may be represented as in FIG. 26B. In this case, if the low-pass filter is arranged by a primary IIR type filter, then this low-pass filter "$L_o$" may be expressed by the following formula (11):

$$L_0 = \frac{C + dZ^{-1}}{1 - bZ^{-1}} \qquad \text{formula (11)}$$

Figure 27:
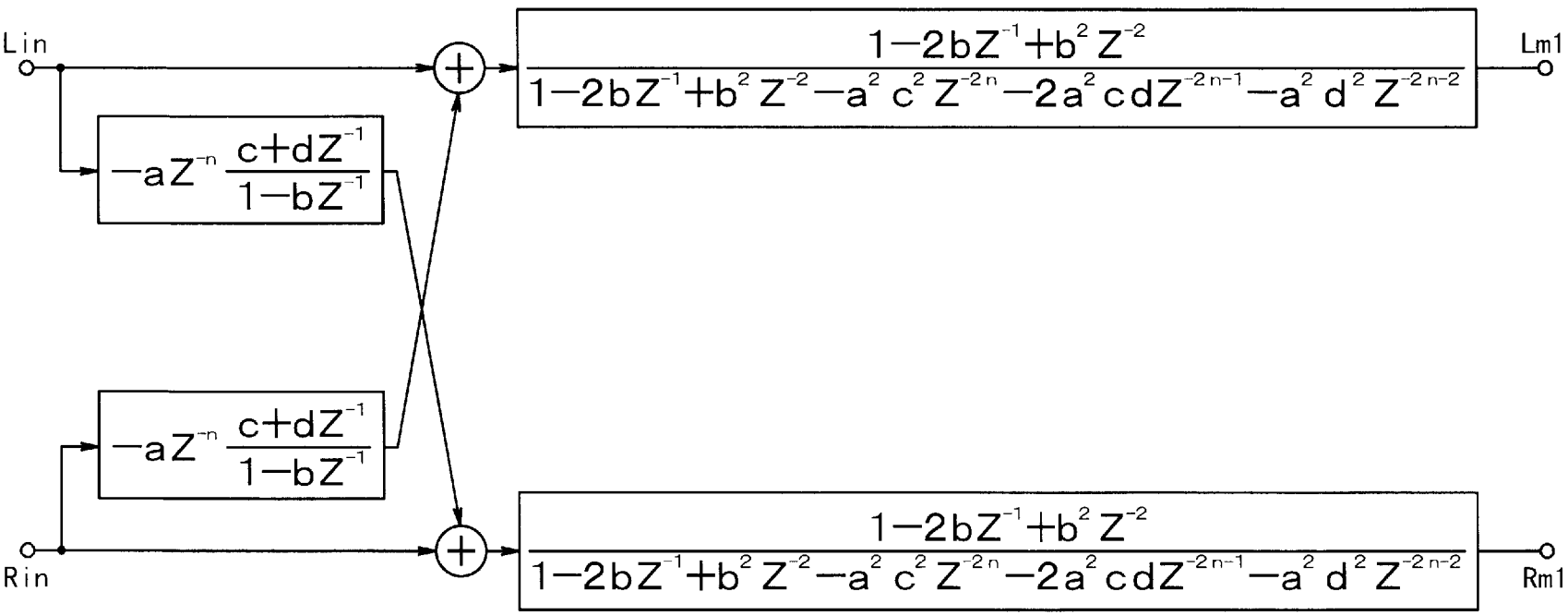
FIG. 27 is an explanatory diagram for explaining a first example of the crosstalk canceling means employed in an embodiment 1 of the stereophonic sound image enhancement apparatus according to the third aspect of the present invention.
Figure 28:
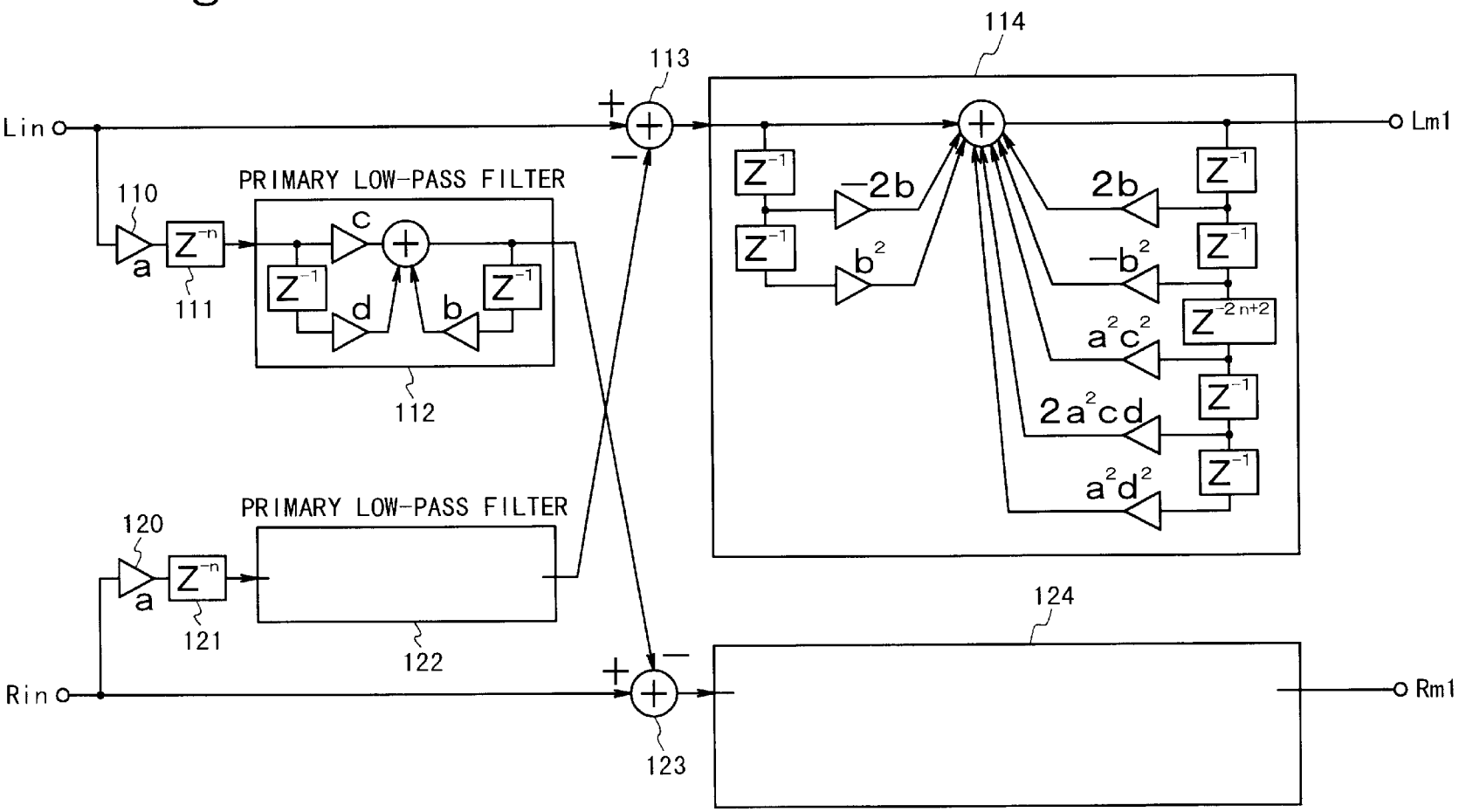
FIG. 28 is a schematic block diagram for indicating an arrangement of a first example of the crosstalk canceling means shown in FIG. 27.

When this formula (11) is applied to FIG. 26B, the crosstalk canceling means may be represented as in FIG. 27. When this is indicated by a block diagram, this block diagram is shown in FIG. 28. The crosstalk canceling means indicated in FIG. 28 corresponds to the crosstalk canceling means shown in FIG. 8. The arrangement shown in FIG. 28 is constructed of an amplifier, a delay device, and an adder, which may be realized by the DPS processing.

In FIG. 28, an L-channel crosstalk attenuator, an L-channel crosstalk delay device, and a second L-channel crosstalk filter, which form left crosstalk signal generating means, are constituted by an amplifier 110, a delay device 111, and an IIR type primary low-pass filter 112. Similarly, a R-channel crosstalk attenuator, a R-channel crosstalk delay device, and a second R-channel crosstalk filter, which form right crosstalk signal generating means, are constituted by an amplifier 120, a delay device 121, and an IIR type primary low-pass filter 122. It should be noted that since the primary low-pass filter 122 is constructed by employing the same arrangement as the above-described primary low-pass filter 112, this arrangement is omitted in the drawing. In FIG. 28, symbol "a" shows an amplification coefficient for the amplifiers 110 and 120; symbols "b" to "d" denote filter coefficients for the primary low-pass filters 112 and 122; and symbol "n" is delay coefficients for the delay devices 111 and 121.

The L-channel crosstalk calculator and the R-channel crosstalk calculator, included in the crosstalk canceling means, are constituted by subtractors 113 and 123, respectively. The subtractor 113 subtracts the right crosstalk signal from the left input signal Lin. An output signal from this subtractor 113 is supplied to the filter 114. Similarly, the subtractor 123 subtracts the left 15 crosstalk signal from the right input signal Rin. An output signal from this subtractor 123 is supplied to the filter 124. It should be noted that since the arrangement of the filter 124 is identical to that of the filter 114, this arrangement is omitted in the drawing. An amplification coefficient and a delay coefficient of the filters 114 and 124 are formed based upon the above-described "a" to "d" and "n."

Note that in the crosstalk canceling means, a secondary IIR type filter may be employed as a low-pass filter. Also in this case, assuming now that S=1 and $A=aZ^{-n}L_o$, the low-pass filter $L_o$ is expressed by the following formula (12):

$$L_0 = \frac{d + eZ^{-1} + fZ^{-2}}{1 - bZ^{-1} - cZ^{-2}} \qquad \text{formula (12)}$$

This low-pass filter may also be realized by the DSP processing. Alternatively, thirdly, or more IIR type filters may be employed as the low-pass filter. Also, in this case, these low-pass filters may be realized by the DSP processing.

As previously described, assuming now that the transfer function S defined from the loudspeaker to the ears on the same sides is equal to "1" and the transfer function A defined from the loudspeaker to the ears on the opposite sides is equal to "$aZ^{-n}L_o$," the crosstalk canceling means can simplify the Schroeder type crosstalk canceling apparatus. In accordance with this arrangement, it is possible to achieve the high precision crosstalk canceling operation, although the arrangement is made simple.

Figure 29A:
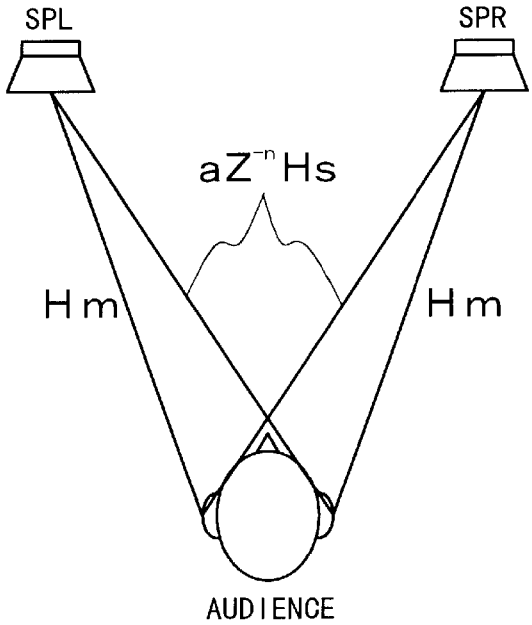
FIG. 29A and FIG. 29B are explanatory diagrams for explaining a second example of the crosstalk canceling means employed in the embodiment 1 of the stereophonic sound image enhancement apparatus according to the third aspect of the present invention.

Next, a second example of the crosstalk canceling means will now be explained with reference to FIG. 29A and FIG. 29B. FIG. 29A shows a path along which the sounds produced from the left loudspeaker SPL and the right loudspeaker SPR reach the right/left ears of the audience. In these drawings, symbol "$H_m$" represents a frequency characteristic of the ears located on the same side of the loudspeaker. Also, symbol "$aZ_{-n}H^s$" shows a frequency characteristic of the ears located on the opposite side of the loudspeaker. In this case, "S" of the Schroeder system is expressed by "$H_m$, " and "A" thereof is expressed by "$aZ^{-n}H_s$." As a consequence, symbol "C" may be expressed by the following formula (13):

$$C = -\frac{A}{S} = -aZ^{-n}\frac{H_s}{H_m} \qquad \text{formula (13)}$$

In this case, since "$H_s/H_m$" may be considered as the frequency characteristics of the ears located on the opposite side when the frequency characteristic of the ears located on the same side of the loudspeaker is "1", this may be expressed by the below-mentioned formula (14), similar to the cases of FIG. 26A and FIG. 26B. As a consequence, an item of $1/(1-C^2)$ is the same as that of FIG. 26A and FIG. 26B.

$$C = -aZ^{-n}\frac{H_s}{H_m} \qquad \text{formula (14)}$$

Since an item of 1/S is present at the final stage in the Schroeder method, $1/H^m$ is entered to the final stage in this second example. As a consequence, the crosstalk canceling means of this second example is arranged as shown in FIG. 29B. Now, when the characteristic of $H_m$ is realized by a primary filter, $H_m$ may be expressed by the below-mentioned formula (15):

$$H_m = \frac{f + gZ^{-1}}{1 - eZ^{-1}} \qquad \text{formula (15)}$$

Accordingly, it becomes:

$$\frac{1}{H_m} = \frac{1 - eZ^{-1}}{f + gZ^{-1}} = \frac{\left(\frac{1}{f}\right) + \left(-\frac{e}{f}\right)Z^{-1}}{1 - \left(-\frac{g}{f}\right)Z^{-1}} \qquad \text{formula (16)}$$

Similar to the above-explained first example, the filter $L_o$ may be expressed by the below-mentioned formula (17):

$$L_0 = \frac{c + dZ^{-1}}{1 - bZ^{-1}} \qquad \text{formula (17)}$$

Figure 29B:
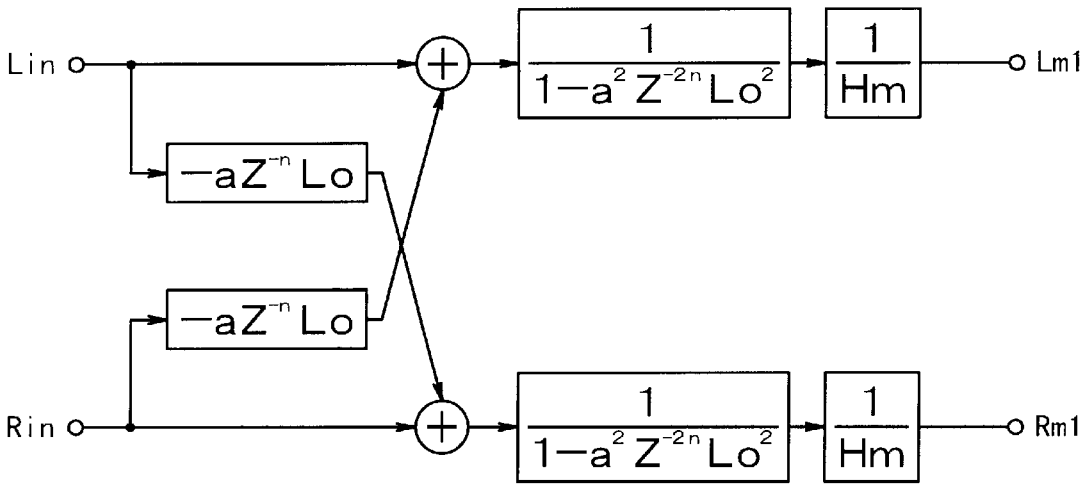
Figure 30:
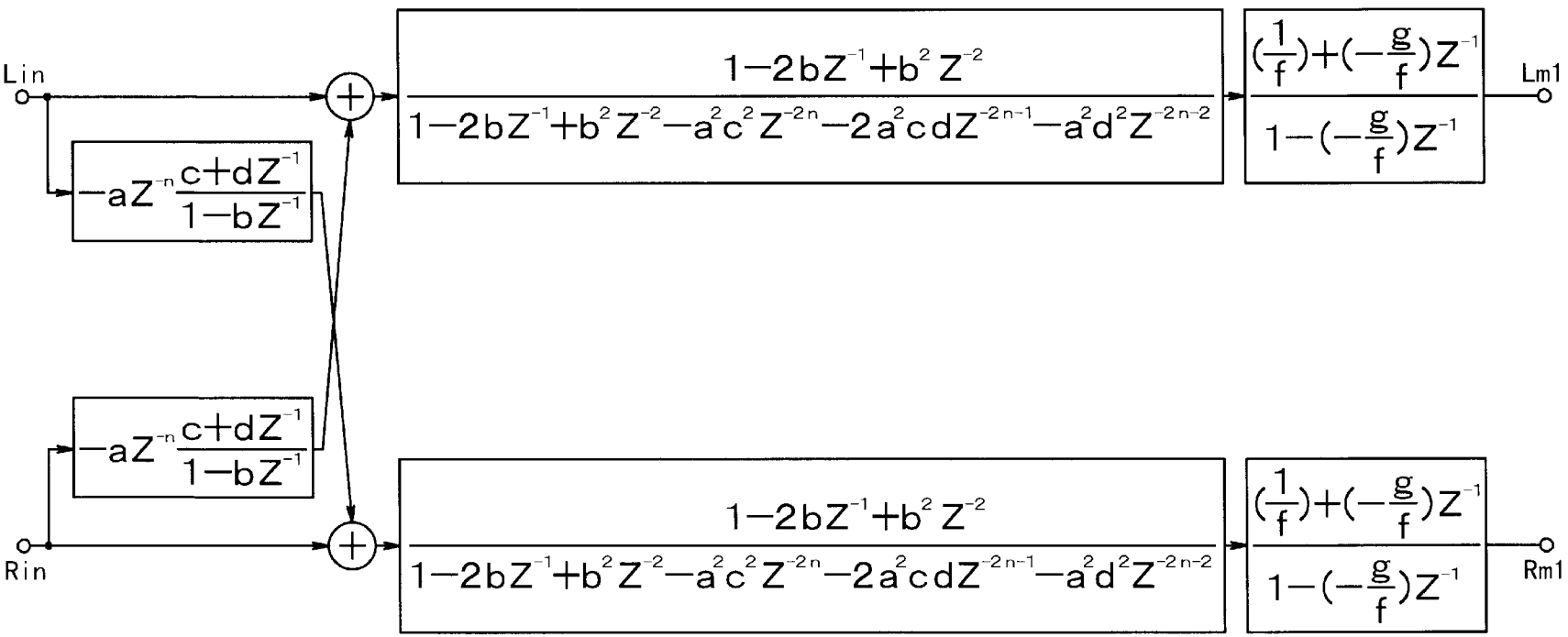
FIG. 30 is an explanatory diagram for explaining a second example of the crosstalk canceling means employed in the embodiment 1 of the stereophonic sound image enhancement apparatus according to the third aspect of the present invention.
Figure 31:
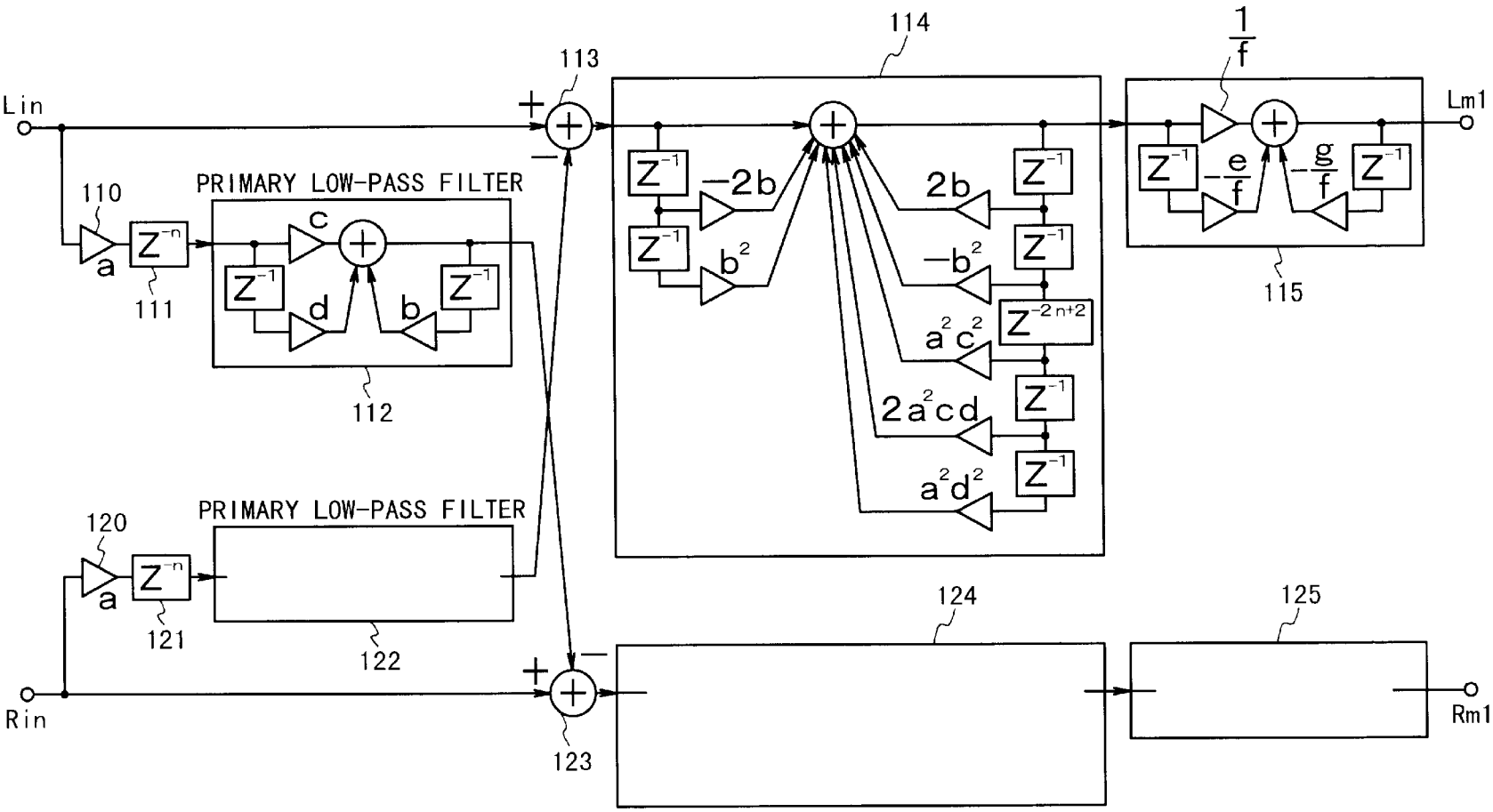
FIG. 31 is a schematic block diagram for indicating an arrangement of a second example of the crosstalk canceling means shown in FIG. 30.

When this formula (17) is substituted for FIG. 29B, the arrangement of the crosstalk canceling means may be expressed as indicated in FIG. 30. When this is indicated by a block diagram, this block diagram is shown in FIG. 31. The arrangement shown in FIG. 31 is constructed of an amplifier, a delay device, and an adder, and then can be realized by the DSP processing. Also, the filter $L_o$ of this second example may be constituted by secondary, or more higher filters.

The second example of the crosstalk canceling means indicated in FIG. 31 owns a different structure from the first example of the crosstalk canceling means such that a filter 115 is further provided on the output side of the filter 114 shown in FIG. 28, and another filter 125 is further provided on the output side of the filter 124.

As previously described, assuming now that the frequency characteristic defined from the loudspeaker to the ears on the same sides is equal to "$H_m$" and the frequency characteristic defined from the loudspeaker to the ears on the opposite sides is equal to "$aZ^{-n}H_s$," the crosstalk canceling means can simplify the Schroeder type crosstalk canceling apparatus. In accordance with this arrangement, it is possible to achieve the high precision crosstalk canceling operation with realistic better quality, although the arrangement is made simple.

Figure 9:
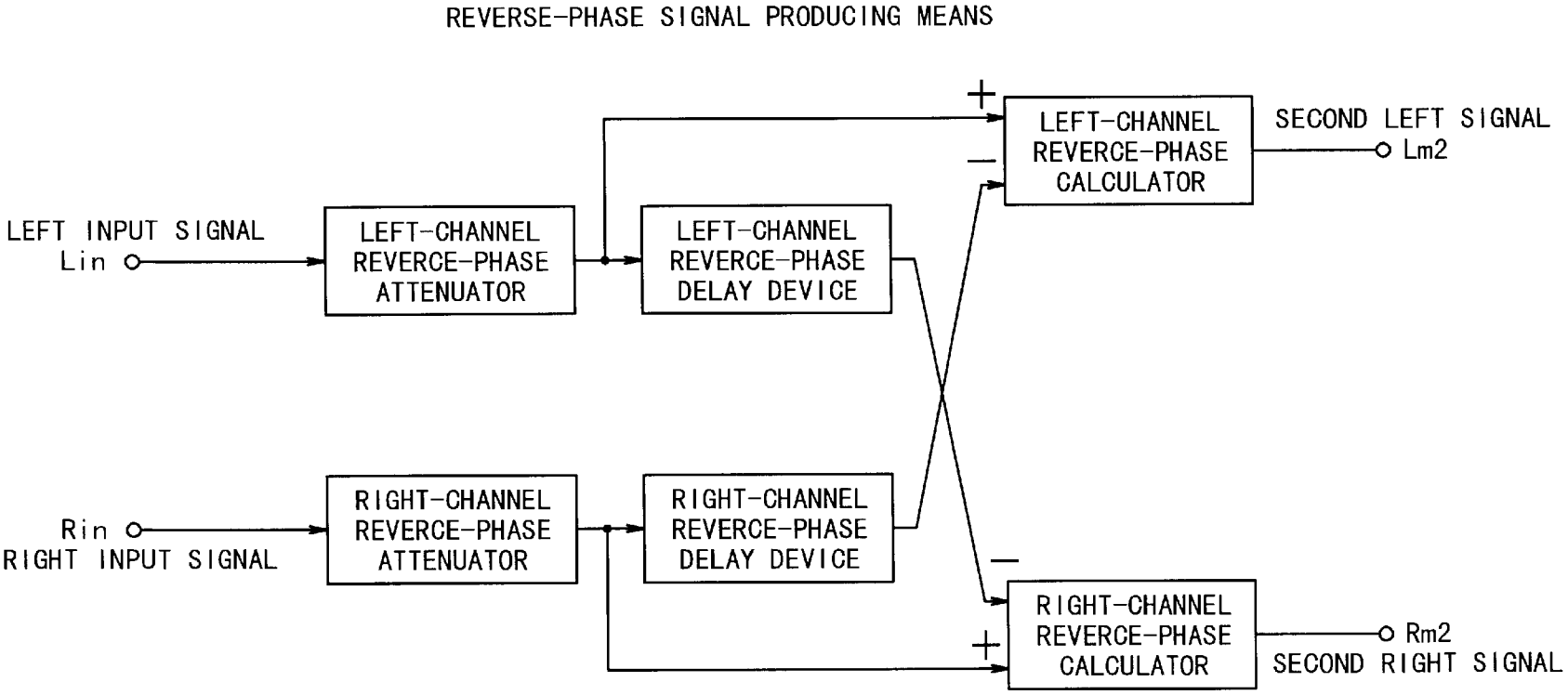
FIG. 9 is a schematic block diagram for representing an arrangement of reverse phase signal producing means employed in the stereophonic sound image enhancement apparatus according to the third aspect of the present invention.
Figure 32:
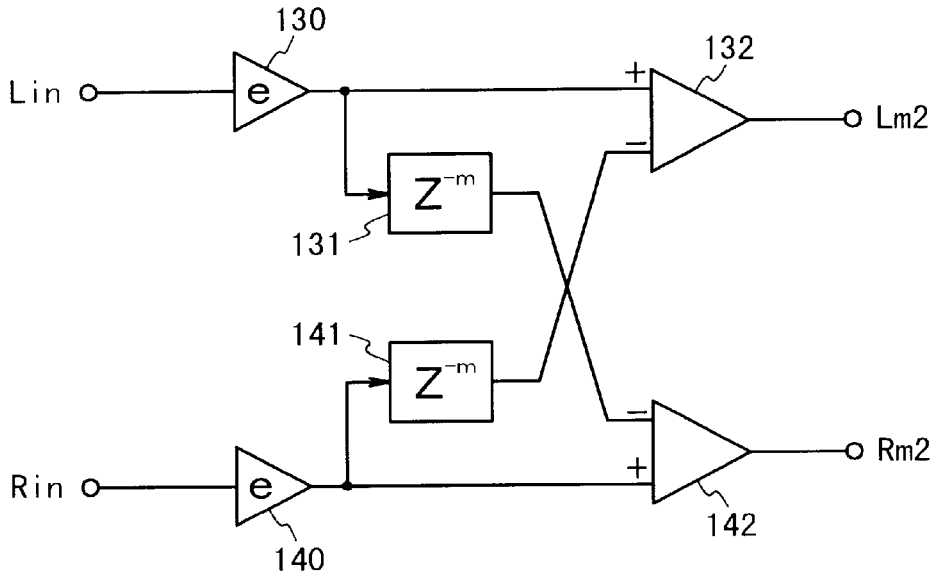
FIG. 32 is a schematic block diagram for showing an arrangement of reverse phase signal producing means employed in the embodiment 1 of the stereophonic sound image enhancement apparatus according to the third aspect of the present invention.

Now, reverse-phase signal producing means will be explained. FIG. 32 schematically shows an arrangement of the reverse-phase signal producing means. The reverse-phase signal producing means shown in FIG. 32 corresponds to the reverse-phase signal producing means indicated in FIG. 9. In FIG. 32, an L-channel reverse-phase signal attenuator, an L-channel reverse-phase signal delay device, and an L-channel reverse-phase signal calculator are constructed of an amplifier 130, a delay device 131, and an adder 132, respectively. Similarly, an R-channel reverse-phase signal attenuator, an R-channel reverse-phase signal delay device, and an R-channel reverse-phase signal calculator are constructed of an amplifier 140, a delay device 141, and an adder 142, respectively.

In FIG. 32, symbol "e" denotes amplification coefficients for the amplifiers 130 and 140, and symbol "m" represents delay coefficients for the delay devices 131 and 141. Symbol "m" is a quantity of sampling points in the case that an analog signal is sampled at a frequency of 48 kHz to produce a digital signal, for instance, "m" is selected to be equal to approximately 6.

Consider now that only the left input signal Lin is applied. At this time, a second left signal Lm2 may be expressed by "$eLin-eZ^{-m}Rin$." Similarly, a second right signal Rm2 may be expressed by "$eRin-eZ^{-m}Lin$."

Assuming now that symbol "m" is equal to the delay time of the crosstalk sound with respect to the direct sound, for example, the crosstalk sound among the sounds outputted from the left loudspeaker SPL is entered into the right ear with a delay of "m." Thus, if this crosstalk sound is outputted from the right loudspeaker SPR in such a manner that this crosstalk sound is delayed by the delay time "m" and reversed, the first-mentioned crosstalk sound can be canceled by the reversed crosstalk sound around the right ear. As a result of this process operation, such a phenomenon approximated to the above-described crosstalk canceling process will occur.

It should be understood that since no consideration is made of the frequency changes caused by the gain and the diffraction in this reverse-phase signal processing means, the crosstalk canceling operation cannot always be correctly performed. When the crosstalk canceling operation is correctly carried out, it feels that the sound images are stuck around the ears. To the contrary, in accordance with the imperfect crosstalk canceling operation by this reverse-phase signal producing means, it feels that the sound images are not localized around the ears, but are localized outside the loudspeakers. As described above, in accordance with this reverse-phase signal producing means, the sound images can be localized outside the right/left loudspeakers by the imperfect crosstalk canceling operation.

Figure 33:
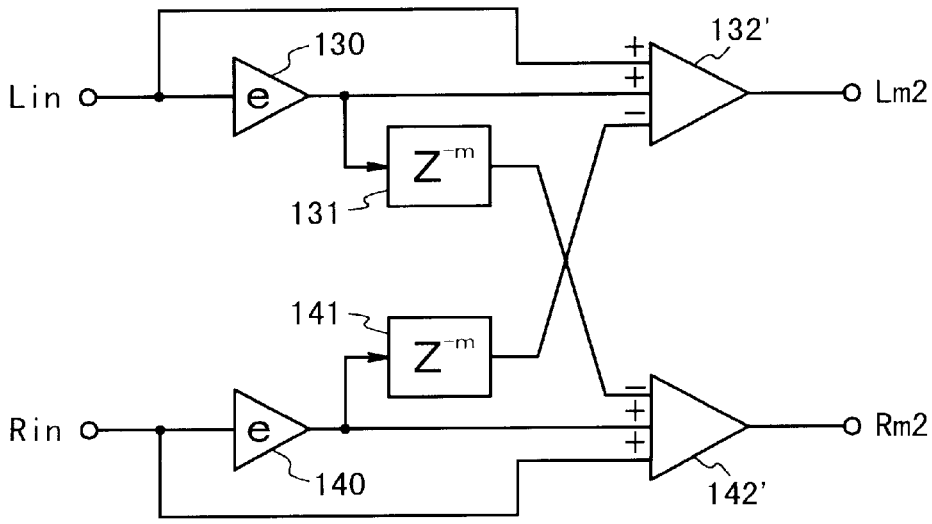
FIG. 33 is a schematic block diagram for indicting another arrangement of reverse phase signal producing means employed in the embodiment 1 of the stereophonic sound image enhancement apparatus according to the third aspect of the present invention.

However, this circuit arrangement shown in FIG. 32 still has a problem. That is, there is a lack of clearness in the sound images. This clearness problem may be solved by constituting reverse-phase signal producing means in a manner as shown in FIG. 33. In the reverse-phase signal producing means indicated in FIG. 33, a left input signal "Lin" is further mixed with the second left signal "Lm2" appearing in the reverse-phases signal producing means indicated in FIG. 32, and a right input signal "Rin" is further mixed with the second right signal Rm2. As a result, the sound image can be clearly localized outside the right/left loudspeakers.

Figure 10:
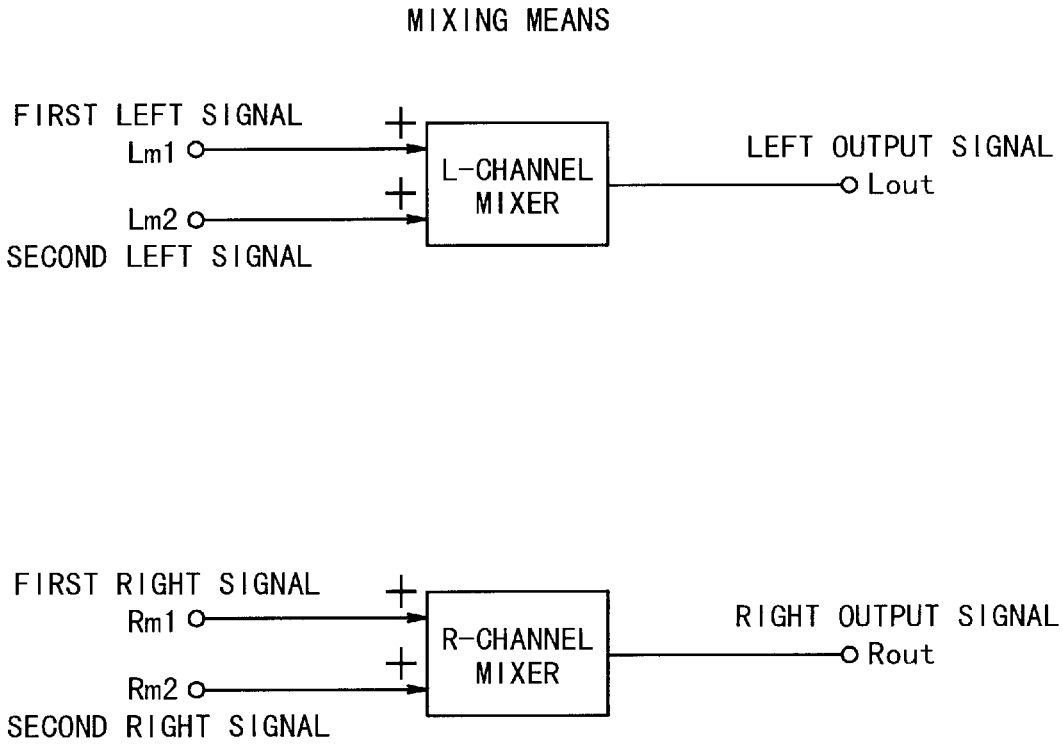
FIG. 10 is a schematic block diagram for showing an arrangement of mixing means employed in the stereophonic sound image enhancement apparatus according to the third aspect of the present invention.
Figure 34:
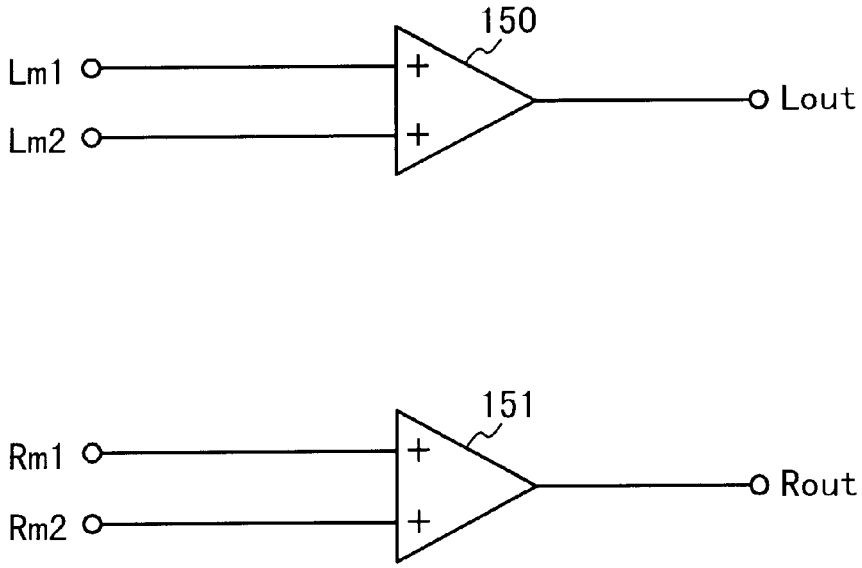
FIG. 34 is a schematic block diagram for showing an arrangement of mixing means employed in the embodiment 1 of the stereophonic sound image enhancement apparatus according to the third aspect of the present invention.

Next, a description will now be made of an embodiment of mixing means. As previously explained with reference to FIG. 10, the mixing means is arranged by the L-channel mixer and the R-channel mixer. As indicated in FIG. 34, the L-channel mixer may be arranged by an adder 150. The adder 150 adds the first left signal Lm1 derived from the crosstalk canceling means to the second left signal Lm2 derived from the reverse-phase signal producing means, and then outputs the added value as a left output signal "Lout." Similarly, the R-channel mixer may be arranged by an adder 151. The adder 151 adds the first right signal Rm1 derived from the crosstalk canceling means to the second right signal Rm2 derived from the reverse-phase signal producing means, and then outputs the added value as a right output signal "Rout."

A mixing ratio of the first left signal Lm1 derived from the crosstalk canceling means and the second left signal Lm2 derived from the reverse-phase signal producing means with respect to the output signal may be controlled based on the respective gains "a" of the amplifiers 110 and 120 of the crosstalk canceling means, and the respective gains "e" of the amplifiers 130 and 140 of the reverse-phase signal producing means. Another mixing ratio of the first right signal Rm1 derived from the crosstalk canceling means and the second right signal Rm2 derived from the reverse-phase signal producing means may be controlled in a similar manner. In other words, the crosstalk canceling amount may be determined based on the value of the gain "a" whereas the mixing amount of the reverse-phase signals may be determined based upon the value of the gain "e."

Depending upon the values of the gains "a" and "e," the following sound stages may be formed.

1). In the case of "a"="e"=0, the left input signal Lin directly constitutes the left output signal Lout, and the right input signal Rin directly constitutes the right output signal Rout. It should be understood that since a=0 and thus the coefficient of the filter 114 becomes symmetrical with respect to that of the filter 124 (see FIG. 28 and FIG. 31), both the filters 114 and 124 employed in the crosstalk canceling means may function as filters capable of directly outputting the input signal.

2). In the case of "a" is not equal to 0 and "e"=0. only the crosstalk canceling means becomes effective, and such a sound stage is formed that the sound images can be heard around the ears.

3). In the case of "a"=o and "e" is not equal to 0, only the reverse-phase signal producing means becomes effectively, and such a sound stage is formed that the sound images are localized outside the right/left loudspeakers.

4). In the case of "a" is not equal to 0 and "e" is not equal to 0, the sound stage such that the sound images can be heard around the ears due to the crosstalk canceling operation are overlapped with the sound stage such that the sound images are localized outside the right/left loudspeakers by mixing the reverse-phase signals. As a consequence, it is possible to form such a sound stage that the sound images are localized along such a wide direction defined from an accurate transverse direction of an audience up to a front direction, and also at a position separated from the audience.

In the above-described case 4), since the delay amount is changed in response to the opening angle of the loudspeakers during the crosstalk canceling operation, there is a problem that the clearness of the sound image localization when the audience listens to the sounds at the position near the loudspeakers is different from that when the audience listens to the sounds at the position apart from the loudspeakers. Accordingly, the delay amount "m" is selected to be a value different from "n" in the reverse-phase signal producing means, so that the clearness of the sound image localization in accordance with the opening angle between the loudspeakers can be ensured. As a consequence, the listening point can be selected to be such a broad range. For instance, the delay amounts "n" and "m" may be selected to be n=8 and m=6. Alternatively, the delay amounts "m" and "n" may be equal to each other. In this case, it is possible to determine the best listening point at a preselected opening angle between the right/left loudspeakers.

Figure 35:
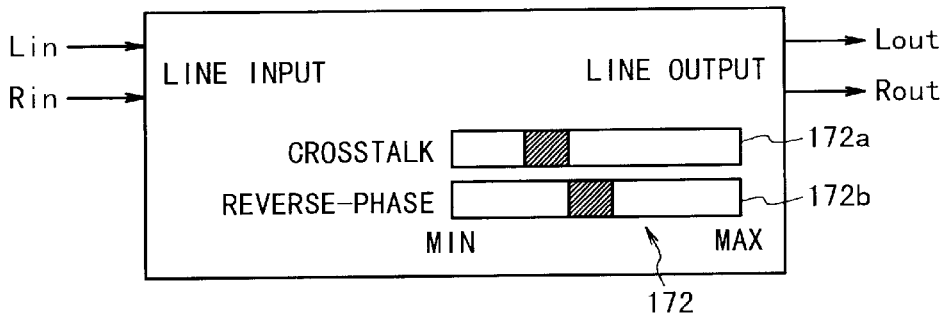
FIG. 35 is an outer view for indicating a stereophonic sound image enhancement system, as viewed from an upper surface thereof, to which the embodiment 1 of the stereophonic sound image enhancement apparatus according to the third aspect of the present invention.

Referring now to the drawings, an example of a stereophonic sound image enhancement system utilizing the above-described stereophonic sound image enhancing apparatus will be explained. FIG. 35 is an outer view of the stereophonic sound image enhancement system, as viewed from an upper surface thereof. In this stereophonic sound image enhancement system, both the left input signal Lin and the right input signal Rin are inputted into a line input terminal, and are processed by way of the crosstalk canceling process operations and the reverse-phase signal mixing process operation, and then the processed signals are outputted from a line output terminal as a left output signal Lout and a right output signal Rout. An input apparatus 170 includes a variable resistor 172*a* and 172*b*. A variable resistor 172*a* is used to instruct an amount of the crosstalk canceling operation. In response to a signal produced from the variable resistor 172*a*, the gain "a" is determined. Also, another variable resistor 172*b* may be used to instruct a mixing amount of a reverse-phase signal. In response to the signal produced from this variable resistor 172*b*, the gain "e" is determined.

Figure 36:
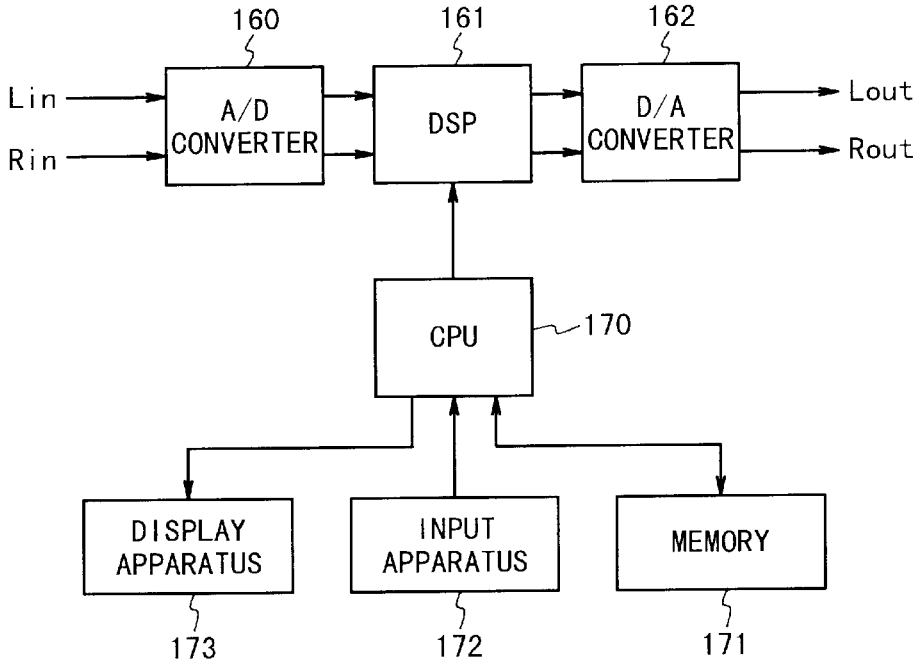
FIG. 36 is a schematic block diagram for showing arrangements of electronic circuits employed in the stereophonic sound image enhancement system to which the embodiment 1 of the stereophonic sound image enhancement apparatus according to the third aspect of the present invention, and in a sound image control system to which the sound image control apparatus of the embodiment 3.

FIG. 36 is a schematic block diagram for representing an arrangement of an electronic circuit of the above-described stereophonic sound image enhancement system. In FIG. 36, an A/D converter 160 converts the left input signal Lin and the right input signal Rin, corresponding to analog signals, into digital signals. The digital signals are supplied to a DSP 161. The DSP 161 executes the above-described crosstalk canceling process operation and the reverse-phase signal mixing process operation in accordance with the control data supplied from the CPU 170. Then, the processed digital signals are supplied to a D/A converter 162. The D/A converter 162 converts the received digital signals into analog signals thereof which will be then outputted as the left output signal Lout and the right output signal Rout.

To a CPU 170, a memory 171, an input apparatus 172, and a display apparatus 173 are connected. Into the memory 171, various sorts of coefficients are stored other than a control program used to operate the CPU 170. The CPU 170 reads out a filter coefficient and the like from this memory 171 and supplies the read filter coefficient as control data to the DSP 161.

Also, the input apparatus 172 contains the above-described variable resistor 172*a* and variable resistor 172*b*. Then, the CPU 172 accepts signals indicative of the setting conditions of these variable resistors 172*a* and 172*b*, and converts these setting condition signals into values representative of the gain "a" and the gain "e," which are supplied as control data to the DSP 161. The DSP 161 performs the above-explained crosstalk canceling operation and reverse-phase signal mixing process operation based upon the values indicative of the above-explained filter coefficient, and gain "a" and also gain "e."

The display apparatus 173 may be constituted by, for instance, an LED (light-emitting diode) display device, and an LCD (liquid crystal display) display device. When the user observes this display apparatus 173, the user can recognize the conditions of this stereophonic sound image enhancement system, and other information thereof.

It should also be noted that although this stereophonic sound image enhancement apparatus can be solely used, this stereophonic sound image enhancement apparatus may be assembled into other apparatus as a multi-effector, and a reverberation generator. As other apparatuses, there are a sound source module, an electronic piano, an electronic keyboard, a game machine, and acoustic appliances.

Embodiment 4

Figure 37:
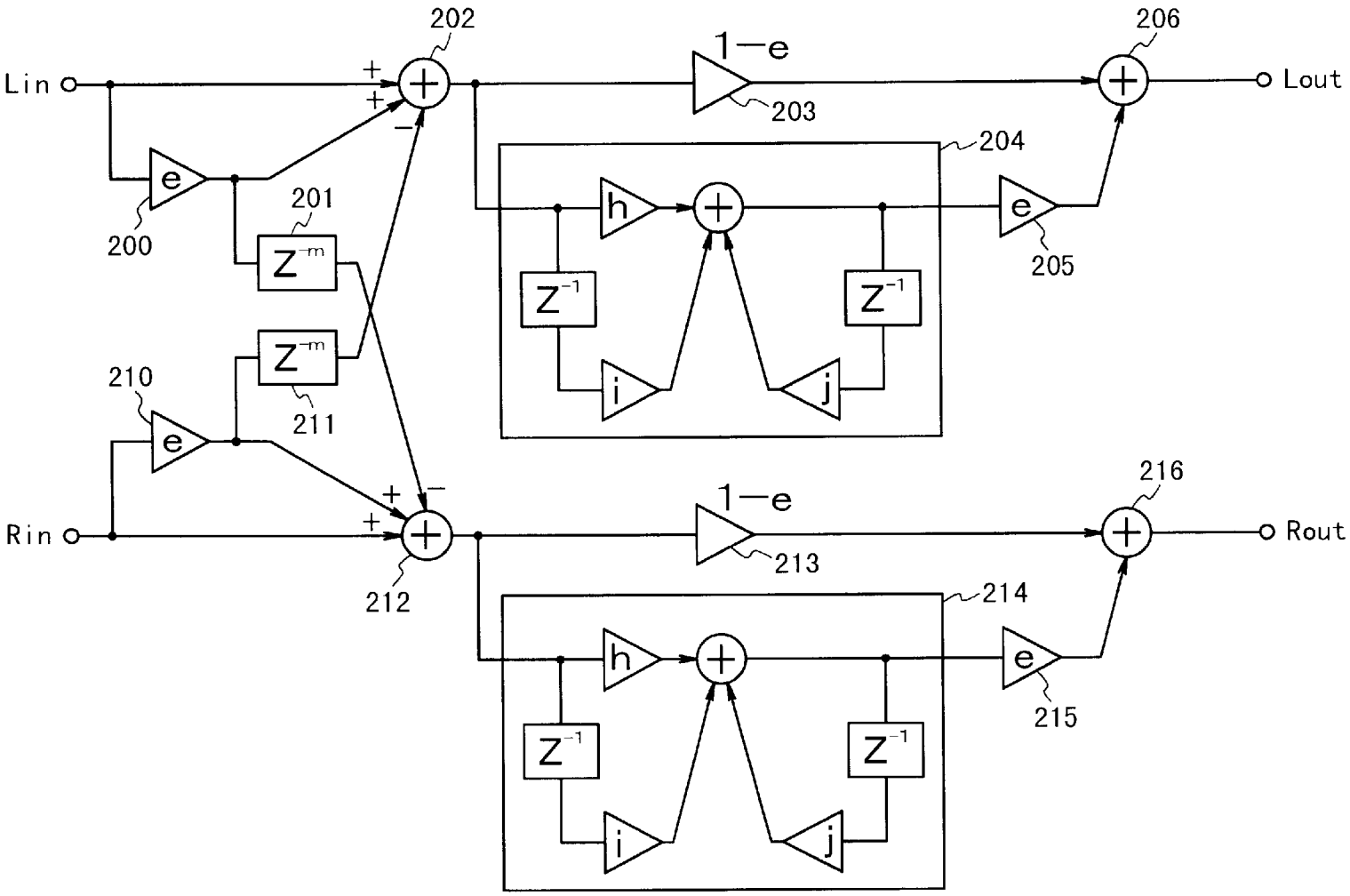
FIG. 37 is a schematic block diagram for showing an arrangement of an embodiment 2 of the stereophonic sound image enhancement apparatus according to third aspect of the present invention.

Referring now to a block diagram of FIG. 37, a description will be made of an embodiment of a stereophonic sound image enhancement apparatus according to a fourth aspect of the present invention. In FIG. 37, an amplifier 200 amplifies the left input signal Lin by a gain "e." The output signal from this amplifier 200 is supplied to a delay device 201 and an adder 202. The delay device 201 delays the output signal supplied from the amplifier 200 by the time "m." The output signal from this delay device 201 is supplied to a adder 212. Similarly, an amplifier 210 amplifies the right input signal Rin by a gain "e." The output signal from this amplifier 210 is supplied to a delay device 211 and the adder 212. The delay device 211 delays the output signal supplied from the amplifier 210 by the time "m." The output signal from this delay device 211 is supplied to the adder 202.

The adder 202 corresponds to L-channel mixing means of the stereophonic sound image enhancement apparatus according to the fourth aspect of the present invention. This adder 202 adds the left input signal Lin to the output signal derived from the amplifier 200 (namely, signal obtained by multiplying left input signal Lin by gain "e"), and subtracts the output signal derived from the delay device 211 from the summation result. As a result, the mixing operation is carried out for the left input signal Lin, the signal obtained by multiplying the left input signal Lin by the gain "e," and also such a signal obtained by multiplying the right input signal Rin by the gain "e" and by delaying the multiplied signal and by further reversing the phase of this delayed multiplied signal.

Similarly, the adder 212 corresponds to R-channel mixing means. This adder 212 adds the right input signal Rin to the output signal derived from the amplifier 210 (namely, signal obtained by multiplying right input signal Rin by gain "e"), and subtracts the output signal derived from the delay device 201 from the summation result. As a result, the mixing operation is carried out for the right input signal Rin, the signal obtained by multiplying the right input signal Rin by the gain "e," and also such a signal obtained by multiplying the left input signal Lin by the gain "e" and by delaying the multiplied signal and by further reversing the phase of this delayed multiplied signal.

L-channel sound quality correcting means of the stereophonic sound image enhancement apparatus according to the fourth aspect of the present invention is arranged by an amplifier 203, a low-pass filter 204, an amplifier 205, and an adder 206. An output signal derived from the L-channel mixing means (adder 202) is amplified by a gain (1−e) in the adder 203, and the amplified signal is supplied to the adder 206. Also, the output signal derived from the L-channel mixing means (adder 202) is filtered out by the low-pass filter 204, and the filtered signal is supplied to the adder 205. Then, this filtered signal is amplified by the gain "e" in this amplifier 205, and the amplified signal is supplied to the adder 206. In the adder 206, the output signal from the amplifier 203 is added to the output signal from the amplifier 205, and this added result is outputted therefrom as a left output signal Lout.

Similarly, R-channel sound quality correcting means of the stereophonic sound image enhancement apparatus according to the fourth aspect of the present invention is arranged by an amplifier 213, a low-pass filter 214, an amplifier 215, and an adder 216. An output signal derived from the R-channel mixing means (adder 212) is amplified by a gain (1−e) in the adder 213, and the amplified signal is supplied to the adder 216. Also, the output signal derived from the R-channel mixing means (adder 212) is filtered out by the low-pass filter 214, and the filtered signal is supplied to the adder 215. Then, this filtered signal is amplified by the gain "e" in this amplifier 215, and the amplified signal is supplied to the adder 216. In the adder 216, the output signal from the amplifier 213 is added to the output signal from the amplifier 215, and this added result is outputted therefrom as a right output signal Rout.

The above-described "e" implies a gain used to control a magnitude of stereophonic sound image enhancement effects. Also, symbols "h" to "j" indicate filter coefficients of the low-pass filter 204 and 214. Further, symbol "m" indicates a delay amount corresponding to delay time of crosstalk sounds with respect to direct sounds. This delay amount "m" is expressed by the number of sampling points in such a case that an analog signal is sampled at a frequency of 48 kHz to produce a digital signal.

Figure 38:
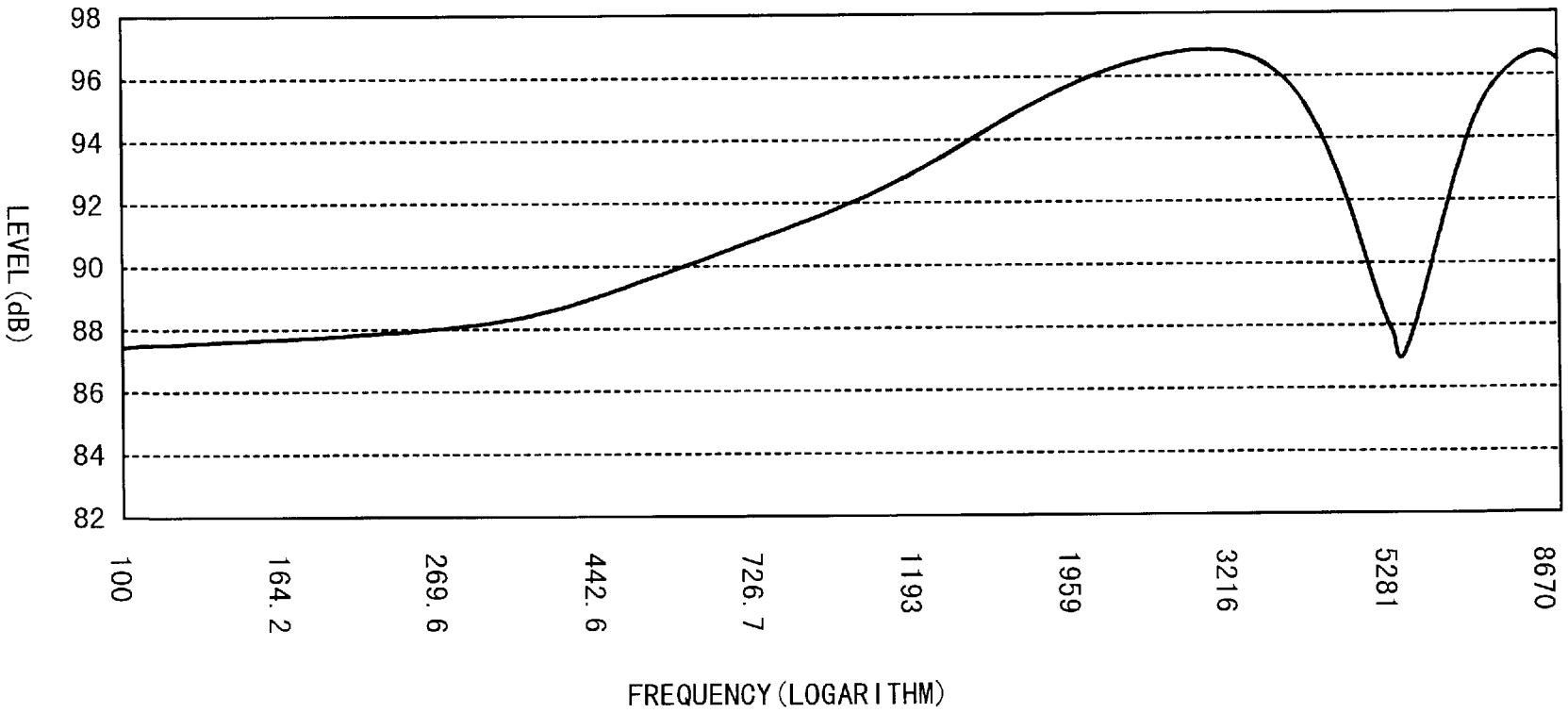
FIG. 38 graphically represents a disturbance in a frequency characteristic of a monophonic signal component, caused by a mixture of a reverse phase signal, in the stereophonic sound image enhancement apparatus according to the third aspect of the present invention.

FIG. 38 indicates a disturbance in a frequency characteristic of a monophonic signal component, which is caused by mixing a reverse-phase signal with the left input signal Lin and the right input signal Rin when neither the low-pass filter 204, nor the low-pass filter 214 is employed. As shown in FIG. 38, the monophonic signal components owns a comb filter characteristic, and reductions in a low frequency range are especially emphasized. As a result, the audience may hear sounds in such a manner that the higher the stereophonic sound image enhancement effect is increased (the larger, the value of "e" becomes). the softer the sound quality becomes. In this stereophonic sound image enhancement apparatus, the low-pass filters are provided at the output stage, and the sound quality is corrected in such a manner that the higher the stereophonic sound image enhancement effect is increased, the larger the filtering effects by the low-pass filters becomes, so that the above-described phenomenon can be suppressed.

The gain "e" is variable in a range from 0 to 1. In the case of e=0, the left input signal Lin directly constitutes the left output signal Lout, and the right input signal Rin directly constitutes the right output signal Rout. In the case of e=1, the filtering effects by the low-pass filters 204 and 214 become maximum.

Figure 39:
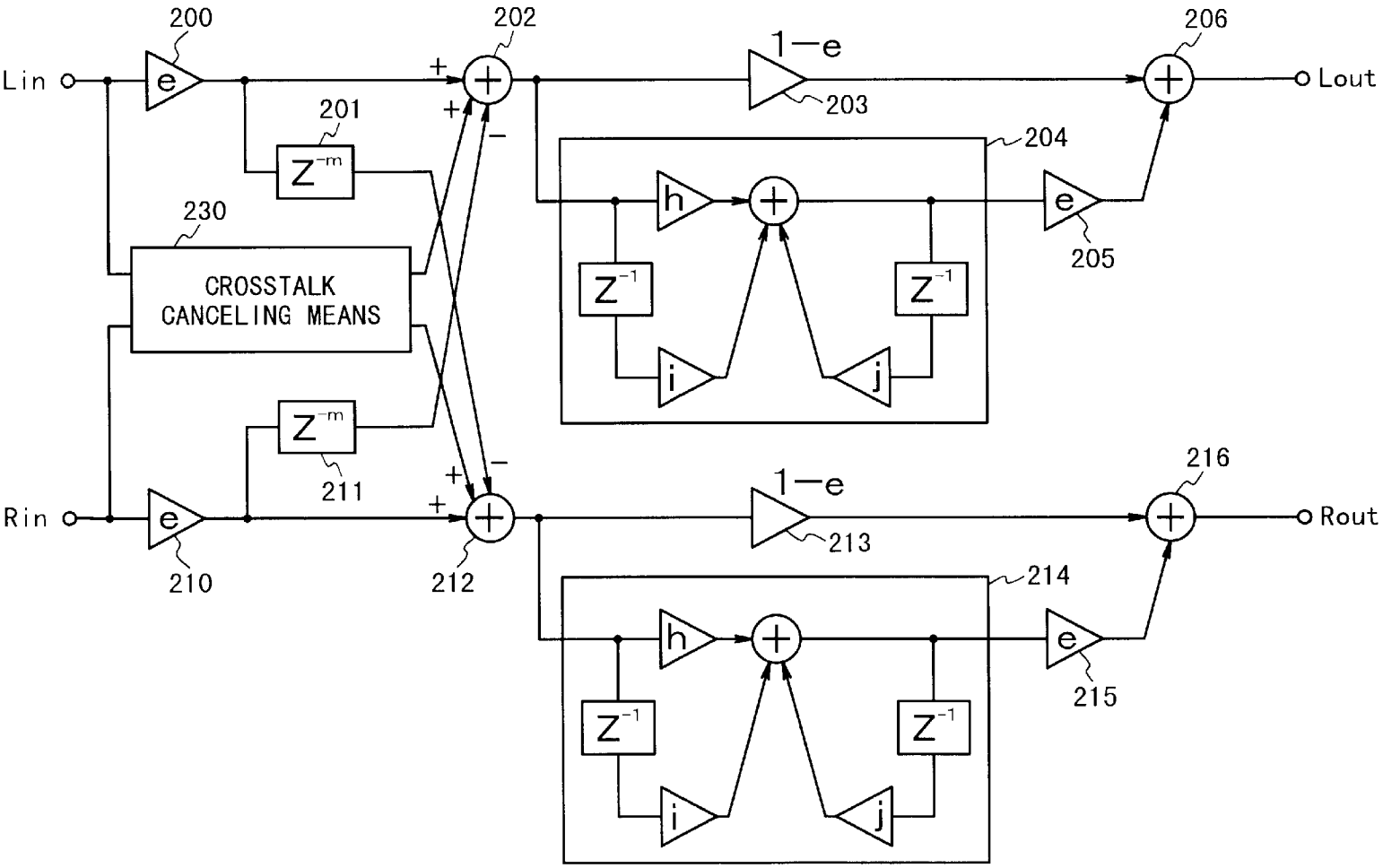
FIG. 39 is a schematic block diagram for showing a modification example of the embodiment 2 of the stereophonic sound image enhancement apparatus according to third aspect of the present invention.

FIG. 39 indicates a modification of this embodiment 4. In this modification, crosstalk canceling means is further employed. The adder 202 adds the left signal derived from this crosstalk canceling means to the output signal derived from the amplifier 200 (namely, a signal obtained by multiplying left input signal Lin by gain "e"), and then subtracts the output signal derived from the delay device 211 from the summation result. The adder 212 adds the right signal derived from this crosstalk canceling means to the output signal derived from the amplifier 210 (namely, a signal obtained by multiplying right input signal Rin by gain "e"), and subtracts the output signal derived from the delay device 201 from this summation result.

As the crosstalk canceling means, the above-explained crosstalk canceling means as described in the first example and the second example in the previous embodiment 3 may be utilized. Apparently, the conventional Schroeder type crosstalk canceling apparatus may be employed.

In accordance with the stereophonic sound image enhancement apparatus of this modification, since the sound quality is corrected based on the magnitudes of the stereophonic sound image enhancement effects, even when the stereophonic sound image enhancement effect is increased, the sound quality is not deteriorated. Moreover, the audience easily hear the sound images that are clearly localized at the position apart from the audience, and also can have a very wide feeling.

When both the left input signal Lin and the right input signal Rin are such binaural signals to which an head related transfer function has been added, the sound images can be controlled by the two-channel loudspeaker reproduction. Also, in this case, the higher the stereophonic sound image enhancement effect is increased, the softer the sound quality becomes. As a result, if the L-channel sound quality correcting means and the R-channel sound quality correcting means are employed at the output stage so as to correct the sound quality, then such a drawback that the sound quality becomes soft can be eliminated.

Embodiment 5

Figure 40:
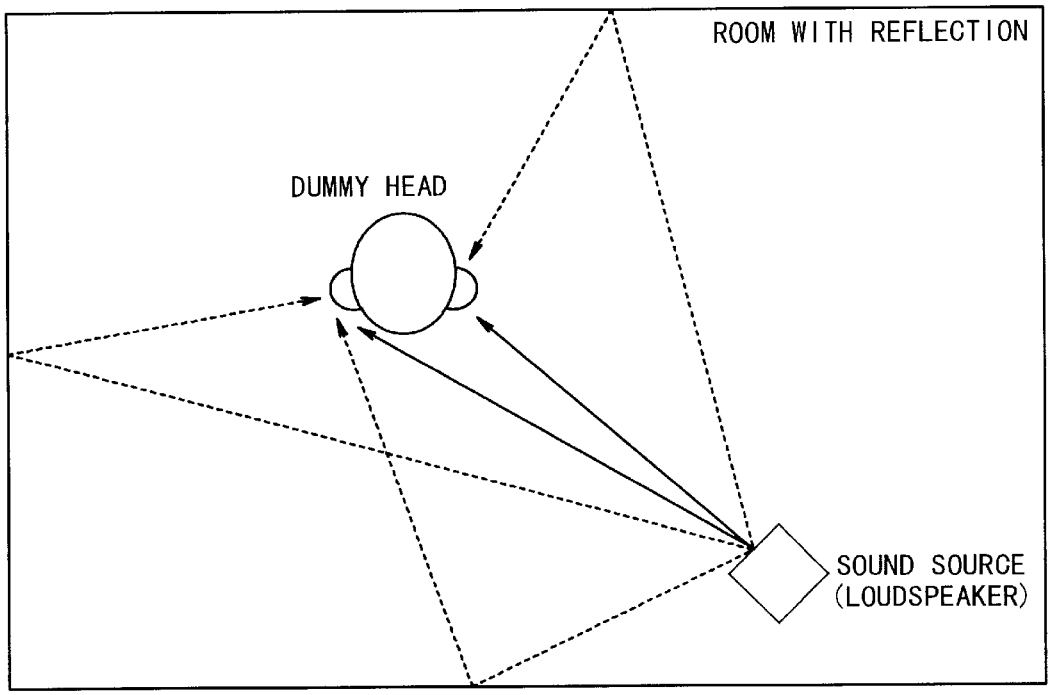
FIG. 40 is an explanatory diagram for explaining the measurement of the head related transfer function (head related impulse response) in the sound image control apparatus according to the fourth aspect of the present invention.

A sound image control apparatus according to a fifth aspect of the present invention will now be described. A head related transfer function (head related impulse response) in the sound image control apparatus of this embodiment 5 may be obtained by a measurement. As illustrated in FIG. 40, the measurement is carried out not in a non-reflection room, but in a room where a certain amount of reflection occurs. This is because a sound image can be clearly localized in such a room with reflection, rather than the non-reflection room. The measurement is performed by employing a dummy head while impulse sounds produced from a sound source (loudspeaker) are acquired.

Sounds which directly reach from the loudspeaker to right/left ears of the dummy head correspond to direct sounds, which are indicated by a solid line in FIG. 40. Sounds which reach from the loudspeaker via walls (involving floors and ceilings) to the right/left ears correspond to reflection sounds, which are indicated by a broken line. When the above-described measurement is carried out while changing the position of the sound source, it is possible to acquire data about the head related transfer functions (head related impulse response) along various directions. It should be noted that the data about the head related transfer function may be produced by way of the TSP (time stretch pulse) method.

Figure 41A:
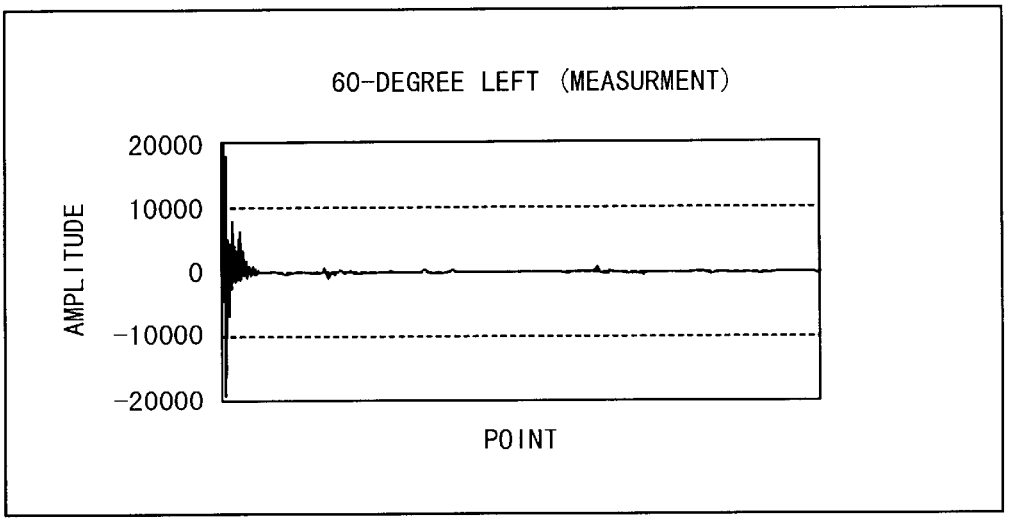
FIG. 41A and FIG. 41B graphically show one example of impulse responses measured in the sound image control apparatus according to the fourth aspect of the present invention.
Figure 41B:
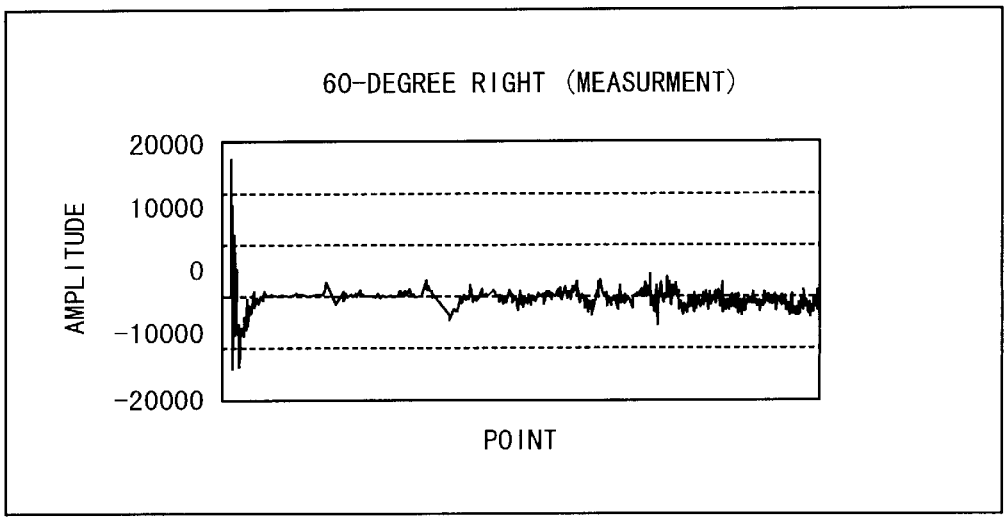

In FIG. 41A and FIG. 41B, there are shown one example of measured head related impulse response. That is, FIG. 41A graphically indicates the head related impulse response of the left ear when the sound source is set at a left-inclined front position with an angle of 60 degrees. FIG. 41B graphically indicates the head related impulse response of the right ear when the sound source is set at a right-inclined front position with an angle of 60 degrees. When this head related impulse response is convoluted with the input sounds and the convoluted sounds are heard by using the headphone, the audience may realize that the position of the sound source corresponds to the left-inclined front position with the angle of 60 degrees.

However, the point number of the impulse responses shown in FIG. 41A and FIG. 41B is 150 points (at sampling frequency of 48 kHz), so that a large-scaled hardware is necessarily required to perform the convolution process operation. Therefore, as will be explained later, since the L-channel/R-channel head related transfer function applying means employed in the sound image control apparatus according to the fifth aspect of the present invention are constructed of a portion for simulating a direct sound, and also a portion for simulating a reflection sound, the overall hardware of this sound image control apparatus can be made simple.

Figure 12:
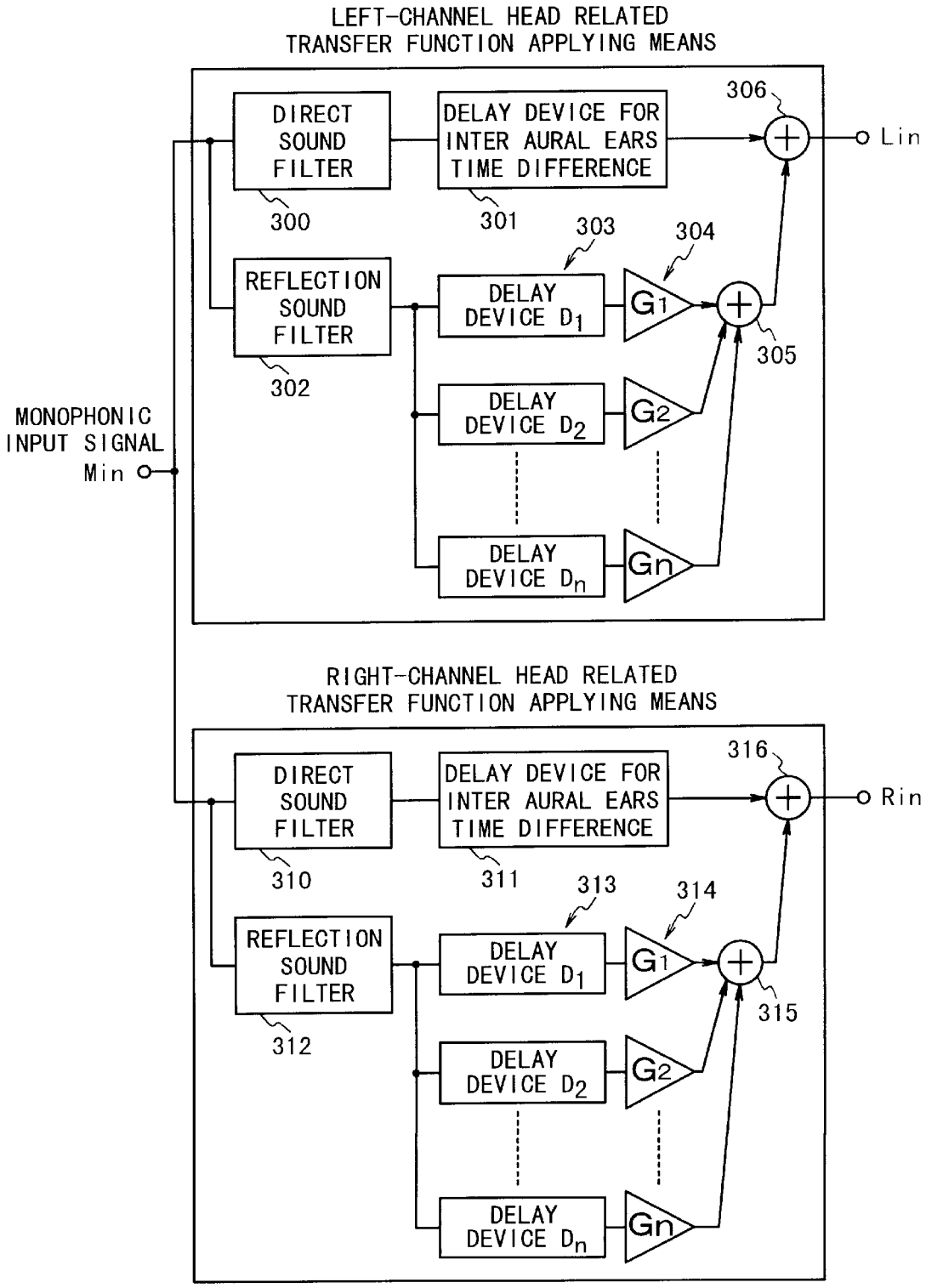
FIG. 12 is a schematic block diagram for indicating arrangement of L-channel head related transfer function applying means and R-channel head related transfer function applying means employed in the sound image control apparatus according to the fifth aspect of the present invention.

In other words, as shown in FIG. 12, each of the L-channel/R-channel head related transfer function applying means is arranged by a portion for simulating direct sounds, another portion for simulating reflection sounds, and an adding unit for adding them.

The portion for simulating the direct sounds in the L-channel head related transfer function applying means is arranged by a direct-sound filter 300 for filtering a monophonic input signal Min, and a delay device 301 for inter aural time difference, which delays the output signal from this direct-sound filter 300. Also, the portion for simulating the reflection sounds is arranged by a reflection-sound filter 302 for filtering the monophonic input signal Min; a delay unit 303 constructed of a plurality of delay devices $D_1$ to $D_n$ for delaying the output signal from this reflecting-sound filter 302; an amplifier unit 304 constructed of a plurality of amplifiers $G_1$ to $G_n$ for amplifying the output signals from the respective delay devices $D_1$ to $D_n$; and also a reflection-sound adder 305 for adding the output signals from a plurality of amplifiers $G_1$ to $G_n$.

Figure 11:
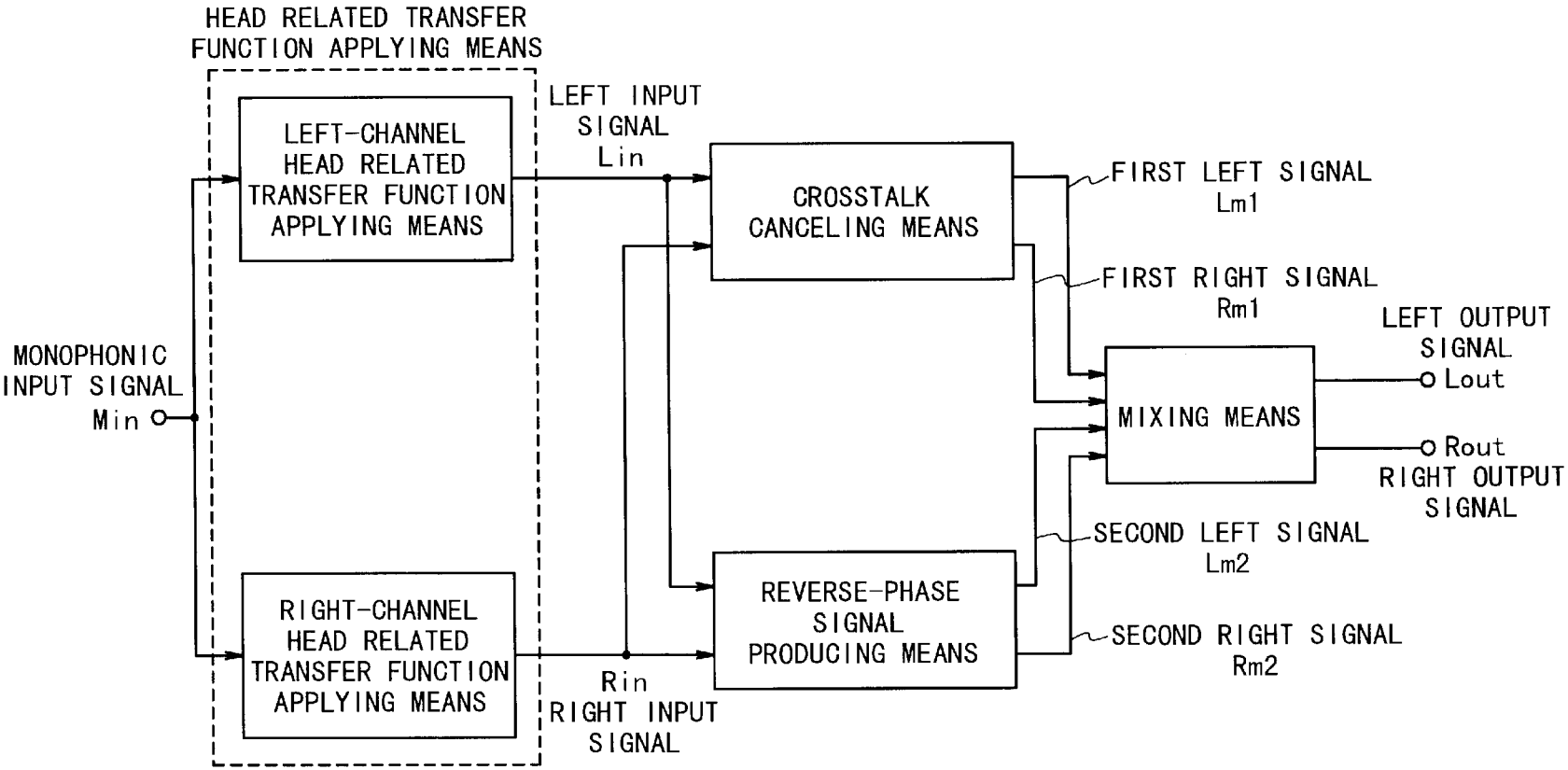
FIG. 11 is a schematic block diagram for showing an arrangement of a sound image control apparatus according to a fifth aspect of the present invention.

The above-described adding unit is arranged by an adder 306 for adding the output signal from the delay device 301 for inter aural time difference to the output signal from the reflection-sound adder 305. The output signal derived from this adder 306 is supplied as the left input signal Lin to the crosstalk canceling means and the reverse-phase signal producing means (see FIG. 11).

Similarly, the portion for simulating the direct sounds in the R-channel head related transfer function applying means is arranged by a direct-sound filter 310 for filtering the monophonic input signal Min, and a delay device 311 for inter aural time difference, which delays the output signal from this direct-sound filter 310. Also, the portion for simulating the reflection sounds is arranged by a reflection-sound filter 312 for filtering the monophonic input signal Min; a delay unit 313 constructed of a plurality of delay devices $D_1$ to $D_n$ for delaying the output signal from this reflecting-sound filter 312; an amplifier unit 314 constructed of a plurality of amplifiers $G_1$ to $G_n$ for amplifying the output signals from the respective delay devices $D_1$ to $D_n$; and also a reflection-sound adder 315 for adding the output signals from a plurality of amplifiers $G_1$ to $G_n$.

The above-described adding unit is arranged by an adder 316 for adding the output signal from the delay device 311 for inter aural time difference to the output signal from the reflection-sound adder 315. The output signal derived from this adder 316 is supplied as the right input signal Rin to the crosstalk canceling means and the reverse-phase signal producing means.

Both the direct-sound filters 300 and 310 simulate the frequency characteristics of the head related transfer functions of the sounds which directly reach from the sound source (e.g., loudspeaker) to the ears of the audience. The delay devices 301 and 311 for inter aural time difference simulate the time differences of the sounds at the right/left ears, which directly reach from the sound source to the ears of the audience. The reflection-sound filters 302 and 312 simulate the changes in the frequencies caused by the reflections occurred in the room. The delay units 303 and 313, the amplifier units 304 and 314, and the reflection-sound adders 305 and 315 may realize the reach times of the reflection sounds to the right/left ears in the room, and the levels of the reflection sounds when reached the right/left ears. Then, the adders 306 and 316 add the signals corresponding to the direct sounds, derived from the delay devices 301 and 311 for inter aural time difference to the signals corresponding to the reflection sounds, derived from the reflection-sound adders 305 and 315. These adders 306 and 316 outputs the summation result as either the left input signal Lin or the right input signal Rin.

Figure 42A:
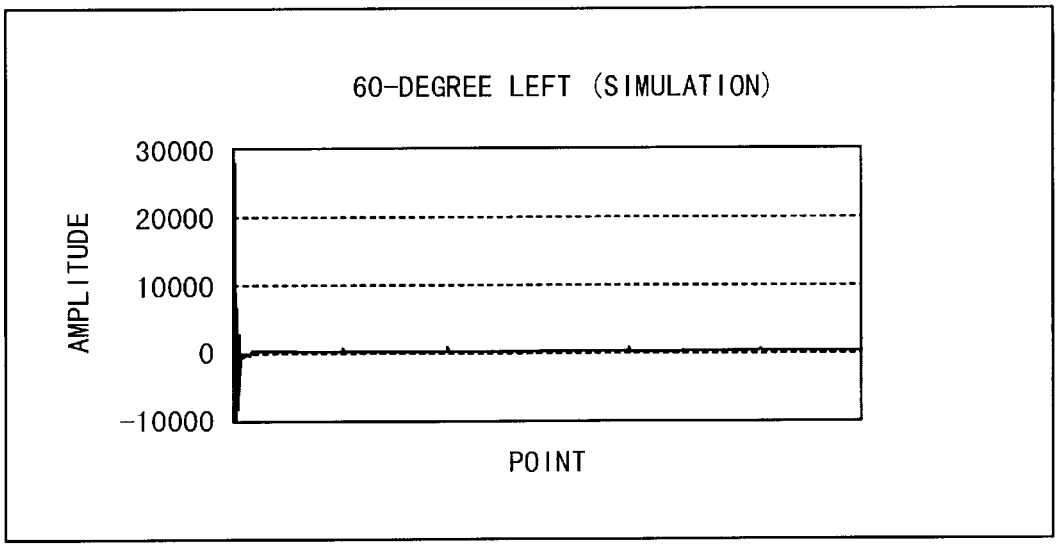
FIG. 42A and FIG. 42B graphically show one example of impulse responses simulated by using the head related transfer function applying means in the sound image control apparatus according to the fourth aspect of the present invention.
Figure 42B:
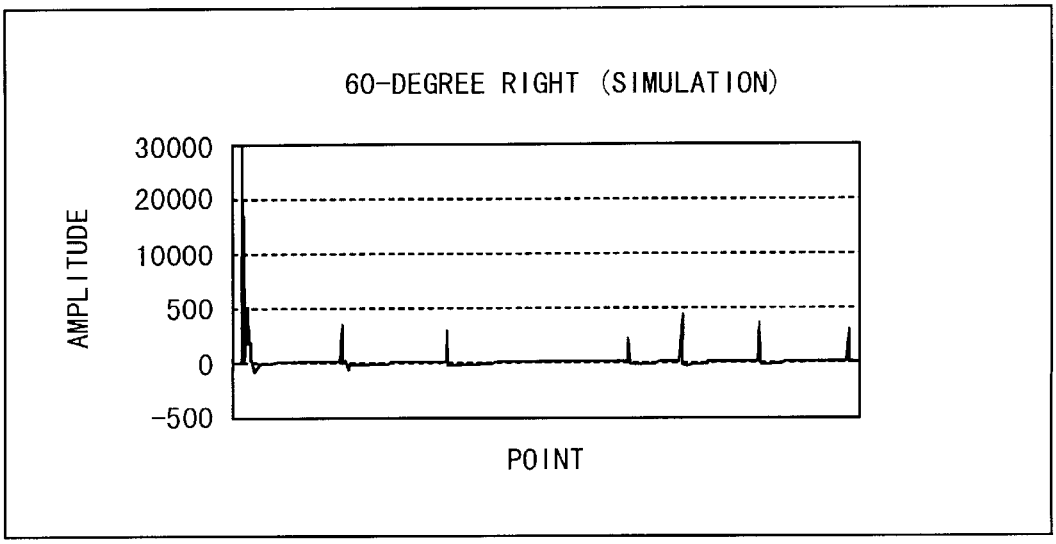

FIG. 42A and FIG. 42B graphically show impulse responses simulated by the head related transfer function applying means. The portion for simulating the direct sounds is equally made by employing an IIR filter and a delay device, whereas the portion for simulating the reflection sounds is equally made by employing an IIR filter, a multiplier, and a delay device. The impulse response shown in FIG. 42A and FIG. 42B are obtained from such an example that the direct-sound filter is arranged by a sixth-order IIR filter, and the reflection-sound filter is arranged by a third-order IIR filter, and further a number of taps on the delay device included in the portion for simulating the reflection sounds are selected to be 8. Apparently, the L-channel/R-channel head related transfer function applying means are not limited those arrangement.

As previously explained, since the head related transfer function are applied to the monophonic input signal Min by the L-channel head related transfer function applying means and the R-channel head related transfer function applying means, the sound images can be localized at any arbitrary positions while the audience hears the sounds by using the headphone.

Figure 43:
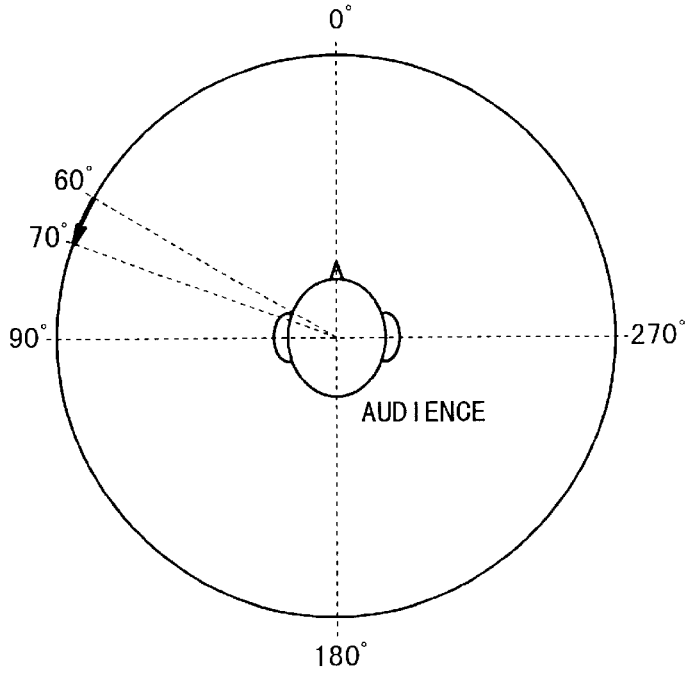
FIG. 43 is an explanatory diagram for explaining movement of a sound image in the sound image control apparatus according to the fourth aspect of the present invention.

Next, a method for moving a sound image in this sound image control apparatus according to the embodiment 5 will now be explained. As indicated in FIG. 43, when a front direction is set to 0 degree and a rear direction is set to 180 degrees, considering now such a case that the sound image is moved every 10 degrees on the horizontal plane by using the data about the head related transfer function.

For instance, in such a case that the values of the filter coefficient and the delay amount are varied from the direction of 60 degrees to the direction of 70 degrees in the head related transfer function applying means shown in FIG. 12, if the input signal is continued, then noise will occur due to waveform distortions. To suppress this noise, the sound image is moved by replacing the 60-degree data by the 70-degree data in such a manner that these degree data are mutually cross-faded. As a consequence, the sound image localization process operation along the two directions is continuously performed, and the data along the different directions are replaced with each other in such a way that these data are cross-faded based upon the direction changing information. The direction changing information may be manually entered by the user, or may be automatically entered by the processing apparatus such as the CPU.

Figure 44:
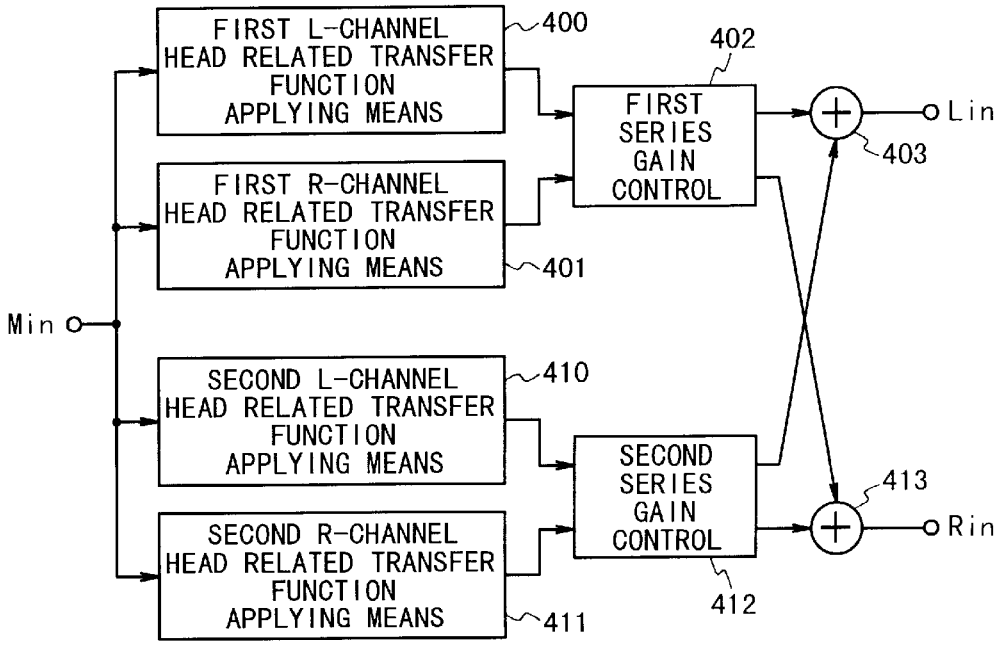
FIG. 44 is a block diagram for indicating an arrangement of sound image movement means employed in the sound image control apparatus according to the fourth aspect of the present invention.

FIG. 44 is a schematic block diagram of an arrangement of this sound image control apparatus capable of smoothly moving the sound image along the adjacent directions while cross-fading these degree data. In FIG. 44, first L-channel head related transfer function applying means 400 is used to apply an L-channel head related transfer function corresponding to a first direction to the monophonic input signal Min. First R-channel head related transfer function applying means 401 is used to apply an R-channel head related transfer function corresponding to the first direction to the monophonic input signal Min. Similarly, second L-channel head related transfer function applying means 410 is used to apply an L-channel head related transfer function corresponding to a second direction to the monophonic input signal Min. Second R-channel head related transfer function applying means 411 is used to apply an R-channel head related transfer function corresponding to the second direction to the monophonic input signal Min.

A first series gain control circuit 402 corresponds to first weighting means employed in the sound image control apparatus according to the fifth aspect of the present invention. This first series gain control circuit 402 applies a weight "$\alpha$" to the respective signals derived from the first L-channel head related transfer function applying means and the first R-channel head related transfer function applying means in response to an instruction issued from direction instructing means. In this case, $0 \leqq \alpha \leqq 1$. This first series gain control circuit 402 may be constituted by a multiplier for multiplying the respective signals derived from the first L-channel head related transfer function applying means 400 and the first R-channel head related transfer function applying means 401 by the weighting coefficient "$\alpha$".

Similarly, a first series gain control circuit 412 corresponds to second weighting means employed in the sound image control apparatus according to the fifth aspect of the present invention. This second series gain control circuit 412 applies a weight "$1-\alpha$" to the respective signals derived from the second L-channel head related transfer function applying means and the second R-channel head related transfer function applying means in response to an instruction issued from the direction instructing means. This second series gain control circuit 412 may be constituted by a multiplier for multiplying the respective signals derived from the second L-channel head related transfer function applying means 410 and the second R-channel head related transfer function applying means 411 by the weighting coefficient "$1-\alpha$".

An adder 403 corresponds to left mixing means employed in the sound image control apparatus according to the fifth aspect of the present invention. This adder 403 mixes the signal derived from the first L-channel head related transfer function applying means, to which the weight "$\alpha$" has been applied by the first series gain control circuit 402, with the signal derived from the second L-channel head related transfer function applying means, to which the weight "$1-\alpha$" has been applied by the second series gain control circuit 412. Then, this adder 403 produces the left input signal accordingly.

Similarly, an adder 413 corresponds to right mixing means employed in the sound image control apparatus according to the fifth aspect of the present invention. This adder 413 mixes the signal derived from the first R-channel head related transfer function applying means, to which the weight "a" has been applied by the first series gain control circuit 402, with the signal derived from the second R-channel head related transfer function applying means, to which the weight "$1-\alpha$" has been applied by the second series gain control circuit 412. Then, this adder 413 produces the right input signal accordingly.

In the above-described arrangement, while setting the data about the 60-degree direction to the first L-channel head related transfer function applying means 400 and the first R-channel head related transfer function applying means 401, and also setting the data about the 70-degree direction to the second L-channel external transfer function applying means 410 and the second R-channel head related transfer function applying means 411, the sound image is moved by changing the weighting factor "$\alpha$". When the present data is replaced by the data about the new direction, while the gain of this series is set to "0", if the gain is gradually increased in accordance with the time elapse, then the noise caused by replacing these data can be eliminated.

It should be understood that the direction determined by the head related transfer function may be selected from any planes other than the horizontal plane, for instance, the upper/lower/right/left directions, and the near distance up to the far distance. As previously described, when the audience hears the sounds by using the headphone, the sound images can be smoothly moved to any places within the three-dimensional space by way of the head related transfer function applying means.

Subsequently, an example of a sound image control system for utilizing the above-explained sound image control apparatus will now be described with reference to drawings. It should be noted that an electronic circuit of this sound image control system is identical to the electronic circuit (see FIG. 36) of the stereophonic sound image enhancement apparatus according to the third aspect of the present invention. However, this electronic circuit owns such a different arrangement that a variable resistor 172*c* and a joy stick 172*d* are additionally provided with the input apparatus 172.

Figure 45:
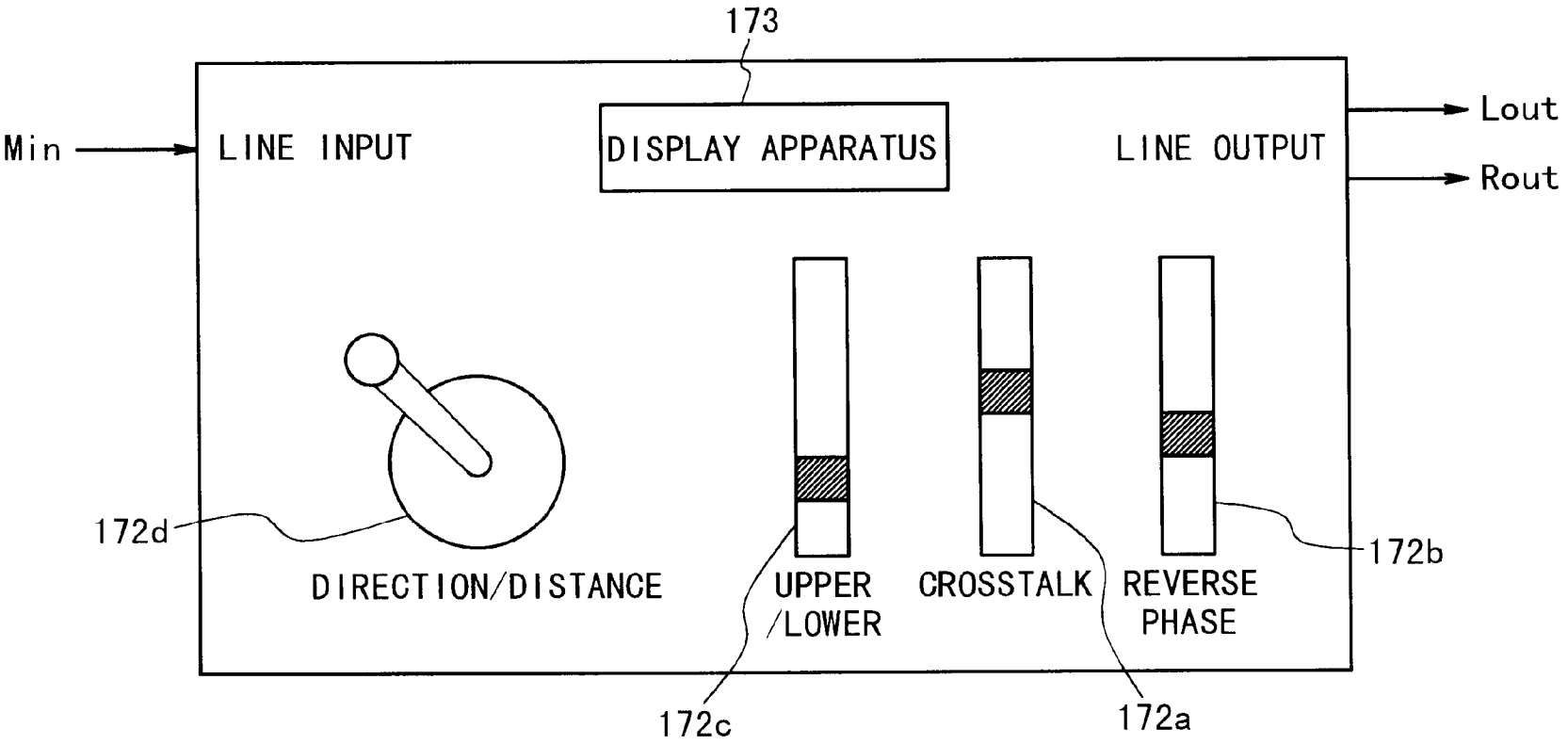
FIG. 45 is an outer view for representing a sound image control system, as viewed from an upper surface thereof, to which the sound image control apparatus of the embodiment 4 of the present invention is applied.

FIG. 45 is an outer view of this sound image control system, as viewed from an upper surface thereof. In this sound image control system, the process operation is carried out by inputting the monophonic input signal Min from a line input terminal and by applying the head related transfer function to this monophonic input signal, and both the crosstalk canceling process operation and the reverse-phase signal mixing process operation are performed. In addition, the processed signals are outputted as the left output signal Lout and the right output signal Rout from the line output terminal.

The variable resistor 172*a* of the input apparatus 172 is used to instruct an amount of crosstalk canceling. A gain "a" is determined in response to a signal derived from this variable resistor 172*a*. Another variable resistor 172*b* is used to instruct a mixing amount of a reverse-phase signal. Another gain "e" is determined based upon a signal derived from this variable resistor 172*b*. Another variable resistor 172*c* is used to instruct upper/lower directions of a sound image. The joy stick 172*d* of the input apparatus 172 is employed so as to determine an angle (0 to 360 degrees) of the sound image along the horizontal direction, and a distance measured from the audience. A weighting factor "α" is determined in response to the signal from this variable resistor 172*c* and the signal from the joy stick 172*d*.

FIG. 36 is a schematic block diagram for representing an arrangement of an electronic circuit of the sound image control system. A DSP 161 is operated in a different manner from that of the stereophonic sound image enhancement apparatus according to the third aspect of the present invention. That is, both the crosstalk canceling process operation and the reverse-phase signal mixing process operation are carried out in accordance with the control data supplied from a CPU 170, and also the head related transfer function is applied to the monophonic input signal Min in the above-described manner.

The CPU 170 reads the filter coefficient from a memory 171 and then supplies the read filter coefficient as the control data to the DSP 161. The CPU 170 receives the signals produced from the variable resistors 172*a* to 172*c* and the joy stick 172*d*, and converts these signals into values indicative of the weighting factor "α", the gain a and the gain "e". Then, this CPU 170 supplies the converted values as the control data to the DSP 161. In response to the data indicative of the weighting factor "α", the gains "a" and "e", and further the filter coefficient, the DSP 161 executes the above-described head related transfer function applying process operation, the crosstalk canceling process operation, and the reverse-phase signal mixing process operation.

It should also be noted that this sound image control apparatus may be solely used, but alternatively, may be assembled into other apparatuses as a multi-effector, and reverberation generator. As these other apparatuses, for instance, a sound source module, an electronic piano, an electronic keyboard, a game machine, and an acoustic appliance may be employed.

What is claimed is:

1. A stereophonic sound image enhancement apparatus comprising:

crosstalk canceling means for producing a first left signal formed by subtracting a right crosstalk signal from a left input signal, and a first right signal formed by subtracting a left crosstalk signal from a right input signal;

reverse-phase signal producing means for producing a second left signal formed by mixing a reverse-phase signal of the right input signal with the left input signal, and a second right signal formed by mixing a reverse-phase signal of the left input signal with the right input signal; and mixing means for mixing the first left signal derived from said crosstalk canceling means with the second left signal derived from said reverse-phase signal producing means to produce a left output signal, and for mixing the first right signal derived from said crosstalk canceling means with the second right signal derived from said reverse-phase signal producing means to produce a right output signal, wherein said crosstalk canceling means comprises left crosstalk signal producing means for producing the left crosstalk signal based on the left input signal;

right crosstalk signal producing means for producing the right crosstalk signal based on the right input signal;

a left-channel crosstalk calculator for subtracting the right crosstalk signal from the left input signal;

a first left-channel crosstalk filter for filtering a signal derived from said left-channel crosstalk calculator to produce the first left signal;

a right-channel crosstalk calculator for subtracting the left crosstalk signal from the right input signal; and a first right-channel crosstalk filter for filtering a signal derived from said right-channel crosstalk calculator to product the first right signal.

2. The stereophonic sound image enhancement apparatus according to claim 1, wherein said left crosstalk signal producing means includes a left-channel crosstalk attenuator for attenuating said left input signal;

a left-channel crosstalk delay device for delaying an output signal derived from said left-channel crosstalk attenuator; and a second left-channel crosstalk filter for filtering an output signal derived from said left-channel crosstalk delay device to output said right crosstalk signal, and wherein said right crosstalk signal producing means includes a right-channel crosstalk attenuator for attenuating said right input signal;

a right-channel crosstalk delay device for delaying an output signal derived from said right-channel crosstalk attenuator; and a second right-channel crosstalk filter for filtering an output signal derived from said right-channel crosstalk delay device to output said left crosstalk signal, wherein a filter coefficient of said first left-channel crosstalk filter is determined based on a amplification coefficient of said right-channel crosstalk attenuator, a delay coefficient of said right-channel crosstalk delay device and a filter coefficient of said second right-channel crosstalk filter, and a filter coefficient of said first right-channel crosstalk filter is determined based on a amplification coefficient of said left-channel crosstalk attenuator, a delay coefficient of said left-channel crosstalk delay device and a filter coefficient of said second left-channel crosstalk filter.

3. The stereophonic sound image enhancement apparatus according to claim 1, wherein said reverse-phase signal producing means comprises:

a left-channel reverse-phase attenuator for attenuating the left input signal;

a left-channel reverse-phase delay device for delaying an output signal derived from said left-channel reverse-phase attenuator;

a right-channel reverse-phase attenuator for attenuator for attenuating the right input signal;

a right-channel reverse-phase delay device for delaying an output signal derived from said right-channel reverse-phase attenuator;

a left-channel reverse-phase calculator for subtracting the output signal derived from said right-channel reverse-phase delay device from the output signal derived from said left-channel reverse-phase attenuator to produce the second left signal; and a right-channel reverse-phase calculator for subtracting the output signal derived from said left-channel reverse phase delay device from the output signal derived from said right-channel reverse-phase attenuator to produce the second right signal.

4. The stereophonic sound image enhancement apparatus according to claim 1, wherein said reverse-phase signal producing means comprises:

a left-channel reverse-phase attenuator for attenuating said left input signal by multiplying said left input signal by a gain "e";

a left-channel reverse-phase delay device for delaying an output signal from said left-channel reverse-phase attenuator;

a right-channel reverse-phase attenuator for attenuating said right input signal by multiplying said right input signal by a gain "e";

a right-channel reverse-phase delay device for delaying an output signal from said right-channel reverse-phase attenuator;

a left-channel reverse-phase calculator for mixing said left input signal, the output signal from said right-channel reverse-phase delay device and the output signal from said left-channel reverse-phase attenuator;

a right-channel reverse-phase calculator for mixing said right input signal, the output signal from said left-channel reverse-phase delay device and the output signal from said right-channel reverse-phase attenuator;

left-channel sound quality correcting means for adding a signal obtained by multiplying an output signal from said left-channel reverse-phase calculator by a gain (1−e) to another signal obtained by filtering the output signal from said left-channel reverse-phase calculator by way of a low-pass filter and by multiplying the filtered signal by the gain "e" to output this adding result as the second left signal; and right-channel sound quality correcting means for adding a signal obtained by multiplying an output signal derived from said right-channel reverse-phase calculator by a gain (1−e) to another signal obtained by filtering the output signal from said right-channel reverse-phase calculator by way of a low-pass filter and by multiplying the filtered signal by the gain "e" to output this adding result as the right output signal.

5. The stereophonic sound image enhancement apparatus according to claim 1, further comprising:

head related transfer function applying means including left-channel head related transfer function applying means for applying a left-channel head related transfer function to a monophonic input signal to output the resultant signal as said left input signal, and right-channel head related transfer function applying means for applying a right-channel head related transfer function to said monophonic input signal to output the resultant signal as said right input signal.

6. The sound image control apparatus according to claim 5, further comprising:

direction instructing means for instructing a direction along which a sound image is moved, wherein said head related transfer function applying means comprises:

first left-channel head related transfer function applying means for applying a left-channel head related transfer function corresponding to a first direction;

first right-channel head related transfer function applying means for applying a right-channel head related transfer function corresponding to said first direction;

second left-channel head related transfer function applying means for applying a left-channel head related transfer function corresponding to a second direction;

second right-channel head related transfer function applying means for applying a right-channel head related transfer function corresponding to said second direction;

first weighting means for applying a weighting factor "α" to the respective signals derived from said first left-channel head related transfer function applying means and from said first right-channel head related transfer function applying means in response to the instruction issued from said direction instructing means:

second weighting means for applying a weighting factor "1−α" to the respective signals derived from said second left-channel head related transfer function applying means and from said second right-channel head related transfer function applying means in response to the instruction issued from said direction instructing means;

left mixing means for mixing a signal derived from said first left-channel head related transfer function applying means to which the weighting factor "α" has been applied by said first weighting means with another signal derived from said second left-channel head related transfer function applying means to which the weighting factor "1−α" has been applied by said second weighting means to thereby produce the left input signal; and right mixing means for mixing a signal derived from said first right-channel head related transfer function applying means to which the weighting factor "α" has been applied by said first weighting means with another signal derived from said second right-channel head related transfer function applying means to which the weighting factor "1−α" has been applied by said second weighting means to thereby produce the right input signal; under which $0 \leqq \alpha \leqq 1$.

7. The sound image control apparatus according to claim 5, further comprising:

direction instructing means for instructing a direction along which a sound image is moved, wherein said head related transfer function applying means is constructed of:

first left-channel head related transfer function applying means for applying a left-channel head related transfer function corresponding to a first direction;

first right-channel head related transfer function applying means for applying a right-channel head related transfer function corresponding to said first direction;

second left-channel head related transfer function applying means for applying a left-channel head related transfer function corresponding to a second direction;

second right-channel head related transfer function applying means for applying a right-channel head related transfer function corresponding to said second direction;

first weighting means for applying a weighting factor "α" to the respective signals derived from said first left-channel head related transfer function applying means and from said first right-channel head related transfer function applying means in response to the instruction issued from said direction instructing means;

second weighting means for applying a weighting factor "1−α" to the respective signals derived from said second left-channel head related transfer function applying means and from said second right-channel head related transfer function applying means in response to the instruction issued from said direction instructing means;

left mixing means for mixing a signal derived from said first left-channel head related transfer function applying means to which the weighting factor "α" has been applied by said first weighting means with another signal derived from said second left-channel head related transfer function applying means to which the weighting factor "1−α" has been applied by said second weighting means to thereby produce the left input signal; and right mixing means for mixing a signal derived from said first right-channel head related transfer function applying means to which the weighting factor "α" has been applied by said first weighting means with another signal derived from said second right-channel head related transfer function applying means to which the weighting factor "1−α" has been applied by said second weighting means to thereby produce the right input signal; under which $0 \leqq \alpha \leqq 1$.

8. The stereophonic sound image enhancement apparatus according to claim 5, wherein said reverse-phase signal producing means comprises:

a left-channel reverse-phase attenuator for attenuating the left input signal;

a left-channel reverse-phase delay device for delaying an output signal derived from said left-channel reverse-phase attenuator;

a right-channel reverse-phase attenuator for attenuating the right input signal;

a right-channel reverse-phase delay device for delaying an output signal derived from said right-channel reverse phase attenuator;

a left-channel reverse-phase calculator for subtracting an output signal derived from said right-channel delay device from the output signal derived from said left-channel reverse-phase attenuator to produce the second left signal; and a right-channel reverse-phase calculator for subtracting an output signal derived from said left-channel delay device from the output signal derived from said right-channel reverse-phase attenuator to produce the second right signal.

9. The stereophonic sound image enhancement apparatus according to claim 8, further comprising:

direction instructing means for instructing a direction along which a sound image is moved, wherein said head related transfer function applying means comprises:

first left-channel head related transfer function applying means for applying a left-channel head related transfer function corresponding to a first direction;

first right-channel head related transfer function applying means for applying a right-channel head related transfer function corresponding to said first direction;

second left-channel head related transfer function applying means for applying a left-channel head related transfer function corresponding to a second direction;

second right-channel head related transfer function applying means for applying a right-channel head related transfer function corresponding to said second direction;

first weighting means for applying a weighting factor "α" to the respective signals derived from said first left-channel head related transfer function applying means and from said first right-channel head related transfer function applying means in response to the instruction issued from said direction instructing means;

second weighting means for applying a weighting factor "1−α" to the respective signals derived from said second left-channel head related transfer function applying means and from said second right-channel head related transfer function applying means in response to the instruction issued from said direction instructing means;

left mixing means for mixing a signal derived from said first left-channel head related transfer function applying means to which the weighting factor "α" has been applied by said first weighting means with another signal derived from said second left-channel head related transfer function applying means to which the weighting factor "1−α" has been applied by said second weighting means to produce the left input signal; and right mixing means for mixing a signal derived from said first right-channel head related transfer function applying means to which the weighting factor "α" has been applied by said first weighting means with another signal derived from said second right-channel head related transfer function applying means to which the weighting factor "1−α" has been applied by said second weighting means to produce the right input signal; under which $0 \leqq \alpha \leqq 1$.

10. A stereophonic sound image enhancement apparatus comprising:

crosstalk canceling means for producing a first left signal formed by subtracting a right crosstalk signal from a left input signal, and a first right signal formed by subtracting a left crosstalk signal from a right input signal;

reverse-phase signal producing means for producing a second left signal formed by mixing a reverse-phase signal of the right input signal with the left input signal, and a second right signal formed by mixing a reverse-phase signal of the left input signal with the right input signal;

mixing means for mixing the first left signal derived from said crosstalk canceling means with the second left signal derived from said reverse-phase signal producing means to produce a left output signal, and for mixing the first right signal derived from said crosstalk canceling means with the second right signal derived from said reverse-phase signal producing means to produce a right output signal, head related transfer function applying means including left-channel head related transfer function applying means for applying a left-channel head related transfer function to a monophonic input signal to output the resultant signal as said left input signal, and right-channel head related transfer function applying means for applying a right-channel head related transfer function to said monophonic input signal to output the resultant signal as said right input signal;

direction instructing means for instructing a direction along which a sound image is moved, wherein said head related transfer function applying means is comprises:

first left-channel head related transfer function applying means for applying a left-channel head related transfer function corresponding to a first direction;

first right-channel head related transfer function applying means for applying a right-channel head related transfer function corresponding to said first direction;

second left-channel head related transfer function applying means for applying a left-channel head related transfer function corresponding to said second direction;

second right-channel head related transfer function applying means for applying a right-channel head related transfer function corresponding to said second direction;

first weighting means for applying a weighting factor "α" to the respective signals derived from said first left-channel head related transfer function applying means and from said first right-channel head related transfer function applying means in response to the instruction issued from said direction instructing means;

second weighting means for applying a weighting factor "1−α" to the respective signals derived from said second left-channel head related transfer function applying means and from said second right-channel head related transfer function applying means in response to the instruction issued from said direction instructing means;

left mixing means for mixing a signal derived from said first left-channel head related transfer function applying means to which the weighting factor "α" has been applied by said first weighting means with another signal derived from said second left-channel head related transfer function applying means to which the weighting factor "1−α" has been applied by said second weighting means to produce the left input signal; and right mixing means for mixing a signal derived from said first right-channel head related transfer function applying means to which the weighting factor "α" has been applied by said first weighting means with another signal derived from said second right-channel head related transfer function applying means to which the weighting factor "1−α" has been applied by said second weighting means to produce the right input signal; under which $0 \leqq \alpha \leqq 1$.

11. A stereophonic sound image enhancement apparatus comprising:

crosstalk canceling means for producing a first left signal formed by subtracting a right crosstalk signal from a left input signal, and a first right signal formed by subtracting a left crosstalk signal from a right input signal;

reverse-phase signal producing means for producing a second left signal formed by mixing a reverse-phase signal of the right input signal with the left input signal, and a second right signal formed by mixing a reverse-phase signal of the left input signal with the right input signal;

mixing means for mixing the first left signal derived from said crosstalk canceling means with the second left signal derived from said reverse-phase signal producing means to produce a left output signal, and for mixing the first right signal derived from said crosstalk canceling means with the second right signal derived from said reverse-phase signal producing means to produce a right output signal, head related transfer function applying means including left-channel head related transfer function applying means for applying a left-channel head related transfer function to a monophonic input signal to output the resultant signal as said left input signal, and right-channel head related transfer function applying means for applying a right-channel head related transfer function to said monophonic input signal to output the resultant signal as said right input signal;

wherein said reverse-phase signal producing means comprises:

a left-channel reverse-phase attenuator for attenuating the left input signal;

a left-channel reverse-phase delay device for delaying an output signal derived from said left-channel reverse-phase attenuator;

a right-channel reverse-phase attenuator for attenuating the right input signal;

a right-channel reverse-phase delay device for delaying an output signal derived from said right-channel reverse-phase attenuator;

a left-channel reverse-phase calculator for subtracting an output signal derived from said right-channel delay device from the output signal dervied from said left-channel reverse-phase attenuator to produce the second left signal;

a right-channel reverse-phase calculator for subtracting an output signal derived from said left-channel delay device from the output signal derived from said right-channel reverse-phase attenuator to produce the second right signal;

direction instructing means for instructing a direction along which a sound image is moved, wherein said head related transfer function applying means is comprises:

first left-channel head related transfer function applying means for applying a left-channel head related transfer function corresponding to a first direction;

first right-channel head related transfer function applying means for applying a right-channel head related transfer function corresponding to said first direction;

second left-channel head related transfer function applying means for applying a left-channel head related transfer function corresponding to said second direction;

second right-channel head related transfer function applying means for applying a right-channel head related transfer function corresponding to said second direction;

first weighting means for applying a weighting factor "α" to the respective signals derived from said first left-channel head related transfer function applying means and from said first right-channel head related transfer function applying means in response to the instruction issued from said direction instructing means;

second weighting means for applying a weighting factor "1−α" to the respective signals derived from said second left-channel head related transfer function applying means and from said second right-channel head related transfer function applying means in response to the instruction issued from said direction instructing means;

left mixing means for mixing a signal derived from said first left-channel head related transfer function applying means to which the weighting factor "$\alpha$" has been applied by said first weighting means with another signal derived from said second left-channel head related transfer function applying means to which the weighting factor "$1-\alpha$" has been applied by said second weighting means to produce the left input signal; and right mixing means for mixing a signal derived from said first right-channel head related transfer function applying means to which the weighting factor "a" has been applied by said first weighting means with another signal derived from said second right-channel head related transfer function applying means to which the weighting factor "$1-\alpha$" has been applied by said second weighting means to produce the right input signal; under which $0 \leqq \alpha \leqq 1$.

* * * * *